US010124946B2

(12) United States Patent
Lyzenga et al.

(10) Patent No.: US 10,124,946 B2
(45) Date of Patent: Nov. 13, 2018

(54) PACKAGES HAVING SEPARABLE SEALING FEATURES AND METHODS OF MANUFACTURING

(71) Applicant: Intercontinental Great Brands LLC, East Hanover, NJ (US)

(72) Inventors: Deborah A. Lyzenga, Whippany, NJ (US); Ronald H. Exner, Munich (DE); Jeffrey T. Weber, Deerfield, IL (US); Leonard S. Scarola, Whippany, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 654 days.

(21) Appl. No.: 14/424,409

(22) PCT Filed: Feb. 14, 2014

(86) PCT No.: PCT/US2014/016366

§ 371 (c)(1),
(2) Date: Feb. 26, 2015

(87) PCT Pub. No.: WO2014/127188

PCT Pub. Date: Aug. 21, 2014

(65) Prior Publication Data

US 2015/0225158 A1 Aug. 13, 2015

Related U.S. Application Data

(60) Provisional application No. 61/765,633, filed on Feb. 15, 2013, provisional application No. 61/791,719,
(Continued)

(51) Int. Cl.
*B65D 73/00* (2006.01)
*B65D 75/58* (2006.01)
(Continued)

(52) U.S. Cl.
CPC ..... *B65D 75/58* (2013.01); *B65B 5/022* (2013.01); *B65B 7/08* (2013.01); *B65B 9/06* (2013.01);
(Continued)

(58) Field of Classification Search
CPC ..... B65B 5/022; B65B 7/08; B65D 5/5495; B65D 65/14; B65D 75/42; B65D 75/527; B65D 75/58
(Continued)

(56) References Cited

U.S. PATENT DOCUMENTS 276,171 A 4/1883 Fraser
1,842,727 A * 1/1932 Molins ..... B65D 5/5023 206/254
(Continued)

FOREIGN PATENT DOCUMENTS

CA 2823465 12/2014
CN 102300782 12/2011
(Continued)

OTHER PUBLICATIONS

English translation of Notification of Reasons for Refusal, dated Oct. 11, 2017, Japanese Patent Application No. 2015-534839 (5 pgs.).
(Continued)

*Primary Examiner* — Ernesto Grano
*Assistant Examiner* — Kaushikkumar Desai
(74) *Attorney, Agent, or Firm* — Fitch, Even, Tabin & Flannery, LLP

(57) ABSTRACT

A package includes a first pouch and either a second pouch or a cover, where the pouches are configured to contain a product, such as a food product, and attached relative to each other about a hinge. The package includes at least one closure flap. The first and second pouches or first pouch and
(Continued)

cover are movable about the hinge from a closed position where access is at least partially blocked by the closure flap toward an open position where the closure flap is separated to allow greater access. Methods of manufacturing such packages are also provided.

12 Claims, 43 Drawing Sheets

Related U.S. Application Data filed on Mar. 15, 2013, provisional application No. 61/880,097, filed on Sep. 19, 2013, provisional application No. 61/915,966, filed on Dec. 13, 2013.

(51) Int. Cl.

| | |
|---|---|
| ***B65D 75/52*** | (2006.01) |
| ***B65D 85/60*** | (2006.01) |
| ***B65B 5/02*** | (2006.01) |
| ***B65B 7/08*** | (2006.01) |
| ***B65D 65/14*** | (2006.01) |
| ***B65D 75/42*** | (2006.01) |
| ***B65D 75/20*** | (2006.01) |
| ***B65B 9/06*** | (2012.01) |
| ***B65B 25/00*** | (2006.01) |
| ***B65B 61/02*** | (2006.01) |
| ***B65B 61/20*** | (2006.01) |

(52) U.S. Cl.
CPC ..... *B65B 25/005* (2013.01); *B65B 61/02* (2013.01); *B65B 61/20* (2013.01); *B65D 65/14* (2013.01); *B65D 75/20* (2013.01); *B65D 75/42* (2013.01); *B65D 75/527* (2013.01); *B65D 75/585* (2013.01); *B65D 75/5833* (2013.01); *B65D 75/5855* (2013.01); *B65D 85/60* (2013.01); *B65B 2230/02* (2013.01); *B65D 2575/586* (2013.01)

(58) Field of Classification Search
USPC ..... 206/449, 476, 525.1, 800; 229/120.09, 229/120.21, 87.07
See application file for complete search history.

(56) References Cited

U.S. PATENT DOCUMENTS 1,863,190 A 6/1932 Coulapides
1,875,197 A * 8/1932 Molins ..... B65D 85/1063 206/256
2,009,659 A 7/1935 Hill
2,074,451 A 3/1937 Berberian
2,158,971 A 5/1939 Stratton
2,192,472 A 3/1940 Huston
2,197,845 A 4/1940 Ward
2,791,324 A 5/1957 Knoop
2,813,602 A * 11/1957 MacArthur, Jr. ..... A45C 3/00 190/108
2,873,058 A 2/1959 Janson
2,959,338 A * 11/1960 Thurston ..... B65D 85/1063 229/120.011
3,062,371 A 11/1962 Patience
3,162,539 A 12/1964 Repko
3,254,828 A 6/1966 Hershey
3,409,721 A 11/1968 Applezweig
3,478,871 A 11/1969 Sager
3,519,197 A 7/1970 Campbell
3,623,653 A 11/1971 Work
3,743,084 A 7/1973 Douglas
4,035,984 A 7/1977 Gerlach
4,131,195 A 12/1978 Worrell, Sr.
4,228,215 A 10/1980 Hein
4,567,986 A 2/1986 Eastwood
4,664,257 A 5/1987 Nilson
4,762,230 A 8/1988 Croce
4,785,940 A 11/1988 Wilson
4,805,767 A 2/1989 Newman
4,932,534 A 6/1990 Focke
5,131,760 A 7/1992 Farmer
5,141,106 A 8/1992 Adams
5,178,271 A 1/1993 Adams
5,180,056 A 1/1993 Adams
5,287,960 A 2/1994 Kalb
5,287,961 A 2/1994 Herran
5,409,116 A 4/1995 Aronsen
5,441,345 A 8/1995 Garvey
5,624,036 A 4/1997 Roulin
5,881,538 A 3/1999 Blohm
5,964,532 A 10/1999 St. Phillips
6,024,222 A 2/2000 Friberg
6,196,716 B1 3/2001 Geyer
6,253,920 B1 7/2001 Kallgren
6,499,878 B1 12/2002 Dobreski
6,547,113 B1 * 4/2003 Hancock ..... B62J 9/003 224/408
6,568,533 B1 5/2003 Tanaka
6,929,400 B2 8/2005 Razeti
7,025,207 B2 4/2006 Breu
7,121,064 B2 * 10/2006 Ausnit ..... B65B 9/093 493/927
7,159,717 B2 1/2007 Aldridge
7,325,686 B2 2/2008 Aldridge
7,533,773 B2 5/2009 Aldridge
7,569,008 B2 8/2009 Aldridge
7,686,165 B2 3/2010 Aldridge
7,699,166 B2 4/2010 Gauger
7,748,534 B2 7/2010 Jeannin
7,811,614 B2 10/2010 Aldridge
7,901,719 B2 3/2011 Aldridge
7,913,846 B2 3/2011 Aldridge
7,971,718 B2 7/2011 Aldridge
D645,735 S 9/2011 Clark
8,141,707 B2 3/2012 Robbins
8,152,037 B2 * 4/2012 Sabbag ..... B25H 3/00 206/373
8,172,086 B2 5/2012 Aldridge
8,205,751 B2 6/2012 Mezzini
8,221,812 B2 7/2012 Aldridge
8,252,352 B2 8/2012 Aldridge
8,393,469 B2 3/2013 Aldridge
8,485,728 B2 7/2013 Bowers
8,506,165 B2 8/2013 Shinozaki
8,534,538 B2 * 9/2013 Fitzwater ..... B65D 5/0254 229/120.08
8,607,980 B2 12/2013 Aldridge
8,658,229 B2 2/2014 Aldridge
8,684,180 B2 4/2014 Lee
8,691,305 B2 4/2014 Markovic
8,701,974 B2 4/2014 Davies
8,784,916 B2 * 7/2014 Zotter ..... B65D 65/10 206/449
2002/0097923 A1 7/2002 Dobreski
2003/0223656 A1 12/2003 Razeti
2004/0226843 A1 11/2004 Hermansson
2005/0252809 A1 11/2005 Aldridge
2005/0252817 A1 * 11/2005 Aldridge ..... B65D 5/009 206/525.1
2005/0269233 A1 12/2005 Aldridge
2006/0027483 A1 2/2006 Aldridge
2007/0199849 A1 8/2007 Aldridge
2007/0209954 A1 9/2007 Aldridge
2008/0054011 A1 3/2008 Grimard
2008/0152264 A1 6/2008 Pokusa
2010/0187145 A1 7/2010 Mezzini
2010/0294775 A1 11/2010 Gainey
2010/0297309 A1 11/2010 Onogi
2011/0003028 A1 1/2011 Onogi
2011/0017632 A1 1/2011 Lee
2011/0210163 A1 9/2011 Clark
2011/0232235 A1 9/2011 Aldridge

(56) References Cited

U.S. PATENT DOCUMENTS

| | | | | |
|---|---|---|---|---|
| 2011/0284532 | A1 | 11/2011 | Naik | |
| 2011/0303574 | A1 | 12/2011 | Aldridge | |
| 2012/0160852 | A1 | 6/2012 | Aldridge | |
| 2012/0241347 | A1 | 9/2012 | Bowers | |
| 2012/0241512 | A1 | 9/2012 | Markovic | |
| 2012/0325711 | A1 | 12/2012 | Markovic | |
| 2013/0095335 | A1 | 4/2013 | Hermel-Davidock | |
| 2013/0095336 | A1 | 4/2013 | Hermel-Davidock | |
| 2013/0182977 | A1 | 7/2013 | Gagne | |
| 2013/0189393 | A1 | 7/2013 | Traldi | |
| 2013/0199956 | A1 | 8/2013 | Hunter | |
| 2013/0233859 | A1 | 9/2013 | Safarik | |
| 2013/0327820 | A1 | 12/2013 | Clark | |
| 2014/0008258 | A1 | 1/2014 | Clark | |
| 2014/0008425 | A1 | 1/2014 | Clark | |
| 2014/0079343 | A1 | 3/2014 | Lyzenga | |
| 2014/0084046 | A1* | 3/2014 | Colon | B65D 5/0005 229/101.2 |
| 2014/0084048 | A1 | 3/2014 | Hammacher | |
| 2014/0166660 | A1 | 6/2014 | Lee | |

FOREIGN PATENT DOCUMENTS

| | | |
|---|---|---|
| CN | 102665625 | 9/2012 |
| CN | 102686492 | 9/2012 |
| DE | 7836997 | 6/1979 |
| DE | 29917001 | 1/2000 |
| DE | 10146921 | 8/2002 |
| DE | 202006007101 | 12/2006 |
| DE | 102005060728 | 6/2007 |
| EP | 0046518 | 3/1982 |
| EP | 0162291 | 11/1985 |
| EP | 0179624 | 4/1986 |
| EP | 0413990 | 2/1991 |
| EP | 1120355 | 8/2001 |
| EP | 1304298 | 4/2003 |
| EP | 1367005 | 12/2003 |
| EP | 1547936 | 6/2005 |
| EP | 1584301 | 10/2005 |
| EP | 1777160 | 4/2007 |
| EP | 2030913 | 3/2009 |
| EP | 2075203 | 4/2010 |
| EP | 2243725 | 10/2010 |
| EP | 1913826 | 11/2010 |
| EP | 3202683 | 8/2017 |
| GB | 2492997 | 1/2013 |
| GB | 2538267 | 11/2016 |
| JP | S564427 | 1/1981 |
| JP | 05193688 | 8/1993 |
| JP | 3035855 | 1/1997 |
| JP | 200850019 | 3/2008 |
| JP | 2012006629 | 1/2012 |
| JP | 2012512110 | 5/2012 |
| JP | 2013503794 | 2/2013 |
| JP | 2011234944 | 6/2013 |
| JP | 2013522138 | 6/2013 |
| WO | 1999065789 | 12/1999 |
| WO | 2000023334 | 4/2000 |
| WO | 0168473 | 9/2001 |
| WO | 0239943 | 5/2002 |
| WO | 2005110865 | 11/2005 |
| WO | 2005110876 | 11/2005 |
| WO | 2008002394 | 1/2008 |
| WO | 2008029332 | 3/2008 |
| WO | 2008114140 | 9/2008 |
| WO | 2008153953 | 12/2008 |
| WO | 2008153954 | 12/2008 |
| WO | 2008155626 | 12/2008 |
| WO | 2009096573 | 8/2009 |
| WO | 2009103296 | 8/2009 |
| WO | 2009151504 | 12/2009 |
| WO | 2010063076 | 6/2010 |
| WO | 2010088492 | 8/2010 |
| WO | 2010151591 | 12/2010 |
| WO | 2010151594 | 12/2010 |
| WO | 2011059941 | 5/2011 |
| WO | 2012037956 | 3/2012 |
| WO | 2012057961 | 5/2012 |
| WO | 2012058367 | 5/2012 |
| WO | 2012058413 | 5/2012 |
| WO | 2012065040 | 5/2012 |
| WO | 2012152676 | 11/2012 |
| WO | 2013010773 | 1/2013 |
| WO | 2013130085 | 9/2013 |
| WO | 2016025737 | 2/2016 |

OTHER PUBLICATIONS

International Search Report and Written Opinion of the International Searching Authority, dated Jan. 25, 2016 for International Application No. PCT/US2015/044656 (20 pgs.).

Extended European Search Report dated May 3, 2017 for European Application No. 17163086.6 (8 pgs.).

International Search Report and Written Opinion of the International Searching Authority, dated May 20, 2014 for International Application No. PCT/US2014/016366 (10 pgs.).

English translation of Notification of Reasons for Refusal, dated Feb. 22, 2017, for Japanese Application No. 2015-534839 (2 pgs.).

International Search Report and Written Opinion of the International Searching Authority, dated Oct. 23, 2015 for International Application No. PCT/US2015/045090 (10 pgs.).

Annex to EPO Communication Pursuant to Article 94(3) EPC, dated Aug. 17, 2018 for Application No. 17163086.6 (4 pgs.).

English translation of Notice of Reasons for Rejection, dated Feb. 22, 2018, for Japanese Application No. 2017-500051 (7 pgs.)

European Patent Office Examination Report, dated Jan. 8, 2018 for Application No. 15753852.1 (8 pgs.).

Notification of the First Office Action, dated Apr. 2, 2018 for Chinese Application No. 201580043224.3 with English translation (10 pgs.).

Notification of the First Office Action, dated May 24, 2018 for Chinese Application No. 201580042641.6 with English translation (13 pgs.).

* cited by examiner

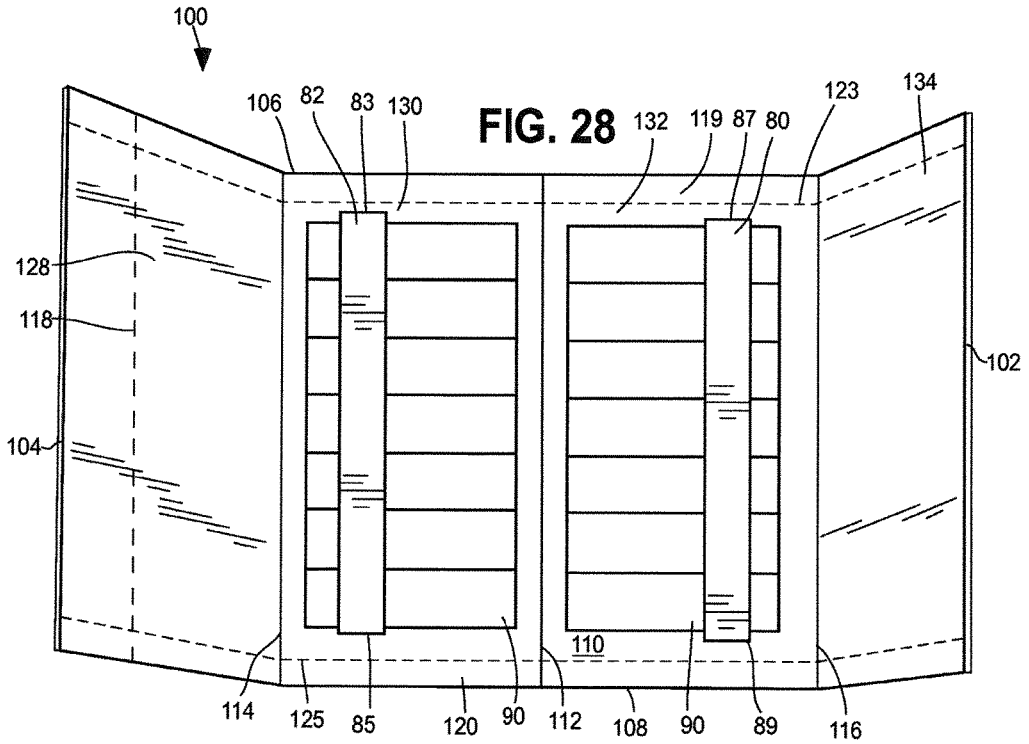
FIG. 28
FIG. 29
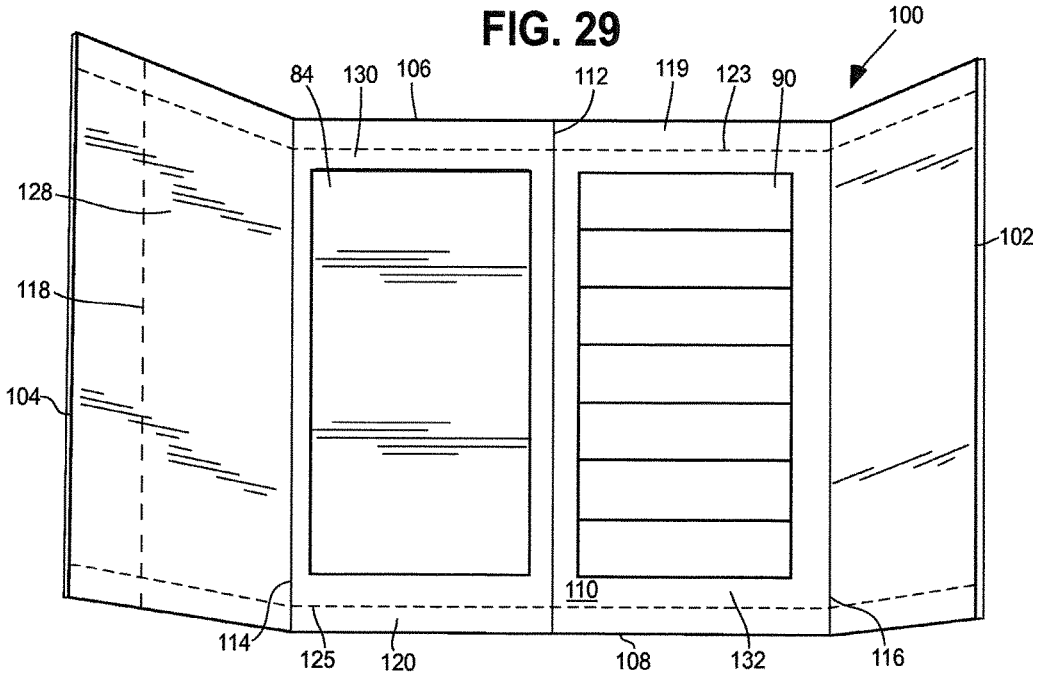

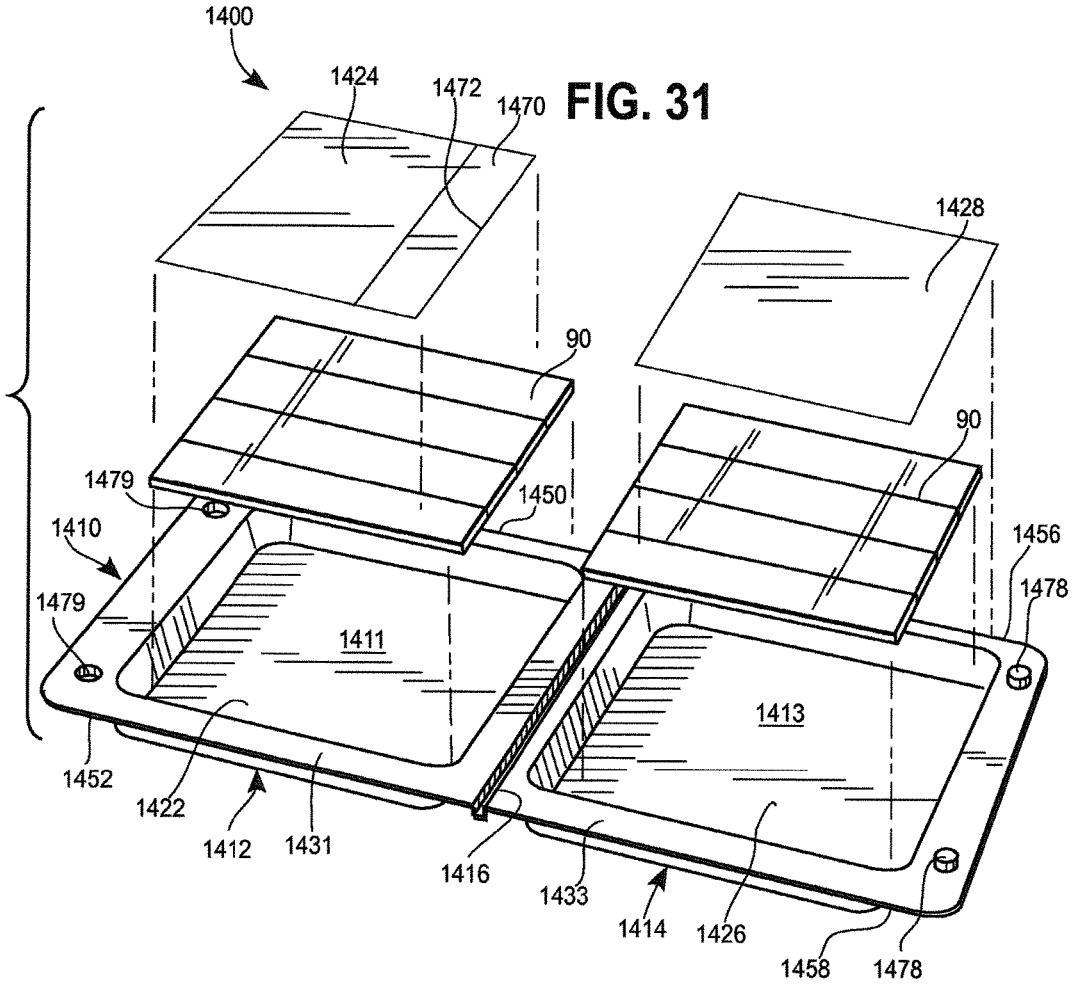
FIG. 31
FIG. 32
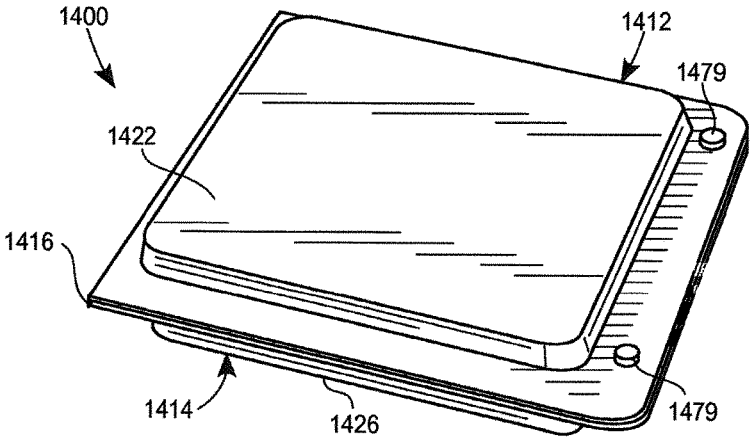

PACKAGES HAVING SEPARABLE SEALING FEATURES AND METHODS OF MANUFACTURING

CROSS REFERENCE TO RELATED APPLICATIONS

This application is a U.S. national phase application of International Application No. PCT/US2014/016366, filed Feb. 14, 2014, which claims benefit from: U.S. Application 61/765,633, filed Feb. 15, 2013; U.S. Application 61/791,719, filed Mar. 15, 2013; U.S. Application 61/880,097, filed Sep. 19, 2013; U.S. Application 61/915,966, filed Dec. 13, 2013, which are each hereby incorporated herein by reference in their entirety.

FIELD

Packages and methods for their manufacture are described herein and, in particular, packages having separable sealing features.

BACKGROUND

Packages, and, in particular, flexible film packages, are used for a variety of food products (e.g., chewing gum sticks, chocolates, candy, and the like). Such packages may include one or more compartments for the storage of the consumer products and multiple flaps and/or panels that cover the compartments. Manufacture of packages that include multiple flaps may require the use of multiple sheets of film and multiple cut or score lines, increasing the manufacturing complexity and cost of the packages.

The packages can be sealed via interlocking fastener strips or facing adhesive strips. The manufacture of interlocking fasteners and multiple adhesive strips can require additional materials and manufacturing steps, which can undesirably increase complexity and cost of the manufacturing process. In addition, the packages are commonly wrapped with a film overwrap to provide a tamper-evident feature. The inclusion of overwrap can increase manufacturing steps and costs.

SUMMARY

The packages described herein can be advantageously manufactured from a single portion of material, such as a web of flexible film or a sheet of paperboard. The material can be scored with one or more lines of weakness to define one or more closure flaps. Opposite edges of the material can then be folded and partially sealed to underlying portions of the material to form first and second pouches of the package having facing openings. A closure flap attached to the first pouch can be folded about the line of weakness away from the hinge and attached via adhesives or other means to the second pouch to seal a food product in the package when the two pouches are folded to abut each other about a hinge between the openings of the pouches. Once the closure flap is attached, the package cannot be opened without detaching the closure flap. The closure flap thus provides a tamper-evident feature for the package. One of the pouches can have one or more adhesive areas that permit repeated attachment to the other of the pouches and provide for reclosure of the package after the initial opening. The packages described herein can be more cost-effective to manufacture than packages requiring an overwrap, multiple sheets of film or paperboard, and/or multiple adhesive strips.

In one form, a food package includes a first pouch and a second pouch attached to each other about a hinge, each of the first and second pouches being configured to contain a food product and having an opening facing the hinge to provide access to the food product. The package further includes a first closure flap attached to the first pouch along a first line of weakness and folded about the first line of weakness to overlay the first pouch. The first line of weakness is spaced from the hinge and the first closure flap is attached to the second pouch. The first and second pouches are movable about the hinge from a closed position, where the first and second pouches abut and access to the openings of the first and second pouches is blocked by the first closure flap, toward an open position, where the first closure flap is attached to the second pouch and detached from the first pouch along the first line of weakness to provide access to the openings of the first and second pouches.

Each of the first and second pouches can comprise an exterior wall having an inner surface and an outer surface, the exterior walls being attached to each other about the hinge to permit the package to be moveable between the open position and the closed position. Each of the first and second pouches can comprise an interior panel having an inner surface and an outer surface, the interior panel being attached to the exterior wall and overlying at least a portion of the inner surface of the adjacent exterior wall. Each of the first and second pouches can also comprise end seals of the package between the interior panel and the exterior wall of each of the first and second pouches.

The bottom end of the first pouch can be at an intersection of the exterior wall and the interior panel of the first pouch and the bottom end of the second pouch can be at an intersection of the exterior wall and the interior panel of the second pouch. The first and second pouches each can have a closed bottom end and the first line of weakness can be closer to the hinge than to the bottom end of the first pouch.

The package can further include means for reclosing the package after the package is moved from the closed position to the open position. For example, the package can also include at least one adhesive area on at least one of the pouches for reclosing the package after the package is moved from the closed position to the open position.

The package may optionally include a second closure flap attached to the second pouch along a second line of weakness and folded about the second line of weakness to overlay the second pouch. The second line of weakness can be spaced from the hinge and the second closure flap can be attached to the first closure flap. Upon movement of the package from the closed position to the open position, one of the first and second closure flaps separates along a respective one of the first and second lines of weakness such that when the package is in the open position, the first and second closure flaps are attached to each other and one of the first and second closure flaps is detached from the adjacent one of the pouches.

At least one of the first and second closure flaps can include means for attaching the closure flaps to each other.

The package can advantageously be formed from a single sheet or portion of material, such as a web of flexible film or length of paperboard or other such material. However, multiple portions of material can also be used to form the package. The package can be in combination with one or more arrays of gum sticks in each pouch. There may be a hermetic seal around the food product.

A method of manufacturing the above package includes: providing material, such as a web of flexible film or a length of paperboard or other such material, having first and second longitudinal edges, a longitudinally extending central fold zone, and a longitudinally extending first line of weakness adjacent the first longitudinal edge; depositing first and second portions of the food product on the film on the opposite sides of the central fold zone; folding the first longitudinal edge of the flexible film to overlay at least part of the first portion of the food product; folding the second longitudinal edge of the flexible film to overlay at least a part of the second portion of the food product; forming end seals between overlying portions of the film to form the first and second pouches; folding the first longitudinal edge of the flexible film about the first line of weakness to overlay the first pouch; folding the first and second pouches toward each other about the hinge; attaching the first closure flap to the second pouch; and, if necessary, singulating the package.

The method may include providing a longitudinally extending second line of weakness in the material adjacent the second longitudinal edge. The method can include attaching the first closure flap to the portion of the material between the second line of weakness and the second longitudinal edge. The method may include hermetically sealing the food product in the package.

A method of opening the above package can include moving the first and second pouches from the closed position toward the open position to detach the closure flap along the line of weakness.

In another form, a food package comprises a pouch configured to contain a food product. The package includes a closure flap attached to the pouch via a hinge and being movable about the hinge from a closed position, where access to the pouch is blocked by the closure flap, toward an open position, where the first closure flap is detached from a portion of the first pouch to provide access to an interior of the pouch.

In yet another form, a package is provided having at least two sides and a top end and a bottom end. The bottom end can have a portion around which the sides can pivot from a closed position, where the sides are generally parallel to each other, to an open position, where the sides are not generally parallel to each other, and can optionally be generally coplanar. The package can include a separable member, such as the flap discussed above, between the sides which initially prevents access to the contents but which is configured to be ruptured upon movement from the closed position to the open position to permit access to the contents. The separable member can optionally be closer to bottom end as compared to the top end.

In yet another form, a package includes a back panel; a front panel being connected to the back panel to form a bottom end of the package; a closure flap detachably attached to the front panel and folded adjacent the exterior flap; and an external flap between the back panel and the closure flap. The back panel, front panel, and external flap define a pouch with an interior configured to contain a product. The closure flap is detachable from the front panel to provide access to the interior of the pouch in response to movement of the exterior flap and closure flap away from the front panel.

In one form, the closure flap is selectively attached by an adhesive to an adjacent surface of the front panel.

In another form, the closure flap is detachable from the front panel along a line of weakness at an intersection between the closure flap and the front panel.

In yet another form, the closure flap forms a first U-shaped fold with the front panel and a second U-shaped fold with the external flap, the first and second U-shaped folds being oriented in opposite directions.

In one form, a package includes a back panel; a front panel being connected to the back panel to form a bottom end of the package; a closure flap detachably attached to the front panel and non-detachably attached by an adhesive to the exterior flap; an external flap between the back panel and the closure flap, the back panel, front panel, and external flap defining a pouch with an interior configured to contain a product. The closure flap is detachable from the front panel to provide access to the interior of the pouch in response to movement of the exterior flap and closure flap away from the front panel.

In one form, the line of weakness has a pair of ends, and one of the ends is further from the hinge than the other of the ends.

A method of opening the package includes moving the first and second pouches from the closed position toward the open position to detach the closure flap along the line of weakness, with the detachment initiating at the one of the ends that is further from the hinge.

In one form, the closure flap is detachable from the front panel along a line of weakness at an intersection between the closure flap and the front panel; and the line of weakness has a pair of ends, and one of the ends is further from the bottom end of the package than the other of the ends.

The above-described packages may be in combination with a stack of gum sticks in each pouch.

In yet another form, a package includes a first pouch and a second pouch attached relative to each other about both an outer hinge and at least one inner connecting flap, with each of the first and second pouches being configured to contain a product. The first and second pouches are movable about the hinge from a closed position where access to the first and second pouches is blocked by the inner connecting flap, toward an open position, where the inner connecting flap is rupturable to at least partially detach relative to one of the first and second pouches to provide access to at least one of the first and second pouches.

In one approach, the inner connecting flap is folded to overlie one of the first and second pouches. The inner connecting flap may be attached to one of the first and second pouches along a line of weakness and to the other of the first and second pouches using an adhesive.

In one form, the line of weakness has a pair of ends, and one of the ends is further from the hinge than the other of the ends.

The first and second pouches may be attached relative to each other about a pair of inner connecting flaps. One of the inner connecting flaps may be attached to the first pouch, the other of the inner connecting flaps may be attached to the second pouch, and the first and second inner connecting flaps may be attached to each other.

In one form, one of the inner connecting flaps is attached to the first pouch along a first line of weakness and the other of the inner connecting flaps is attached to the second pouch along a second line of weakness. The pair of inner connecting flaps may be attached to each other using an adhesive.

In one form, the package is configured such that: each of the first and second pouches comprises an exterior wall having an inner surface and an outer surface, the exterior walls being attached to each other about the hinge to permit the package to be moveable between the open position and the closed position; each of the first and second pouches comprises an interior panel having an inner surface and an outer surface, the interior panel being attached to the exterior wall and overlying at least a portion of the inner surface of the adjacent exterior wall; and end seals of the package are positioned between the interior panel and the exterior wall of each of the first and second pouches.

Each of the pouches may have an opening facing the hinge to provide access to the product. At least one of the pouches may include means for accessing the opening.

In an approach, the package is formed from a single sheet of flexible film. The package may be used in combination with an array or stack of gum sticks in each pouch. In one form, the package may be sealed by a hermetic seal around the product.

In one form, the package may include means for reclosing the package after the package is initially moved from the closed position to the open position.

In one form, a package comprises a first pouch and a second pouch, each of the pouches having an inner panel and an outer panel sealed together to define an interior configured to contain a product and a line of weakness formed in the inner panel to define an inner closure flap and separable from the inner panel along the line of weakness to form an opening to access the interior. The first and second pouches are attached relative to each other about both an outer hinge and the inner closure flaps and are movable about the hinge from a closed position, where access to the first and second pouches is blocked by the inner closure flaps being attached to their respective inner panels, toward an open position, where at least one of the inner closure flaps is separated along its respective lines of weakness to provide access to the respective one of the first and second pouches.

In one form, each of the lines of weakness has a middle section spaced further from the hinge as compared to ends thereof.

Each of the lines of weakness may be arcuate. The outer panels of the first and second pouches may be joined at the hinge. The outer panels of the first and second pouches may be each joined to a common outer cover defining the hinge.

In one approach, the force required to break one of the lines of weakness is less than the force required to separate the inner closure flaps.

In one approach, the package further includes a third pouch having an inner panel and an outer panel sealed together to define an interior configured to contain a product and a line of weakness formed in the inner panel to define an inner closure flap separable from the inner panel along the line of weakness to form an opening to access the interior of the third pouch. The third pouch may be attached relative to the second pouch about a second outer hinge and attached relative to the first pouch by an inner closure flap of the third pouch.

The third pouch may be movable about the second outer hinge from a closed position, where access to the interior of the third pouch is blocked by the inner closure flap of the third pouch being attached to the outer panel of the first pouch, toward an open position, where the inner closure flap of the third pouch is separated along the line of weakness.

In one approach, the third pouch is separable from the second pouch along a line of weakness located proximate the second outer hinge.

A method of opening the package includes moving the first and second pouches from the closed position toward the open position to separate the closure flap of the first pouch from the remainder of the inner panel of the first pouch to provide access to the interior of the first pouch. The method may include manipulating the package to separate the closure flap of the second pouch from the remainder of the inner panel of the second pouch to provide access the interior of the second pouch.

In one form, a method of opening the above package includes moving the first and second pouches about the outer hinge from the closed position toward the open position and separating an inner closure flap of the first pouch from the inner panel of the first pouch along the line of weakness of the first pouch without separating an inner closure flap of the second pouch attached to the inner panel of the second pouch along the line of weakness of the second pouch, such that the first pouch is open to provide access to the product in the first pouch while the second pouch remains sealed to restrict access to the product in the second pouch.

The method may further comprise forming a second hinge in the outer panel of the first pouch during the moving of the first pouch from the closed position toward the open position, wherein, when the second hinge is formed, the first pouch is open to provide access to the product in the first pouch while the second pouch remains sealed to restrict access to the product in the second pouch.

The method may further comprise positioning the outer panel of the first pouch such that the second hinge is closer to a bottom end of the second pouch than the outer hinge.

The method may further comprise moving the first pouch by moving a bottom end of the first pouch in a direction away from the outer hinge to separate the inner closure flap of the second pouch from the inner panel of the second pouch along the line of weakness of the second pouch to open the second pouch and provide access to the product in the second pouch.

In one approach, the moving the first pouch further comprises moving the bottom end of the first pouch in a direction away from the bottom end of the second pouch to increase a length of the package, wherein the length of the package is defined as a distance between the bottom end of the first pouch and the bottom end of the second pouch along a line perpendicular to the outer hinge.

In one approach, moving the bottom end of the first pouch includes moving the second hinge in a direction away from a bottom end of the second pouch.

In an approach, the moving of the second hinge in a direction away from a bottom end of the second pouch includes moving the second hinge in a direction away from the bottom end of the second pouch to a position where the second hinge is further away from the bottom end of the second pouch than the outer hinge.

The method may further comprise maintaining the inner closure flaps of the first and second pouches attached to one another during the movement of the first and second pouches about the outer hinge from the closed position toward the open position.

The method may further comprise positioning the inner closure flaps of the first and second pouches to at least in part obstruct an opening of at least one of the first and second pouches to restrict movement of the product out of at the at least one of the first and second pouches.

In one approach, a method of opening the package may comprise moving the first and second pouches about the outer hinge from the closed position toward the open position and substantially simultaneously separating an inner closure flap of the first pouch from the inner panel of the first pouch along the line of weakness of the first pouch and an inner closure flap of the second pouch attached to the inner panel of the second pouch along the line of weakness of the second pouch, such that the first pouch and the second pouch substantially simultaneously open to provide access to the product in the first pouch and to the product in the second pouch.

In one embodiment, a package includes a first pouch and a second pouch each having an inner panel and an outer panel to define an interior configured to contain a product and a line of weakness formed in the inner panel to define a closure flap separable from the inner panel along the line of weakness to form an opening to the interior. The first and second pouches are attached relative to each other about a hinge and are movable about the hinge from a closed position, where access to the first and second pouches is blocked by the closure flaps being attached to their respective inner panels, toward an open position, where at least one of the closure flaps is separated along its respective line of weakness to provide access to the respective one of the first and second pouches through the opening. The openings of the first and second pouches face the hinge and each other during movement of the first and second pouches from the closed position to the open position. A first of the closure flaps is movable relative to the hinge and obstructs at least a portion of the opening of the first pouch to restrict the product from dislodging from the first pouch during movement of the first and second pouches away from each other by a degree of rotation of at least 180 degrees from the closed position to the open position.

In one embodiment, a multi-compartment flexible package includes a first sealed compartment having an integrated closure flap; a second sealed compartment connected to the first sealed compartment by a first hinge and having an integrated closure flap; and a third sealed compartment connected to the second sealed compartment by a second hinge and having an integrated closure flap. The first sealed compartment is disposed between the second and third sealed compartments. The closure flap of the third sealed compartment is adhered to the first sealed compartment such that moving of the third sealed compartment about the second hinge causes the integrated closure flap of the third sealed compartment to open to allow access to an interior of the third sealed compartment. The integrated closure flaps of the first and second sealed compartments are adhered to each other such that moving of the first or second sealed compartment about the first hinge away from the other of the first or second compartment causes at least one of the closure flaps of the first and second sealed compartments to open to allow access to an interior of at least one of the first and second sealed compartments.

In one approach, the third pouch is separable from the second pouch along a line of weakness located proximate the second hinge. The first and second pouches may be separable from each other along a line of weakness located proximate the first hinge.

In one approach, each of the integrated closure flaps of the first, second, and third sealed compartments may open by separating at least in part along a line of weakness from its respective sealed compartment.

BRIEF DESCRIPTION OF THE DRAWINGS

FIG. 28 illustrates a top plan view of an exemplary sheet of material including a food product deposited thereon and stiffening members overlying each array of the food product, which sheet of material can be a part of a larger web of material that can be used to form another exemplary package;

FIG. 29 illustrates a top plan view of another exemplary sheet of material having a stiffening member and including a food product deposited thereon, which sheet of material can be a part of a larger web of material that can be used to form another exemplary package;

FIG. 31 illustrates an exploded view of an eleventh exemplary package, having a rigid outer cover forming a portion of a pair of pouches spaced by a hinge, a pair of film sheets for attachment to flanges of respective ones of the pouches, and a food product;

FIG. 32 illustrates a perspective view of the package of FIG. 31 in a closed configuration;

DETAILED DESCRIPTION

The packages described herein include at least a first pouch and, in many examples, both first and second pouches attached to each other about a hinge. The pouches are configured to contain a product, such a food product. Each of the pouches can optionally have an opening facing the hinge to provide access to the consumer product. The packages further include one or more closure flaps separable along a line of weakness and/or rupturable or peelable seal or adhesion area spaced from the hinge to provide a tamper-evident feature for the packages. The first and second pouches, or in some examples, a cover, are movable in a direction away from one another about the hinge from a closed position where the first and second pouches or first pouch and cover at least partially overlie each other toward an open position where the first and second pouches or first pouch and cover are spaced from one another and the closure flap is detached or otherwise separated to provide access to the consumer product via the openings of the first and, if present, second pouches. One or both of the pouches may have an adhesive area for repeated attachment to the other of the pouches to permit multiple openings and reclosures of the package after the initial breaking of the seal and opening of the package. The packages described herein can advantageously be more cost-effective to manufacture than packages requiring an overwrap, multiple sheets of film or paperboard, complex cut or score lines, multiple adhesive strips, and having complex tamper-evident features.

Figure 1:
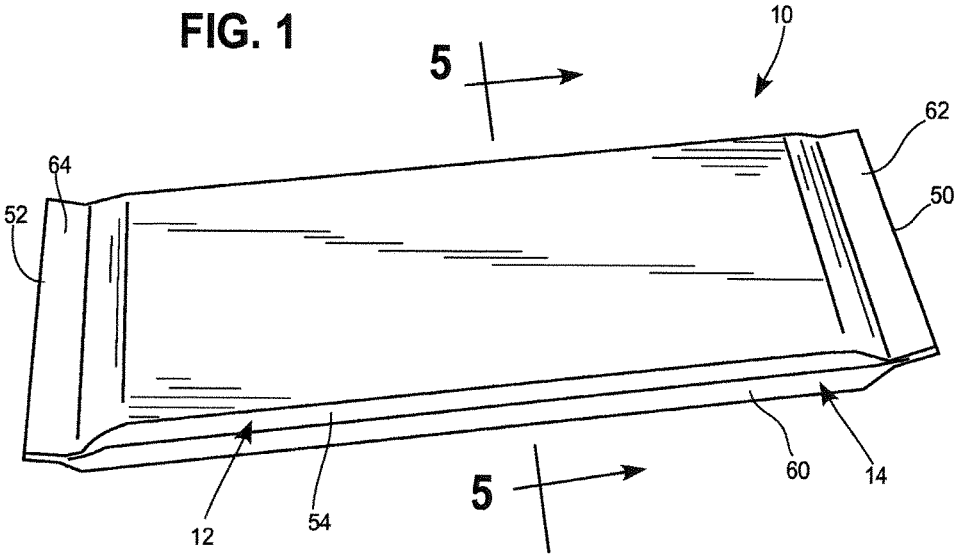
FIG. 1 illustrates a front perspective view of a first exemplary package having two pouches folded about a hinge in a closed position.
Figure 2:
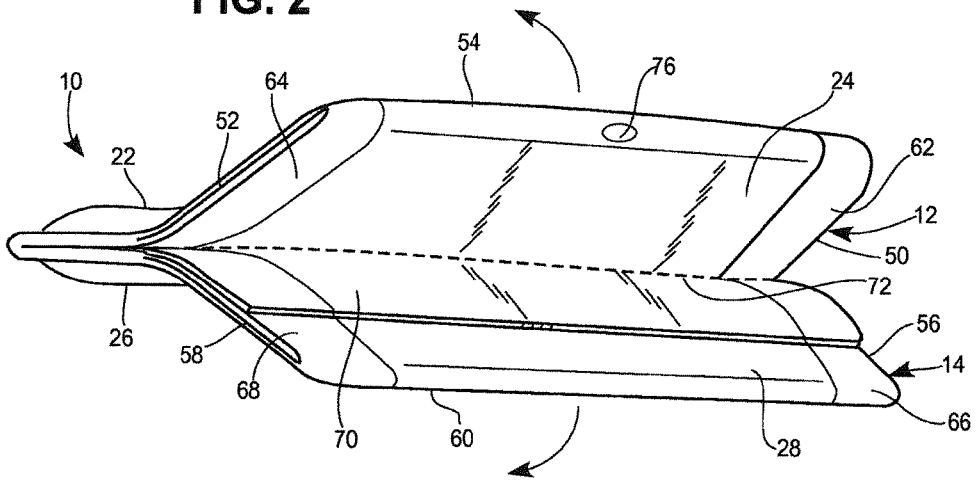
FIG. 2 illustrates a front perspective view of the package of FIG. 1 folded about the hinge to a partially open position with an internal closure flap fully attached to an adjacent pouch along a line of weakness.
Figure 3:
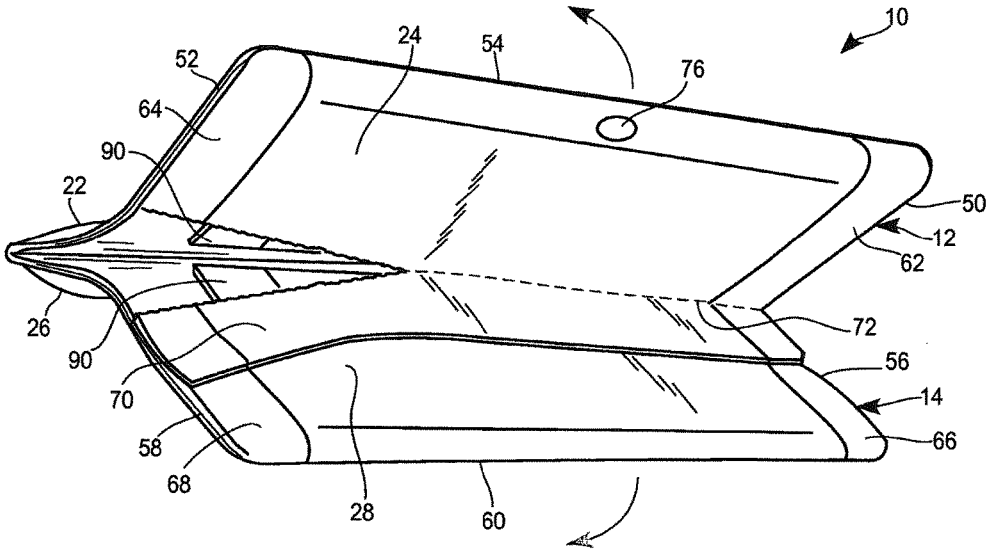
FIG. 3 illustrates a front perspective view of the package of FIG. 1 in a further partially open position with the closure flap being partially detached along the line of weakness.
Figure 4:
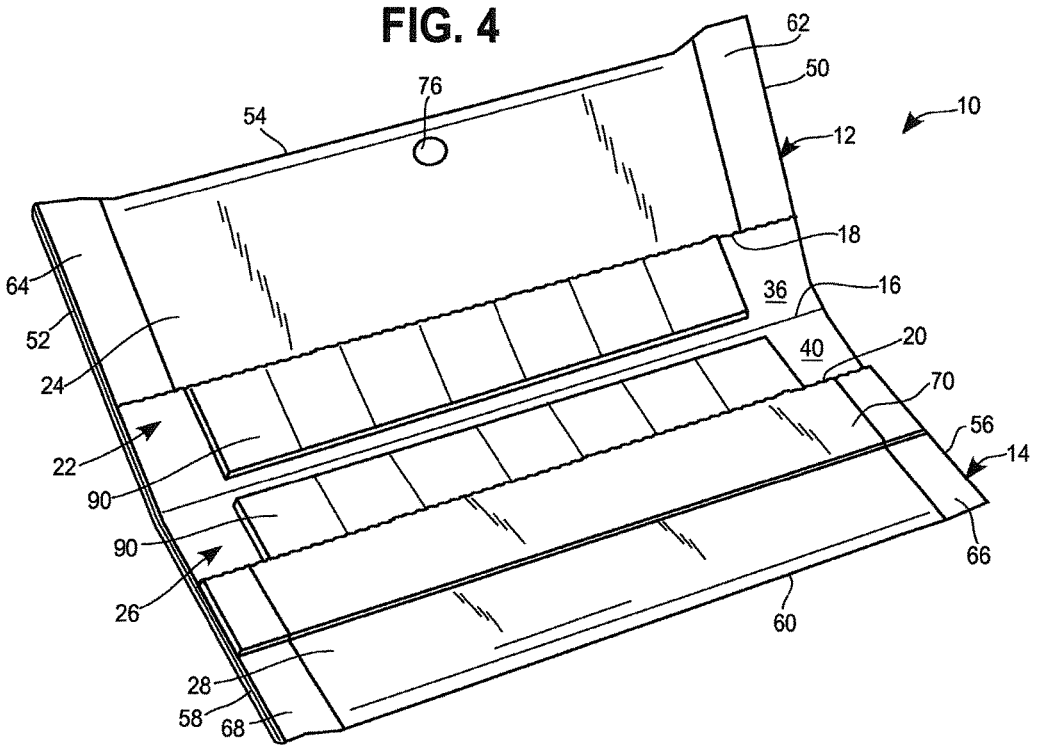
FIG. 4 illustrates a perspective view of the package of FIG. 1 in an open position with the closure flap being fully detached along the line of weakness.

A first exemplary package 10 is shown in FIGS. 1-5. The package 10 includes a first pouch 12 and second pouch 14 attached to each other at a hinge 16, as shown in FIG. 4. When the package 10 is in a closed position, the first and second pouches 12, 14 abut each other, as shown in FIG. 1. The hinge 16 permits the first and second pouches 12, 14 of the package 10 to move about the hinge 16 from the closed position in a direction away from one another (indicated by the directional arrows in FIGS. 2 and 3) toward an open position where the first and second pouches 12, 14 are spaced from one another, as shown in FIG. 4. Similarly, when the package 10 is in the open position shown in FIG. 4, the first and second pouches 12, 14 are permitted to move about the hinge 16 toward a closed position where the first and second pouches 12, 14 abut each other, as shown in FIG. 1. When the package 10 is moved between the closed position (FIG. 1) and the open position (FIG. 4), the movement of the pouches 12 and 14 of the package 10 resembles the opening and closing of a book, which may be visually appealing to consumers.

The first and second pouches 12, 14 of the package 10 have hollow interiors configured to contain a food product 90, for example, gum sticks, as depicted in FIG. 4. It is to be appreciated that the number of gum sticks (i.e., seven) in each of the pouches 12, 14 has been shown by way of example only, and each of the pouches 12, 14 may contain less than seven, or more than seven gum sticks, which can be either individually wrapped or have no individual wrapper. It is also to be appreciated that the gum sticks are being shown as an exemplary consumer product and that other consumer products, for example, chocolate, candy, or non-food products may be contained in the pouches 12, 14. While in the exemplary packages described herein, the first and second pouches are each shown as containing the food products 90, it will be appreciated that instead of both of the pouches containing a food product 90, any one of the packages described herein may include a first pouch containing one or more food products (e.g., gum sticks) and a second pouch containing one or more non-food products, for example, sweepstakes entry and scratch-off tickets, stickers, stick-on tattoos, or various other prizes. Alternatively, one of the two pouches may be empty.

Figure 5:
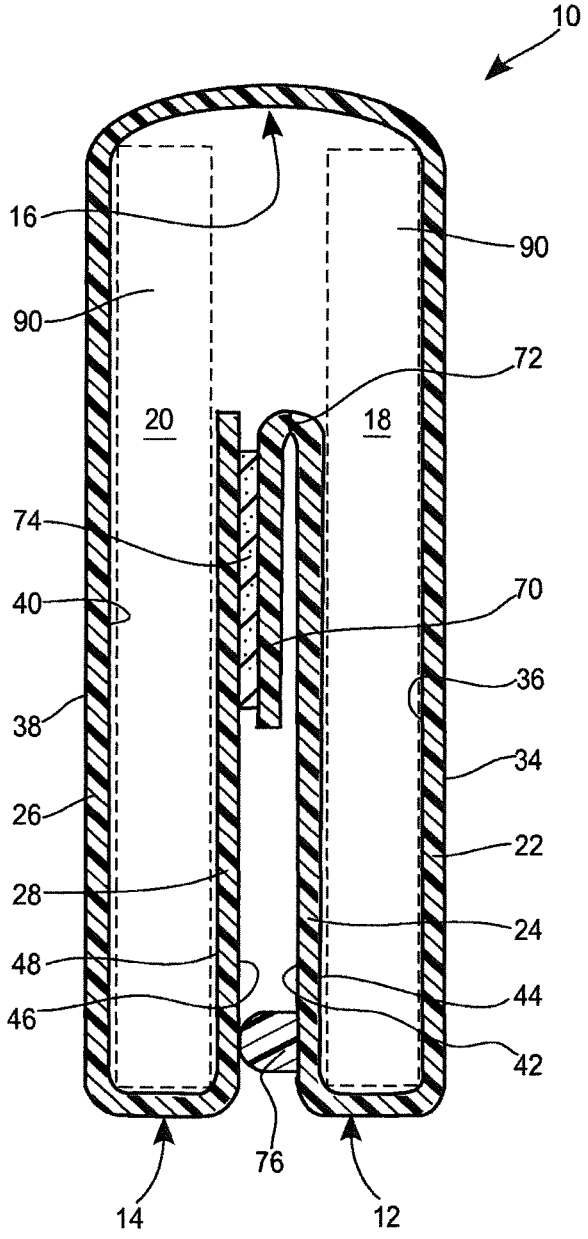
FIG. 5 illustrates a cross-section of the package of FIG. 1 taken along line 5-5 thereof.

The first pouch 12 has an opening 18 and the second pouch 14 has an opening 20 to provide access to the consumer product, as shown in FIGS. 4 and 5. The openings 18, 20 of the pouches 12, 14 face the hinge 16, as shown in FIG. 4. While the openings 18, 20 are shown as being exposed, e.g., product can be removed through the openings, either or both of the openings 18, 20 can optionally be selectively blocked, as discussed in detail below with respect to the alternative package of FIG. 23.

The first pouch 12 includes an exterior wall 22 and an interior panel 24. Similarly, the second pouch 14 includes an exterior wall 26 and an interior panel 28. The exterior wall 22 of the pouch 12 is attached to the exterior wall 26 of the pouch 14 at the hinge 16, permitting the exterior walls 22, 26 of the first and second pouches 12, 14 to move relative to each other about the hinge 16 between the open and closed positions.

The exterior wall 22 of the pouch 12 has an outer surface 34 and an inner surface 36, and the exterior wall 26 of the pouch 14 has an outer surface 38 and an inner surface 40, as shown in FIG. 5. Similarly, the interior panel 24 of the pouch 12 has an outer surface 42 and an inner surface 44, and the interior panel 28 of the pouch 14 has an outer surface 46 and an inner surface 48, as shown in FIG. 5. The pouches 12, 14 are configured such that the inner surfaces 44, 48 of the interior panels 24, 28 face the inner surfaces 36, 40 of the exterior walls 22, 26, respectively. When the package 10 is in the closed position shown in FIG. 5, the food products 90 are contained in the pouches 12, 14 between the inner surfaces 44, 48 of the interior panels 24, 28 and the inner surfaces 36, 40 of the exterior walls 22, 26.

With reference to FIG. 4, the pouch 12 has a top edge 50, a bottom edge 52, and a side edge 54 while the pouch 14 has a top edge 56, a bottom edge 58, and a side edge 60. The exterior wall 22 and the interior panel 24 of the pouch 12 intersect and are joined at the side edge 54 to form a closed bottom end of the pouch 12. The exterior wall 26 and the interior panel 28 of the pouch 14 intersect and are joined at the side edge 60 to form a closed bottom end of the pouch 14. The interior panel 24 of the pouch 12 is sealingly attached to the exterior wall 22 of the pouch 12 proximate the top and bottom edges 50 and 52 at first and second end seals 62, 64, respectively. Similarly, the interior panel 28 of the pouch 14 is sealingly attached to the exterior wall 26 proximate the top and bottom edges 56, 58 at end seals 66, 68, respectively. The end seals 62, 64, 66, and 68 may include a metalized layer to facilitate the formation of the end seals 62, 64, 66, and 68.

Figure 6:
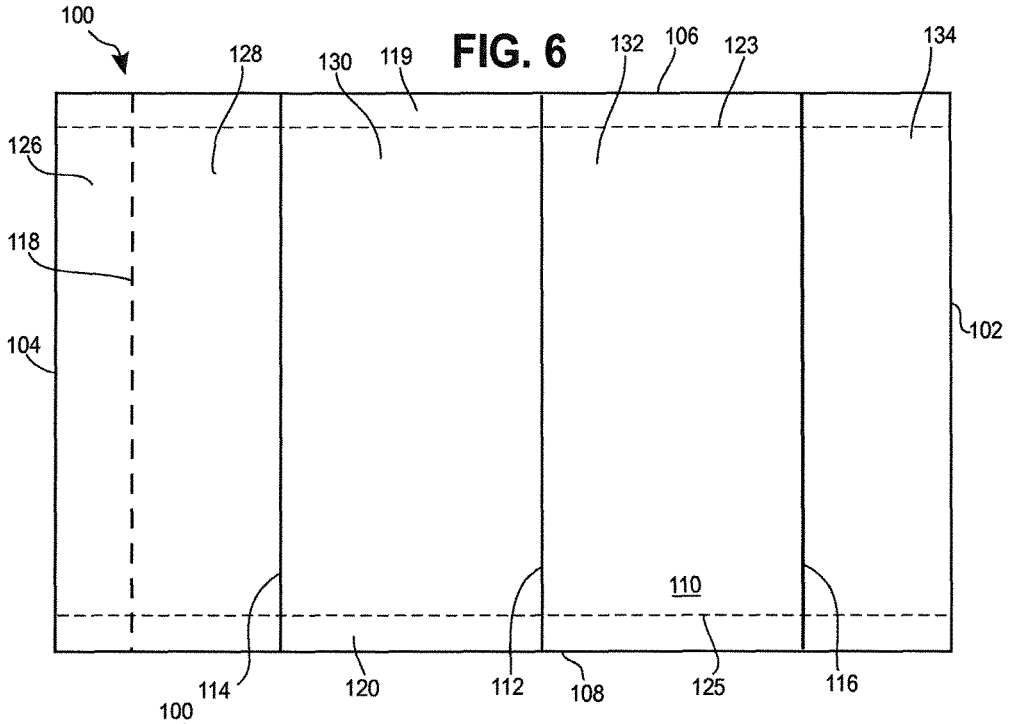
FIG. 6 illustrates a top plan view of an exemplary sheet of material, which can be part of a larger web of material, that can be used to form the package of FIG. 1.

The interior panel 24 of the first pouch 12 includes a first inner connecting or closure flap 70 that permits the package 10 to be sealed, and preferably, hermetically sealed, as shown in FIG. 5. The first closure flap 70 is attached to the interior panel 24 of the pouch 12 along a first line of weakness 72, as shown in FIGS. 2 and 6. The line of weakness 72 can be a score line, which can be formed by laser ablation, die-cutting, micro-abrasion, or the like. While the line of weakness 72 has been shown as being straight and parallel to the side edges 54, 60 of the pouches 12, 14, the line of weakness 72 may be non-parallel to the side edges 54, 60, as discussed in more detail in reference to FIGS. 43-45, and may be a non-linear (e.g., undulating or arcuate), as discussed in more detail in reference to FIGS. 49-54, or a discontinuous line. While the line of weakness 72 and the closure flap 70 are shown in FIG. 2 as extending from the top edge 50 to the bottom edge 52 of the first pouch 12 of the package 10, the closure flap 70 and the line of weakness 72 may extend across less than the distance from the top edge 50 to the bottom edge 52.

In this package embodiment, the first closure flap 70 is an extension of the interior panel 24 of the pouch 12, delineated by the line of weakness 72. However, as will be discussed herein with respect to alternative package embodiments, the closure flap may not be distinguishable or delineated from the panel to which it may be part of. Thus, broadly, the closure flap can simply be a portion of another portion of the package identifiable by its attachment to another portion of the package, as will be discussed in greater detail herein.

While the gum sticks 90 are shown in FIG. 5 as not abutting each other when the package 10 is in a closed position, it is to be appreciated that the package 10 is not drawn to scale and the gum sticks 90 may abut or be closer to each other than shown in FIG. 5. In addition, the gum sticks 90 are not shown in FIG. 5 in cross-section for clarity purposes. Further, while the package 10 has been shown in FIGS. 1-5 with only one closure flap 70 detachably attached to the interior panel 24 of the pouch 12, the package 10 may include a second closure flap detachably attached to the interior panel 28 of the pouch 14, as discussed in more detail below with reference to FIGS. 11-15.

When the package 10 is in a closed position, the pouches 12 and 14 abut each other as shown in FIG. 1 and the closure flap 70 is folded about the line of weakness 72 to overlie the outer surface 42 of the interior panel 24 of the pouch 12, as shown in FIG. 5. When the package 10 is in the closed position, access to the openings 18, 20 of the pouches 12, 14 is blocked by the closure flap 70. While the closure flap 70 has been shown in FIG. 5 as spaced apart from the outer surface 42 of the interior panel 24 of the pouch 12 for clarity, the closure flap 70 may abut the outer surface 42 of the interior panel 24 when the package 10 is in a closed position. Similarly, while the outer surfaces 42, 46 of the interior panels 24, 28 are shown spaced from each other in FIG. 5 for clarity, the outer surfaces 42, 46 of the interior panels 24, 28 of the pouches 12, 14 abut each other when the package 10 is in a closed position.

With the package 10 being in the closed position shown in FIG. 5, the closure flap 70 is attached via an adhesive 74 to the outer surface 46 of the interior panel 28 of the pouch 14. The adhesive 74 is selected to create a non-detachable attachment of the closure flap 70 to the interior panel 28 of the pouch 14. For purposes of this disclosure, "non-detachable" means an attachment that is not meant to be detached. While the closure flap 70 has been shown as being attached to the interior panel 28 via the adhesive 74, the closure flap 70 may be attached to the outer surface 46 of the interior panel 28 via other suitable means, for example, heat sealing, welding, UV-curing, lamination, or the like.

When the package 10 is moved from the closed position of FIG. 1 toward the open position of FIG. 4 in a direction shown by the directional arrows in FIGS. 2 and 3, the pouches 12 and 14 move about the hinge 16 away from each other to open the package in a book-like manner, which may be visually appealing to consumers. During the opening of the package 10, the pouches 12, 14 move away from each other to a position where the opening force and tension being applied by the consumer initiates a tear in the line of weakness 72 and causes the closure flap 70 to separate by tearing from the interior panel 24 of the pouch 12 along the line of weakness 72, as shown in FIG. 3. The closure flap 70 thus provides a consumer with a visual indication of the degree of opening of the package 10. In addition, since a consumer would feel some resistance during the detachment of the closure flap 70 along the line of weakness 72, the closure flap 70 can provide a tactile and potentially audible response to the consumer during the initial opening of the package 10.

After the closure flap 70 is detached from the interior panel 24 of the first pouch 12 along the line of weakness 72, the closure flap 70 no longer holds the pouches 12 and 14 together and permits the pouches 12 and 14 to be moved further away from each other into the open position shown in FIG. 4. When the package 10 is in the open position shown in FIG. 4, the closure flap 70 remains attached to the interior panel 28 of the pouch 14, but no longer seals the package 10 or blocks access to the openings 18, 20 of the pouches 12, 14. Instead, as shown in FIG. 4, a consumer is permitted to remove portions of the food products 90 from the pouches 12 and 14 through the openings 18 and 20. The closure flap 70 thus provides a freshness seal and/or tamper-evident feature for the package 10 such that the absence of, or the partial detachment of the closure flap 70, would visually indicate to a consumer that the package 10 has been previously opened or tampered with.

To permit the package 10 to be reclosed after being opened for the first time, the outer surface 42 of the interior panel 24 of the pouch 12 includes an optional adhesive area 76, as shown in FIGS. 4 and 5. A consumer desiring to reclose the package 10 from the open position of FIG. 4 to the closed position of FIG. 1 would bring the pouches 12, 14 toward each other about the hinge 16 such that the adhesive area 76 contacts and adheres to the outer surface 46 of the interior panel 28. The consumer may apply some force by, for example, pinching the exterior walls 22 and 26 to ensure a secure attachment of the adhesive area 76 to the outer surface 46 of the interior panel 28. When the package 10 is reclosed, the food product 90 is contained in the pouches 12, 14 and restricted from falling out of the package 10. While the adhesive area 76 has been shown as a single circular area in FIG. 4, the adhesive area 76 may be of any other shape or size and may comprise multiple adhesive areas that permit repeated detachable attachment of the interior panels 24, 28 of the pouches 12, 14 to each other. The adhesive area 76 may be in the form of one or more glue dots, pressure-sensitive adhesive, adhesive tape or strips, velcro, zipper, or the like that would permit multiple openings and reclosures of the package 10. Optionally, the package 10 may not include the adhesive area 76 or any other form of reclosure.

An exemplary method of manufacturing the package 10 is described with reference FIGS. 6-10. The method of manufacture is generally depicted in FIG. 10 by illustrating the orientation and manipulation of the flexible material 100 from which the package 10 is made without showing the accompanying assembly line machinery. The flexible material 100 can be unwound from a feed roll 101 and fed as a web in a machine direction shown by the directional arrows as shown in FIG. 10. It will be understood that the film and gum can be fed on top of a stationary plate, moving conveyor, or the like.

The package 10 can be manufactured from a single sheet or web of flexible material 100. The flexible material 100 may be a film made of one or more polymers, laminates, metalized polymers, paper, or the like. For clarity of illustrating the method, a portion of the flexible film 100 of FIG. 10 from which a single package 10 may be manufactured is depicted in FIGS. 6-9. The exemplary single sheet of the flexible film 100 depicted in FIG. 6 has a leading edge 108, a rear edge 106, a first longitudinal side edge 104, a second longitudinal side edge 102, and an upward-facing surface 110. It will be appreciated that a single functional sheet of material can be made for joining multiple components.

As the flexible film moves in the machine direction shown by the directional arrows in FIG. 10, the film has a central fold zone 112 where a crease or fold line may be formed in the flexible film 100. A second crease line or fold line 114 can then formed on one side of the central fold zone 112, and a third crease line or fold line 116 can then formed on the opposite side of the central fold zone 112, as shown in FIG. 6. While the central fold zone 112, and second and third crease lines 114 and 118 have been shown in FIG. 6 as straight lines, it will be appreciated that one or more of the central fold zone 112, second crease line 114, and third crease line 116 may be non-linear or in a form of an area of the flexible film 100 instead of a single line.

The crease lines 112, 114, and 116 can be made in the flexible film 100 before or after the flexible film 100 is unwound from the feed roll 101 in the machine direction. In an approach where the crease lines 112, 114, and 116 are created in the flexible film 100 prior to folding of the flexible film 100, such crease lines can be made, for example, by suitable rollers, lasers, or the like. For example, optionally, the crease lines 112, 114, and 116 may not be made in the flexible film 100, and the flexible film 100 may be folded without the crease lines 112, 114, and 116. The first crease line or central fold zone 112 corresponds to the hinge 16 of the package 10, the second crease line 114 corresponds to the side edge 54 of the package 10, and the third crease line 116 corresponds to the side edge 60 of the package 10, as can be seen, for example, in FIGS. 4 and 6.

Prior to, or after making the first second, and third crease lines 112, 114, 116 in the flexible film 100, a line of weakness 118 is formed in the flexible film 100 between the second crease line 114 and the first longitudinal edge 104 of the flexible film 100, as shown in FIG. 6. The line of weakness 118 can be formed in the flexible film 100 using, for example, laser ablation, die-cutting, micro-abrasion, or other suitable means. The line of weakness 118 in the flexible film 100 corresponds to the line of weakness 72 of the package 10.

Proximate the trailing edge 106, the flexible film 100 includes a sealing margin 119 where the end seals 62 and 66 of the package 10 will be formed, and proximate the leading edge 108, the flexible film 100 includes a sealing margin 120, where the end seals 64 and 68 of the package 10 will be formed. On a lower side of the flexible film 100 opposite the upward-facing surface 110 and under the sealing margins 119, 120, the flexible film 100 includes metalized areas 122, 124, shown in FIG. 8. The metalized areas 122, 124 can facilitate the heat sealing of the sealing margins 119, 120 to form the end seals 62, 64, 66, and 68 of the package 10. The edges 123, 125 of the metalized areas 122 and 124 coincide with the edges of the sealing margins 119, 120, and are indicated in dotted lines in FIG. 6 because the metalized areas 122 and 124 are on a lower side of the flexible film 100 opposite the upward-facing surface 110. The metalized areas 122, 124 can include, for example, foil, or another reflective material. Optionally, the flexible film 100 may lack the metalized areas 122, 124, in which case such areas can correspond to sealing zones.

Figure 8:
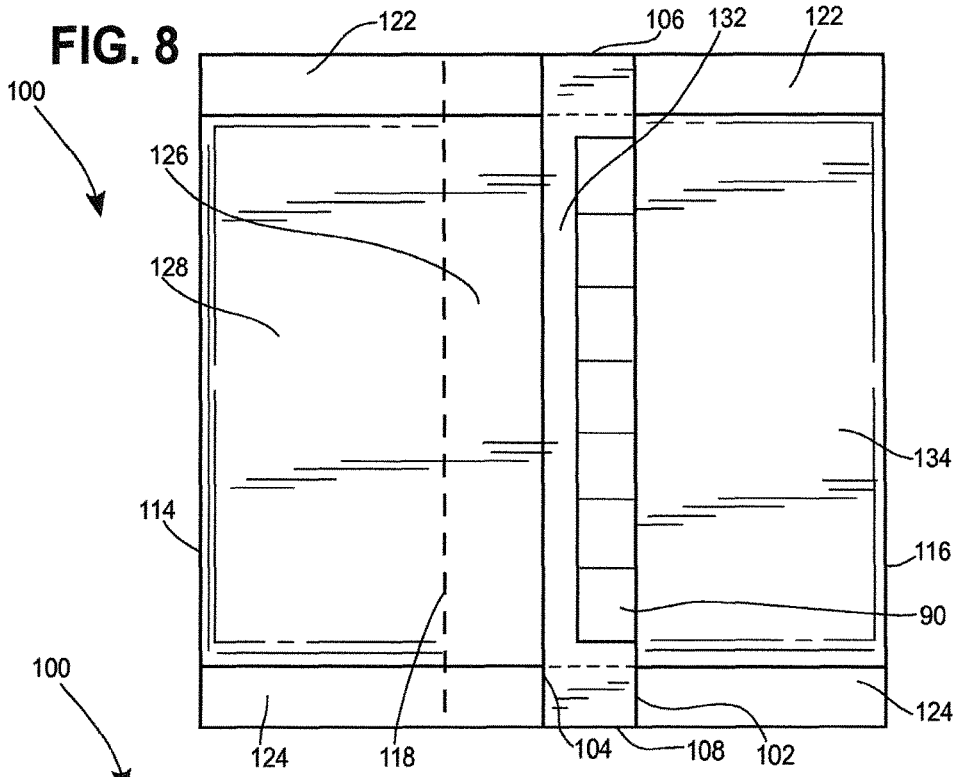
FIG. 8 is a top plan view of the web of material of FIG. 7 having a food product deposited thereon and with interior panels being folded into the sealing position covering the food product.

With reference to FIG. 8, the area 126 of the flexible film 100 between the first line of weakness 118 and the first longitudinal edge 104 corresponds to the closure flap 70 of the package 10. The area 128 between the first line of weakness 118 and the second crease line 114 of the flexible film 100 corresponds to the interior panel 24 of the first pouch 12 of the package 10. The area 130 between the second crease line 114 and the central fold zone or first crease line 112 of the flexible film 100 corresponds to the exterior wall 22 of the first pouch 12 of the package 10. The area 132 between the central fold zone or first crease line 112 and the third crease line 116 of the flexible film 100 corresponds to the exterior wall 26 of the second pouch 14 of the package 10. Finally, the area 134 between the third crease line 116 and the second longitudinal edge 102 of the flexible film 100 corresponds to the interior panel 28 of the second pouch 14 of the package 10.

Figure 7:
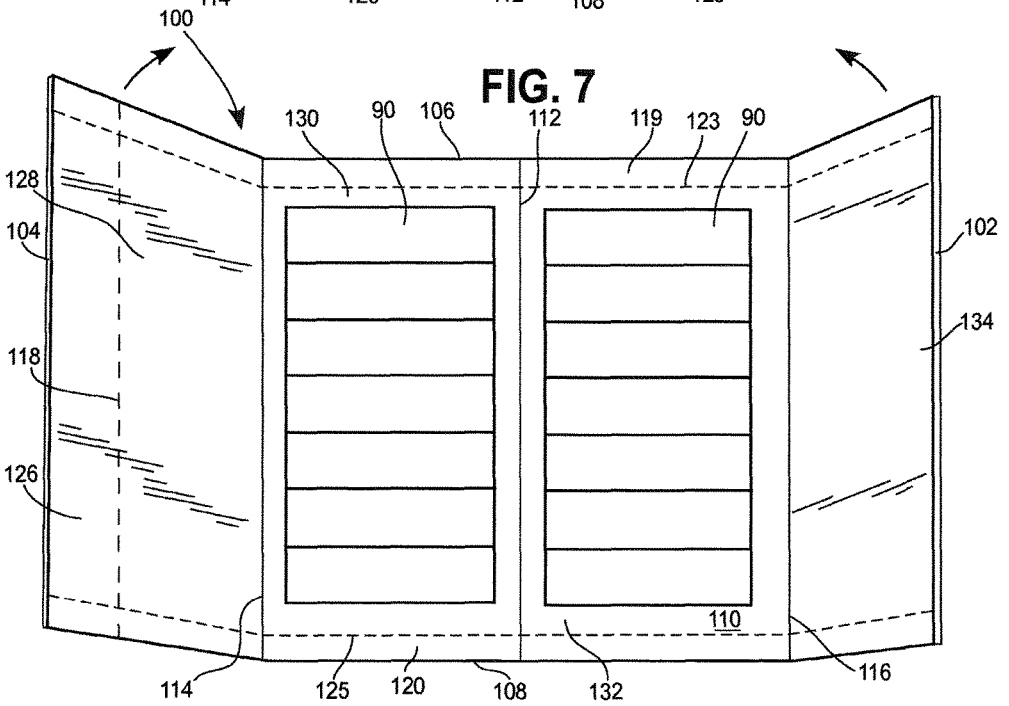
FIG. 7 is a top plan view of the sheet of material of FIG. 6 having a food product deposited thereon and with interior panels being moved toward a sealing position covering the food product.

As the flexible film 100 is moved in the machine direction, a food product 90 is deposited onto the upward-facing surface 110 of the flexible film 100, as shown in FIGS. 7 and 10. The crease lines 112, 114, 116, and the line of weakness 118 shown in FIGS. 7 and 10 may be made in the flexible film 100 before or after the food product 90 is placed on the flexible film 100.

While the food product 90 has been shown in FIG. 7 in the form of gum sticks, food products other than gum sticks, for example, candy, chocolates, or the like, may be used in combination with the flexible film 100 instead of gum sticks. In one approach, a non-food product to be wrapped in the package 10 may be used in combination with the flexible film 100. Optionally, the food product 90 may be removably attached to the upward-facing surface 110 of the flexible film 100, for example, via an adhesive material, adhesive tape, or the like. The removable attachment of the food product 90 to the upward-facing surface 110 of the flexible film 100 may keep the food product 90 from undesirably falling out or shifting inside of the package 10.

With the food product 90 being positioned on the upward-facing surface 110 of the flexible film 100 as shown in FIG. 7, the opposite longitudinal edges 102, 104 of the flexible film 100 are folded inward and brought toward each other and toward the central fold zone 112 to overlay portions of the food product 90 and portions of the flexible film 100, as depicted in FIGS. 8 and 10. As shown in FIGS. 8 and 10, the first and second longitudinal edges 102, 104 of the flexible film 100 are positioned such that the first longitudinal edge 104 overlays the central fold zone 112 and portions of the flexible film 100 cover the food product 90, while the second longitudinal edge 102 is spaced from the first longitudinal edge 104 and the central fold zone 112 such that a portion of the food product 90 is exposed, as shown in FIGS. 8 and 10.

Figure 9:
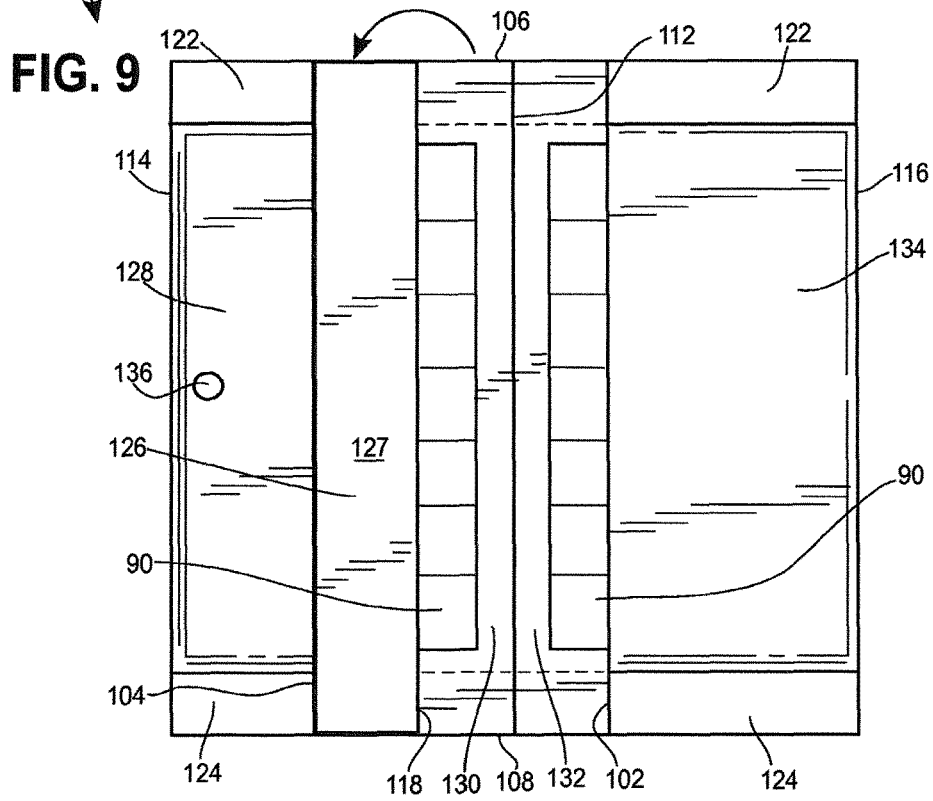
FIG. 9 is a top plan view of the sheet of material of FIG. 8 having a food product deposited thereon and with interior panels being sealed to form pouches for the food product and the closure flap being folded over prior to the sealing of the package.
Figure 10:
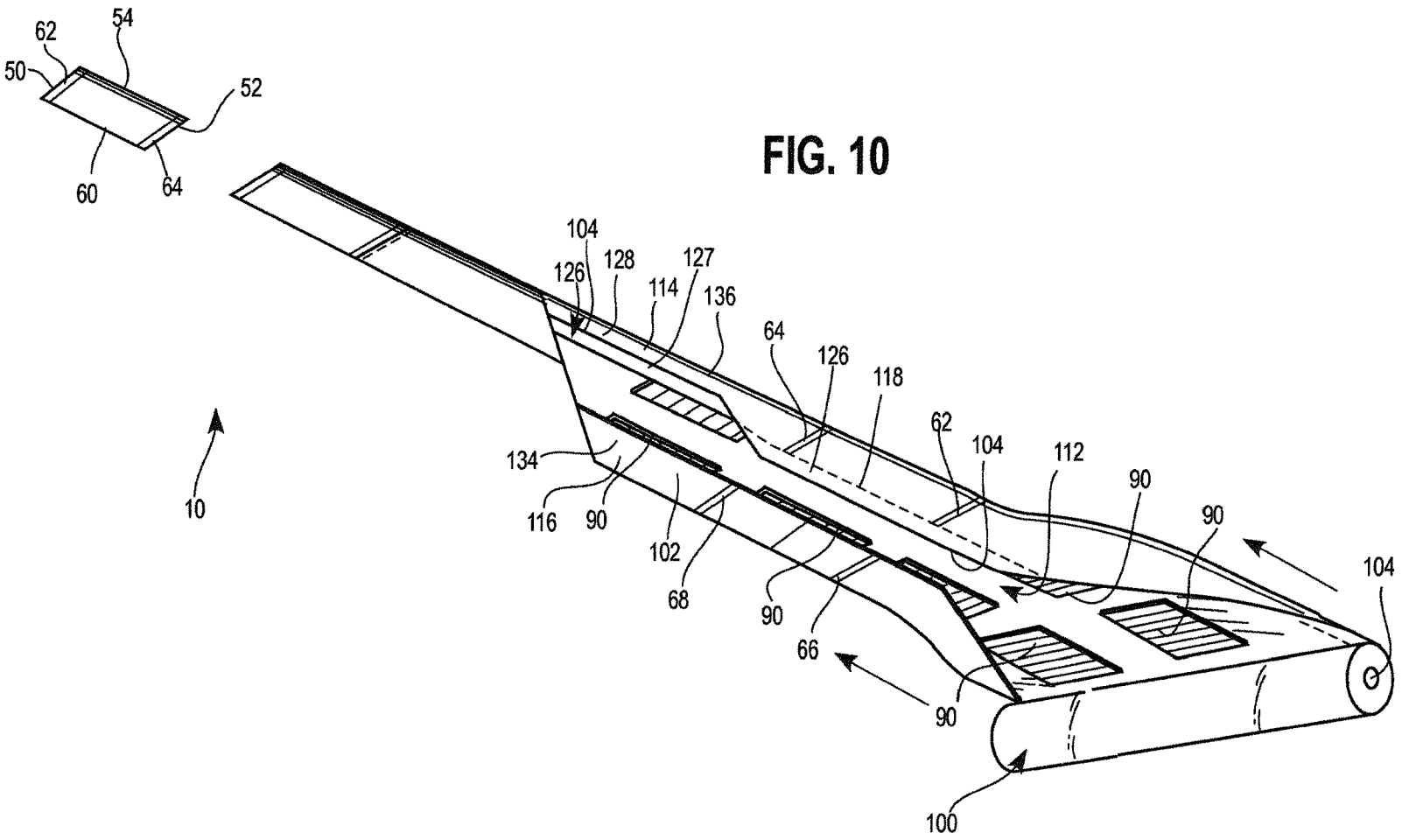
FIG. 10 illustrates a schematic view of an exemplary process for manufacturing the package of FIG. 1 from a web of film.

In one alternative form of the method, prior to folding the flexible film 100 as shown in FIGS. 8-10, stiffening members 80, 82 as shown in FIG. 28 may be added to provide additional structural support to the soon-to-be-formed package. In particular, with the food product 90 being deposited on the flexible film 100 as shown in FIG. 7, stiffening members 80 and 82 may be either placed on top of the food product 90 without being attached to the upward-facing surface 110 of the flexible film 100, or with the ends 83, 85 and 87, 89 of the stiffening members 80 and 82, respectively, being attached to the upward-facing surface 110 of the flexible film 100 via a suitable adhesive.

As the flexible film 100 including the stiffening members 80 and 82 is folded substantially as shown in FIGS. 8-10 to form a final package, the final package is similar to the package 10, but different in that it includes the stiffening members 80 and 82, which may provide increased structural integrity to the final package and which may restrict the food product 90 from shifting within the package. The stiffening members 80 and 82 may be formed from a variety of materials, for example, paperboard, plastic, or the like.

In another alternative form of the method, prior to folding the flexible film 100 as shown in FIGS. 8-10, an alternative stiffening member 84 as shown in FIG. 29 may be added to provide additional structural support to the soon-to-be-formed package. In particular, instead of placing the food product 90 on the areas 130 and 132 as shown in FIG. 7, the food product 90 is deposited in the area 132 of the flexible film 100 and a stiffening member 84 is either simply placed without attachment onto the upward-facing surface 110 in the area 130 of the flexible film 100, or is attached to the upward-facing surface 110 of the flexible film 100 via a suitable adhesive.

As the flexible film 100 including the stiffening member 84 is folded substantially as shown in FIGS. 8-10 to form a final package, the final package is similar to the package 10, but different in that one of the pouches includes the stiffening member 84, which may provide increased structural integrity to the final package. Similarly to the stiffening members 80 and 82, the stiffening member 84 may be formed from a variety of materials, for example, paperboard, plastic, or the like.

It is to be appreciated that the first longitudinal edge 104 of the flexible film 100 does not have to overlie the first crease line 112 when the flexible film 100 is folded as shown in FIG. 8. In addition, it is to be appreciated that the dimensions in FIGS. 6-9 are merely exemplary and not necessarily drawn to scale, and that the flexible film 100 may be used to manufacture flexible packages of various shapes and sizes. Examples of such packages are shown in FIGS. 16-19 and will be discussed below.

After the first and second longitudinal edges 102 and 104 of the flexible film 100 folded inward as shown in FIGS. 8 and 10, the sealing margins 119, 120 (see FIGS. 6 and 7) of the flexible film 100 underlying the metalized layers 122, 124 are sealed together, for example, by heat sealing, to form the first and second pouches 12 and 14. Adhesive materials, lamination, bonding, welding, UV-curing, or fusion may be used instead of heat sealing. Then, the area 126 of the flexible film 100, which includes the first longitudinal edge 104, is folded about the line of weakness 118 toward the second crease line 114 to overlay a portion of the area 128 of the flexible film 100 and expose an upward-facing surface 127 of the area 126, exposing more of the food product 90, as shown in FIGS. 9 and 10.

To provide the package 10 with a reclosable feature, an adhesive material can be applied to the area 128 of the flexible film 100 to form an adhesive area 136. While the adhesive area 136 has been shown in FIG. 9 as being applied on the area 128 of the flexible film 100 that will form part of the first pouch 12 of the package 10, the adhesive area 136 may be additionally or alternatively applied to the area 134 that will form part of the second pouch 14 of the package 10. It will be appreciated that while the adhesive area 136 has been shown as one circular area in FIGS. 9 and 10, the adhesive area 136 may be in a form a square or a rectangular strip, or may be in the form of several spaced adhesive areas that detachably attach the area 128 to the area 134 when the area 128 and the area 134 of the flexible film 100 are brought into abutment with each other.

After the area 126 of the flexible film 100 is folded as shown in FIGS. 9 and 10, one or more adhesive materials is applied to all or part of the upward-facing surface 127 of the area 126 of the flexible film 100. The adhesive material is chosen such that when the upward-facing surface 127 of the area 126 of the flexible film 100 is attached to an opposing portion of the flexible film 100, for example, a portion of the area 134, a non-detachable attachment is created. Instead of applying the adhesive material to the upward-facing surface 127, the adhesive material may be applied to the portion of the area 134 that faces the upward-facing surface 127 when the flexible film 100 is folded to its final configuration shown in FIG. 10.

After the adhesive material is applied to the upward-facing surface 127 of the area 126 of the flexible film 100, the flexible film 100 is folded such that the second and third crease lines 114, 116 are brought toward the first crease line 112 and toward each other such that the adhesive material on the upward-facing surface 127 of the area 126 adheres to an opposing portion of the area 134 of the flexible film 100 to seal the food product in the flexible film 100. It is to be appreciated that instead of applying an adhesive to the upward-facing surface 127 of the area 126 and then attaching the upward-facing surface 127 to the area 134 of the flexible film 100 to form an adhesive-based seal or vice versa, the upward-facing surface 127 can be brought into contact with an opposing portion of the area 134 of the flexible film 100 and heat-sealed, welded, bonded, fused, UV-cured, or laminated to seal the food product 90 in the flexible film 100.

Finally, the package 10 is singulated from the remainder of the flexible film 100 as depicted in FIG. 10. For example, a cutting device such as cutting jaws can make one or more cuts though the flexible film 100 to singulate the individual package 10 as shown in FIG. 10. The above-described method advantageously allows the above-described package 10 to be easily formed from a single sheet of flexible film 100.

Figure 11:
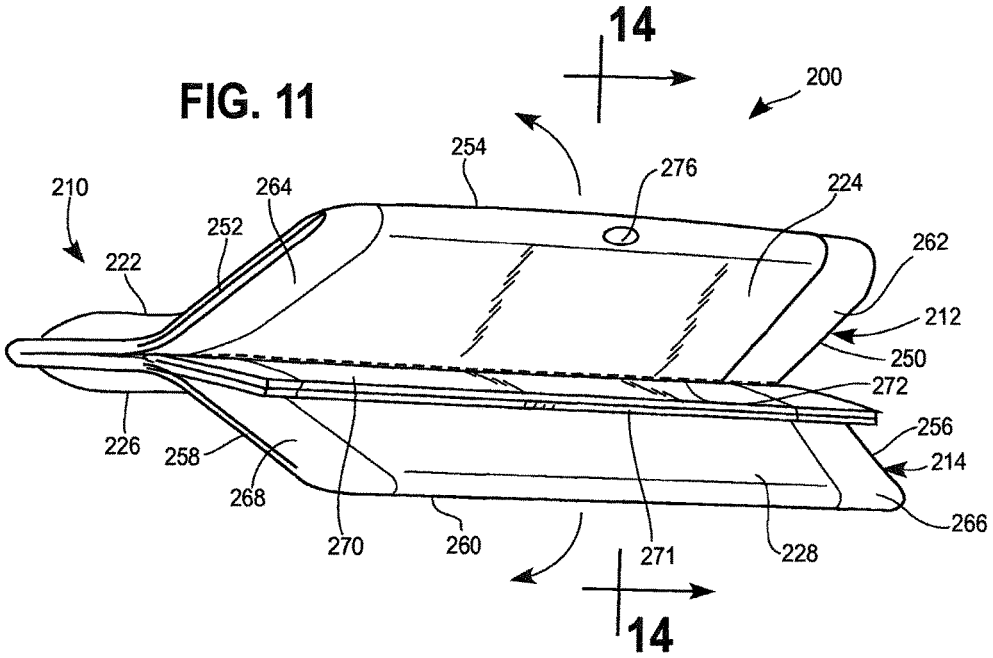
FIG. 11 illustrates a front perspective view of a second exemplary package folded about the hinge in a partially open position with two internal closure flaps (instead of one closure flap as in the prior figures) being fully attached to each other and their adjacent pouches along their respective lines of weaknesses.
Figure 12:
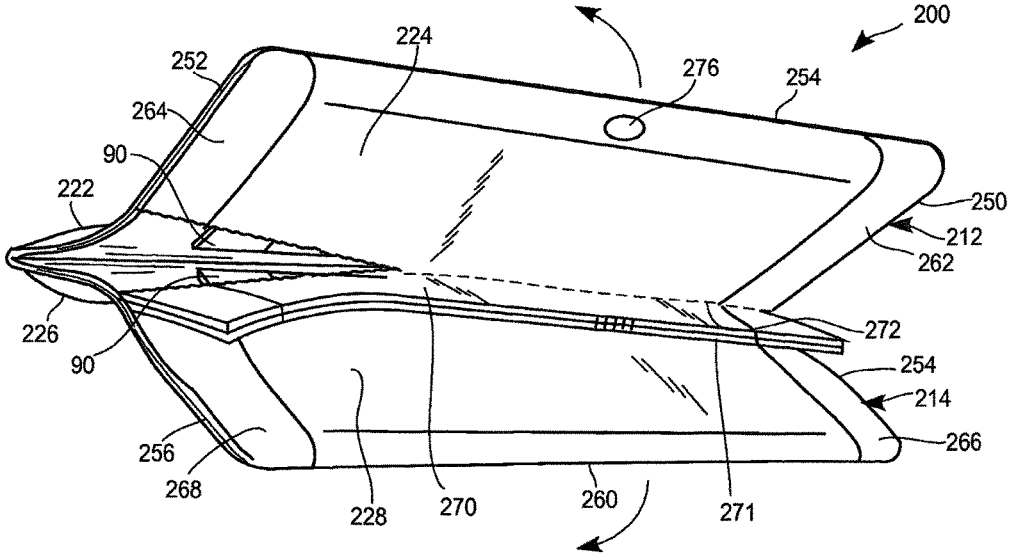
FIG. 12 illustrates a front perspective view of the package of FIG. 11 in a further partially open position with one of the two closure flaps being partially detached along its respective line of weakness.
Figure 13:
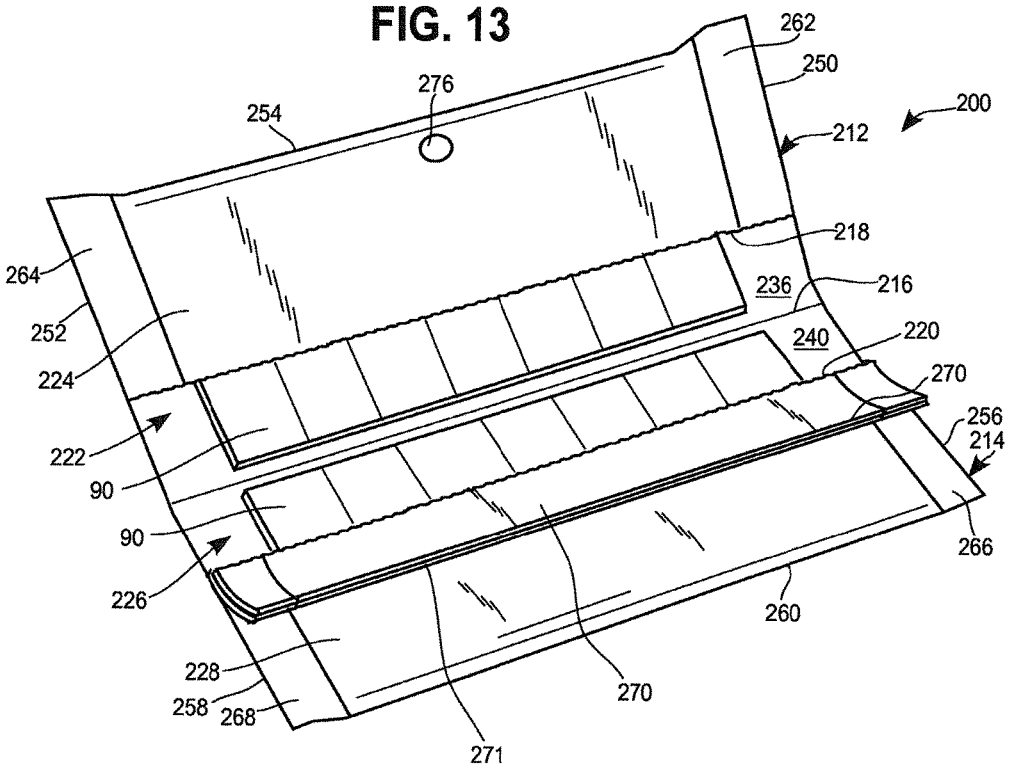
FIG. 13 illustrates a perspective view of the package of FIG. 11 in an open position with one of the two closure flaps being fully detached along its respective line of weakness.
Figure 14:
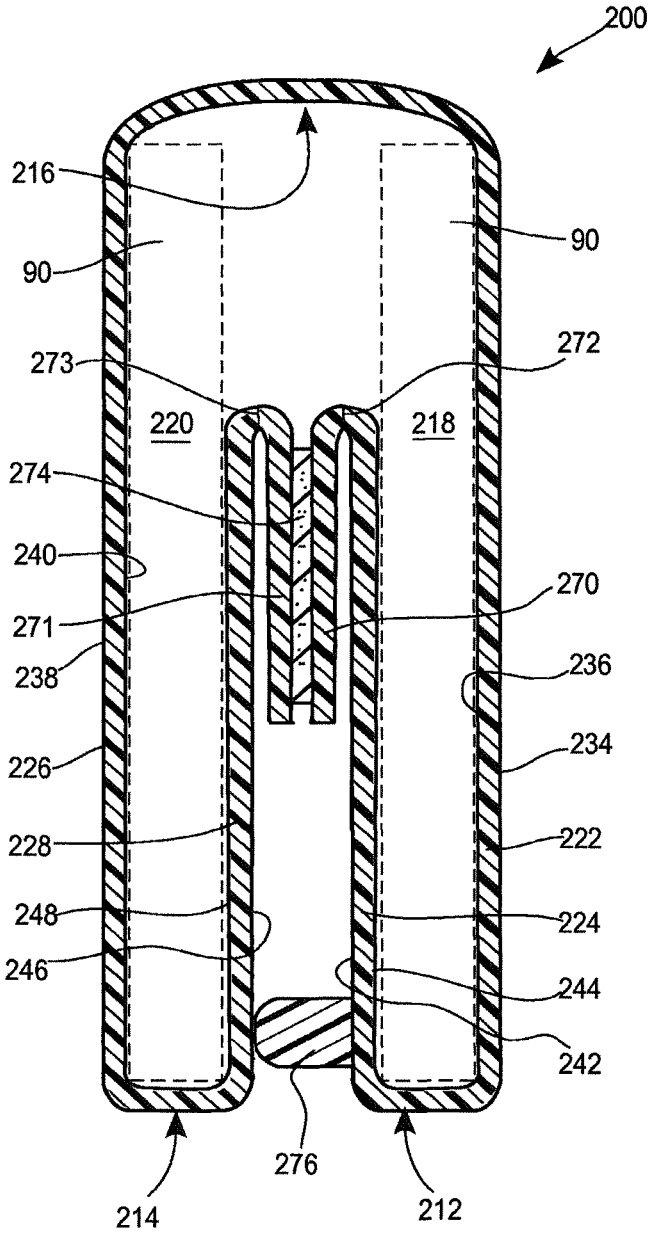
FIG. 14 illustrates a cross-section of the package of FIG. 11 taken alone line 14-14 thereof.

A package 200 according to another form is illustrated in FIGS. 11-14. Unlike the package 10, which includes one closure flap 70, the package 200 includes two closure flaps 270 and 271. The first closure flap 270 of the package 200 is attached to an interior panel 224 of the first pouch 212 along a first line of weakness 272, and the second closure flap 270 of the package 200 is attached to an interior panel 228 of the second pouch 214 along a second line of weakness 273, as shown in FIGS. 11 and 14. When the package 200 is in a closed position, the pouches 212 and 214 abut each other and the closure flaps 270 and 271 are folded about their respective lines of weakness 272 and 273 to overlie the outer surfaces 242 and 246 of the interior panels 224 and 228 of the pouches 212 and 214, respectively, as shown in FIG. 14.

With the package 200 being in the closed position shown in FIG. 14, the closure flaps 270 and 271 are attached to each other via an adhesive 274, which is selected to create a non-detachable attachment of the closure flaps 270 and 271 to each other. It will be appreciated that the closure flaps 270 and 271 may be attached to each other via other suitable means, for example, heat sealing, welding, UV-curing, lamination, or the like. With the closure flaps 270 and 271 being attached to each other when the package 200 is in the closed position, access to the openings 218, 220 of the pouches 212, 214 is blocked by the closure flaps 270 and 271.

Similar to the package 10, when the package 200 is moved from the closed position of FIG. 14 toward the open position of FIG. 13 in a direction shown by the directional arrows in FIGS. 11 and 12, the pouches 212 and 214 move about the hinge 216 away from each other to open the package 10 in a book-like manner, which may be visually appealing to consumers. During the opening of the package 200, the pouches 212, 214 move away from each other to a position where the opening force being applied by the consumer initiates a tear in one or both of the lines of weakness 272 and 273. In the form shown in FIG. 12, the package 200 has been shown with the closure flap 270 separating from the interior panel 224 of the first pouch 212 along the line of weakness 272.

It will be appreciated that, depending on the orientation of the package 200 and the opening force applied by the consumer, the closure flap 270 may remain attached to the interior panel 224, while the closure flap 271 may separate from the interior panel 228 of the second pouch 214 along the line of weakness 273. Alternatively, both of the closure flaps 270 and 271 may separate from their respective interior panels 224 and 228 of the first and second pouches 212 and 214 along their respective lines of weakness 272 and 273. After the closure flap 270 is fully detached from the interior panel 224 of the first pouch 212 along the line of weakness 272, the closure flap 270 no longer holds the pouches 212, 214 together and permits the pouches 212, 214 to be moved further away from each other into the open position shown in FIG. 13.

When the package 200 is in the open position shown in FIG. 13, the first closure flap 270 remains attached to the second closure flap 271, but no longer seals the package 200 or blocks access to the openings 218, 220 of the pouches 212, 214. Instead, as shown in FIG. 13, a consumer is permitted to remove portions of the food product 90 from the pouches 212 and 214 through the openings 218 and 220. Similar to the closure flap 70 of the package 10, the closure flaps 270 and 271 of the package 200 provides a freshness seal and/or tamper-evident feature for the package 200 such that the absence of, or the partial detachment of one or both of the closure flaps 270, 271 would visually indicate to a consumer that the package 200 has been previously opened or tampered with.

The package 200 is otherwise similar to the package 10 of FIGS. 1-9 in that it is formed from two pouches 212 and 214 having closed bottom ends 254 and 260. The pouches 212, 214 of the package 200 have end seals 262, 264, 266, and 268 similar to the end seals 62, 64, 66, and 68 of the package 10, as shown in FIG. 13. For ease of reference, in FIGS. 11-15, the aspects of the package 200 that are similar to the aspects of the package 10 have been designated with similar reference numbers, but prefaced with a "2."

The package 200 can be formed via a method that is substantially similar to the method shown in FIGS. 6-10. Since the package 200 includes two closure flaps 270, 271 instead of one closure flap 70 as in the package 10, the method of manufacture of the package 200 differs from the method of manufacture of the package 10 at least in that a second closure flap is formed in a flexible film 300 from which the package 200 is made.

Figure 15:
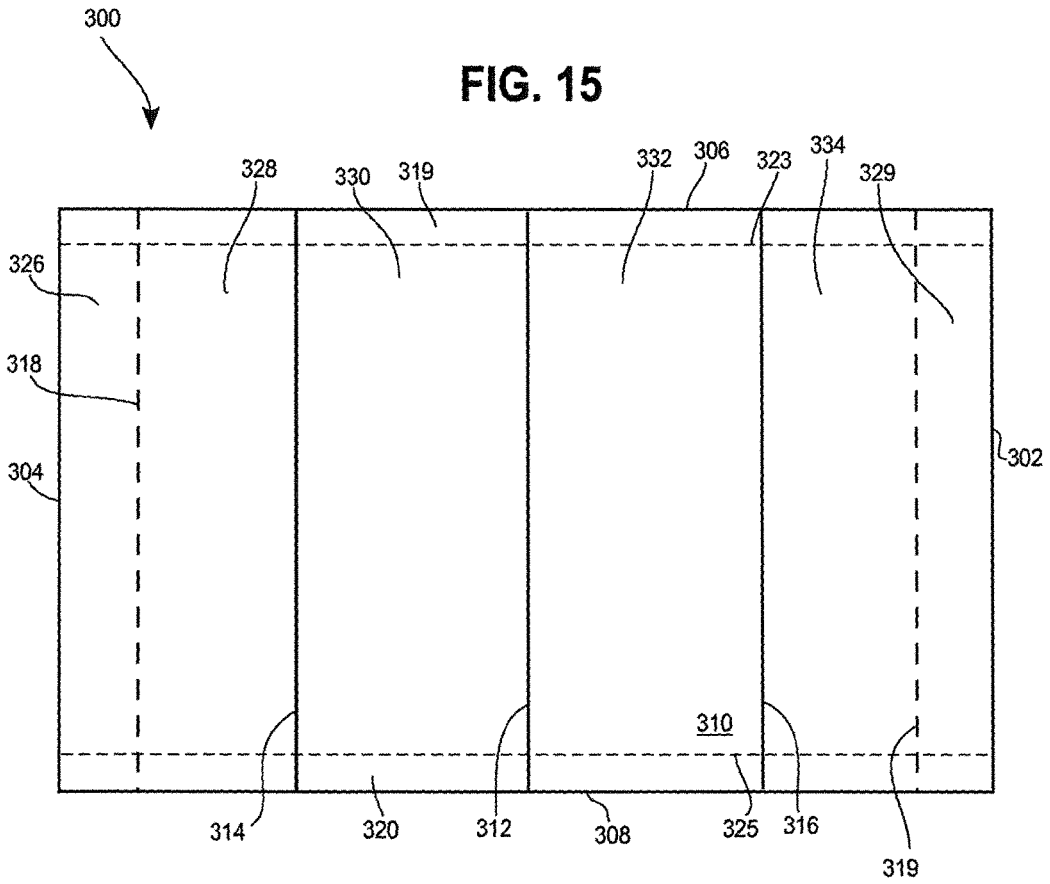
FIG. 15 illustrates a top plan view of an exemplary sheet of material, which can be part of a larger web of material, that can be used to form the package of FIG. 11.

In particular, in addition to forming a first line of weakness 318 in the flexible film 300 between a second crease line 314 and a first longitudinal edge 304 of the flexible film 300, a second line of weakness 319 is formed in the flexible film 300 between a third crease line 316 and a second longitudinal edge 302 of the flexible film 300, as shown in FIG. 15. The lines of weakness 318, 319 are formed substantially the same way as the line of weakness 118 is formed in the flexible film 100. The line of weakness 318 in the flexible film 300 corresponds to the line of weakness 272 of the package 200, while the line of weakness 319 corresponds to the line of weakness 273 of the package 200. The area 326 of the flexible film 300 between the first line of weakness 318 and the first longitudinal edge 304 corresponds to the closure flap 270 of the package 200, while the area 329 of the flexible film 300 between the second line of weakness 319 and the second longitudinal edge 302 corresponds to the closure flap 271 of the package 200.

As the flexible film 300 is moved in the machine direction, a food product 90 is deposited onto the upward-facing surface 310 of the flexible film 300 in a manner similar to that shown in FIGS. 7 and 10. Then, the opposite longitudinal edges 302, 304 of the flexible film 300 are folded inward and brought toward each other and toward the central fold zone 312 to overlay portions of the food product 90 and portions of the flexible film 300, substantially as shown in FIGS. 8 and 10. After the sealing margins 319, 320 of the flexible film 300 are sealed together in a manner similar to that described in reference to the package 10. Subsequently, the area 326 of the flexible film 300, which includes the first longitudinal edge 304, is folded about the first line of weakness 318 toward the second crease line 314 to overlay a portion of the area 328 of the flexible film 300 and expose an upward-facing surface of the area 326, as generally shown in FIG. 9 and described in reference to the folding of the area 126 of the flexible film 100. Similarly, the area 329 of the flexible film 300, which includes the longitudinal edge 302, is folded about the second line of weakness 319 toward the third crease line 316 to overlay a portion of the area 332 of the flexible film 300 and expose an upward-facing surface of the area 329.

After the areas 326 and 329 are folded about their respective lines of weakness 318 and 319 as described above, one or more adhesive materials is applied to all or part of one or both of the upward-facing surfaces of the area 326 and 329. Then, the flexible film 300 is folded such that the second and third crease lines 314, 316 are brought toward the first crease line 312 and toward each other such that the upward-facing surfaces of the areas 126 and 129 adhere to each other to seal the food product 90 in the flexible film 300. Finally, the package 200 is singulated from the remainder of the flexible film 300 in a manner similar to that shown in FIG. 10.

Figure 30:
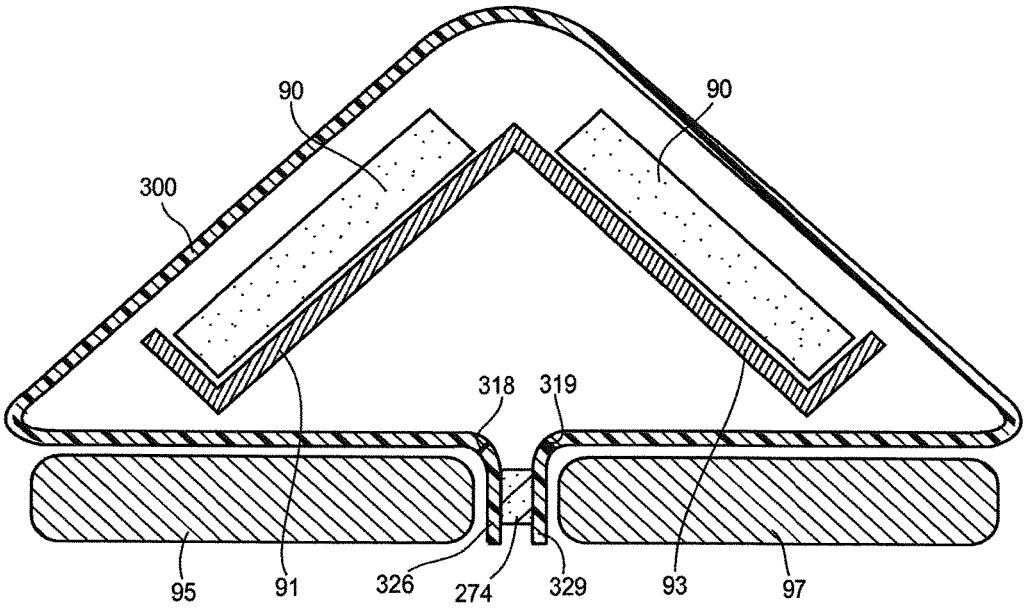
FIG. 30 illustrates a cross-sectional end view of some components of an exemplary process of manufacturing an alternative package similar to the package shown in FIGS. 11-14.

FIG. 30 shows some exemplary machinery that can be used to manufacture the package 200. Such machinery may include conveyor surfaces 91 and 93 on which the food product 90 may be placed. The conveyor surfaces are angled and diverge relative one another such that the flexible film 300 envelopes the food product 90 and assumes a generally triangular orientation as shown in FIG. 30. As the flexible film 300 is fed over the drive wheels 93 and 95, portions 326 and 329 of the flexible film 300 that will correspond to the closure flaps 270 and 271, respectively, of the package 200 are folded and attached to each other, in one form, non-detachably, via a heat seal 274 as shown in FIG. 30.

Figure 16:
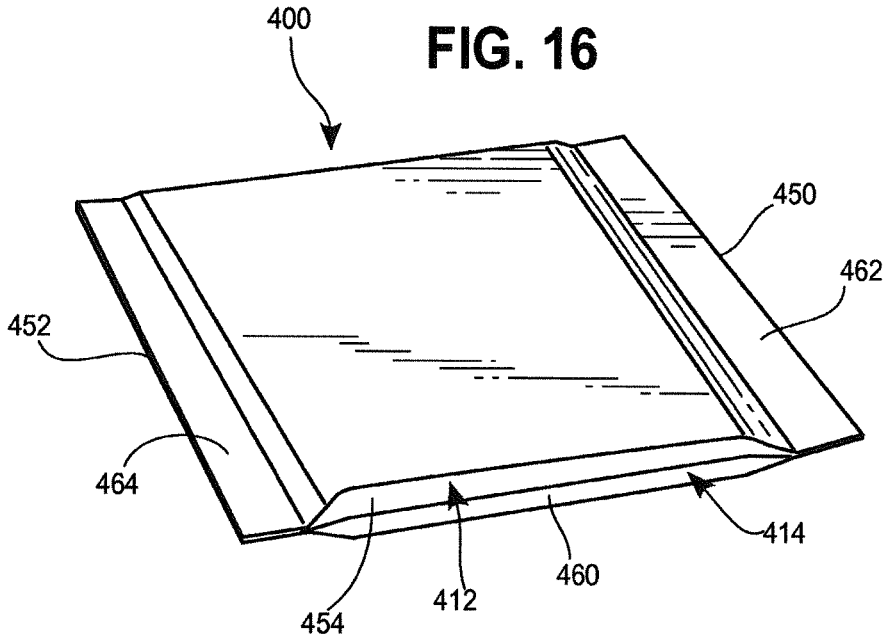
FIG. 16 illustrates a front perspective view of a third exemplary package having two smaller pouches than shown in FIG. 1 folded about a hinge in a closed position with an internal closure flap fully attached to an adjacent pouch along a line of weakness.
Figure 17:
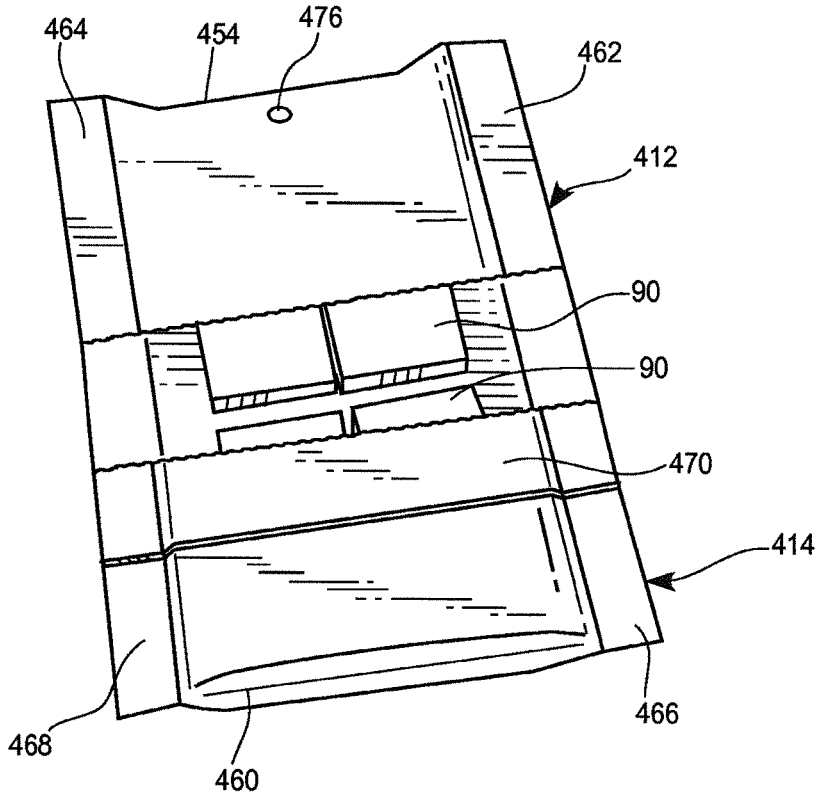
FIG. 17 illustrates a perspective view of the package of FIG. 16 in an open position with the closure flap being fully detached along the line of weakness.

A package 400 according to another form is illustrated in FIGS. 16 and 17. The package 400 has a different shape than the package 10. Specifically, while the package 10 is generally rectangular, the package 400 is generally square-shaped. In addition, the package 400 has a smaller size and capacity for the food product 90 as compared to the package 10. Specifically, the length of the package 400 as measured by the distance from the edge 450 to the edge 452 is approximately half, or less than half the length of the package 10 as measured by the distance from the edge 50 to the edge 52. For at least that reason, the package 400 has a smaller capacity for the food product 90, as demonstrated by the fact that the exemplary package 10 contains seven gum sticks in each of the pouches 12, 14, while the exemplary package 400 contains two gum sticks in each of the pouches 412, 414.

The package 400 is otherwise similar to the package 10 of FIGS. 1-9 in that it is formed from two pouches 412 and 414 having closed bottom ends 454 and 460. For ease of reference, in FIGS. 16 and 17, the aspects of the package 400 that are similar to the aspects of the package 10 have been designated with similar reference numbers, but prefaced with a "4." The pouches 412, 414 of the package 400 have end seals 462, 464, 466, and 468 similar to the end seals 62, 64, 66, and 68, as shown in FIG. 17. The package 400 is sealed similarly to the package 10 of FIGS. 1-9 in that a closure flap 470 is attached to both pouches 412 and 414 when the package 400 is in a closed position.

The package 400 is opened similarly to the package 10 of FIGS. 1-9 in that the closure flap 470 detaches from the pouch 412 along a line of weakness and remains attached to the pouch 414, as shown in FIG. 17. The package 400 is also provided with a reclosure feature in that the pouch 412 includes an adhesive area 476 similar to the adhesive area 76 of the package 10. The package 400 can be formed via a method that is substantially similar to the method shown in FIGS. 6-10. The package 400 can be formed with different dimensions and/or features than those shown in FIGS. 16 and 17. For example, the package 400 may optionally have a length that is greater than or less than the package 10, and may optionally have two closure flaps similar to the package 200 of FIGS. 11-14.

Figure 18:
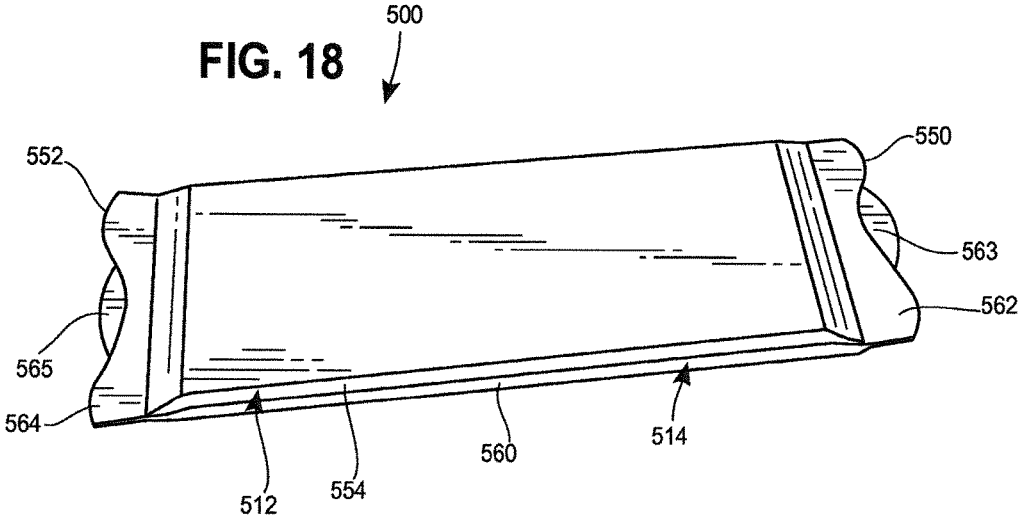
FIG. 18 illustrates a front perspective view of a fourth exemplary package having two pouches folded about a hinge in a closed position with end seals forming pull tabs and an internal closure flap fully attached to an adjacent pouch along a line of weakness.
Figure 19:
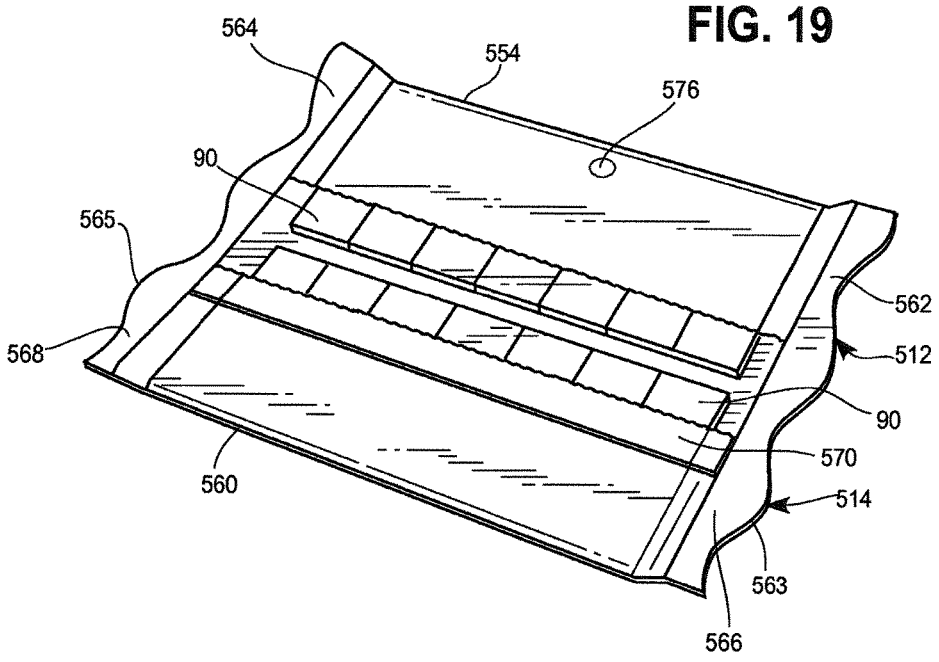
FIG. 19 illustrates a perspective view of the package of FIG. 18 in an open position with the closure flap being fully detached along the line of weakness.

A package 500 according to another form is illustrated in FIGS. 18 and 19. The package 500 has end seals 562, 564, 566, and 568 that have a different shape than the end seals 62, 64, 66, and 68 of the package 10. In particular, while the end seals 62, 64, 66, and 68 of the package 10 are generally straight, the end seals 562, 564, 566, and 568 of the package 500 are in the form of one or more waves forming an undulating shape, as shown in FIGS. 18 and 19. In addition, opposing end seals 562 and 566 as well as opposing end seals 564 and 568 have a different shape such that when the package is closed, portions of the end seals 566 and 568 protrude from under the end seals 562 and 564, respectively, to form pull tabs 563 and 565, as shown in FIGS. 18 and 19. The pull tabs 563 and 565 can facilitate a consumer in opening the package 500.

The package 500 is otherwise similar to the package 10 of FIGS. 1-5 in that it is formed from two pouches 512 and 514 having closed bottom ends 554 and 560. For ease of reference, in FIGS. 18 and 19, the aspects of the package 500 that are similar to the aspects of the package 10 have been designated with similar reference numbers, but prefaced with a "5." The pouches 512, 514 of the package 500 have end seals 562, 564, 566, and 568 similar to the end seals 62, 64, 66, and 68, as shown in FIG. 19. The package 500 is sealed similarly to the package 10 of FIGS. 1-5 in that a closure flap 570 is attached to both pouches 512 and 514 when the package 500 is in a closed position. The package 500 is opened similarly to the package 10 of FIGS. 1-5 in that the closure flap 570 detaches from the pouch 512 along a line of weakness and remains attached to the pouch 514, as shown in FIG. 19. The package 500 is also provided with a reclosure feature in that the pouch 512 includes an adhesive area 576 similar to the adhesive area 76 of the package 10.

The package 500 can be formed via a method that is substantially similar to the method shown in FIGS. 6-10. It will be appreciated that the package 500 of FIGS. 18 and 19 can be manufactured in larger or smaller sizes such that each pouch 512, 514 may contain 1, 2, 3, 4, 5, 6, 7, or 8 gum sticks, or more. The package 500 may optionally have two closure flaps similar to the closure flaps 270, 271 of the package 200 of FIGS. 11-14.

Figure 20:
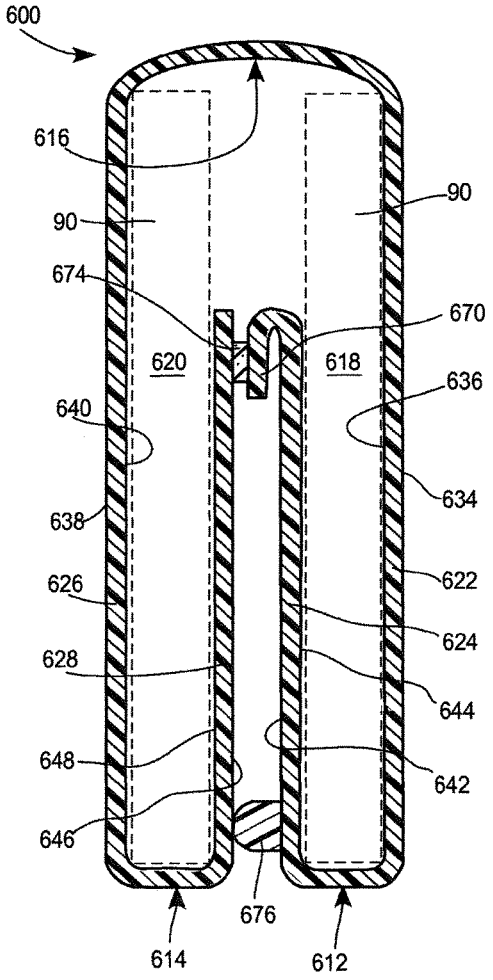
FIG. 20 illustrates a cross-section of a third exemplary package, similar to the packages of the prior figures but having a single closure flap lacking a line of weakness and attached to an adjacent pouch via a seal configured for rupturing during opening instead of along a line of weakness.

A package 600 according to another form is illustrated in FIG. 20. The package 600 is similar to the package 10 of FIGS. 1-9, with certain differences highlighted below. For ease of reference, aspects of the package 600 that are similar to aspects of the package 10 have been designated with similar reference numbers, but prefaced with a "6." While shown in section, it will be understood that the package 600 is of the same general construction of the packages described above, with differences highlighted below.

The package 600 of FIG. 20 is unlike the package 10 of FIG. 5 in that the closure flap 670 of the package 600 is shorter than the closure flap 70 of the package 10, although the length of the closure flap 670 can be of other lengths than illustrated. In addition, while the closure flap 70 of the package 10 of FIG. 5 includes a line of weakness 72 to permit the closure flap 70 to be separable from the interior panel 24, the closure flap 670 of the package 600 of FIG. 20 does not include such a line of weakness. Further, while the closure flap 70 of FIG. 5 is attached to the exterior surface 46 of the panel 28 via an adhesive 74 that is preferably in the form of a heat seal, the closure flap 670 in FIG. 20 is attached to the exterior surface 646 of the panel 628 via a peelable seal 674, such as a cold seal or a pressure sensitive adhesive.

During the opening of the package 600, the pouches 612, 614 move away from each other when pivoted about the hinge to a position where the opening force being applied by the consumer peels or breaks the peelable seal 674 to separate the closure flap 670 from the interior panel 624 of the pouch 612 such that the closure flap 670 no longer seals the package 600, or blocks access to the openings 618, 620 of the pouches 612, 614. This permits the consumer to remove portions of the food product 90 from the pouches 612 and 614 through the openings 618 and 620.

Figure 21:
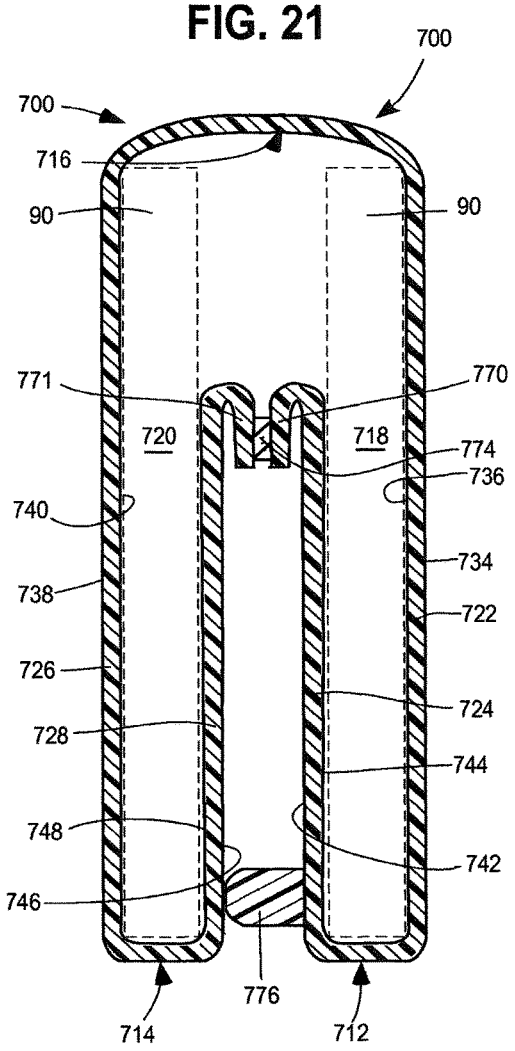
FIG. 21 illustrates a cross-section of a fourth exemplary package, similar to the packages of the prior figures but having a pair of closure flaps that are each attached to their respective pouches without a line of weakness, folded against their respective pouches, and joined by a seal configured for rupturing during opening instead of along a line of weakness.

A package 700 according to another form is illustrated in FIG. 21. The package 700 of FIG. 21 is similar to the package 200 of FIG. 14, with differences discussed below. For ease of reference, aspects of the package 700 that are similar to aspects of the package 200 have been designated with similar reference numbers, but prefaced with a "7." While shown in section, it will be understood that the package 700 is of the same general construction of the packages described above, with differences highlighted below.

The package 700 of FIG. 21 is unlike the package 200 of FIG. 14 in that the closure flaps 770 and 771 in FIG. 21 are shorter than the closure flaps 270 and 271 in FIG. 14, although other lengths can be suitable. By way of example only, the closure flap 770 in FIG. 21 is identical in size to the closure flap 670 in FIG. 20. In addition, the closure flaps 770 and 771 of the package 700 of FIG. 21 do not include lines of weakness akin to the lines of weakness 272 and 273 in FIG. 14 that permit the closure flaps 270 and 271 of the package 200 to be separated from the interior panels 224 and 228. Further, while the closure flap 270 of FIG. 14 is attached to the exterior surface 246 of the panel 228 via an adhesive 274 that is preferably in the form of a heat seal, the closure flap 770 in FIG. 21 is attached to the exterior surface 746 of the panel 728 via a peelable seal 774, such as a cold seal or a pressure sensitive adhesive.

As the package is being opened by a consumer, the pouches 712 and 714 move away from each other to a position where the opening force being applied by the consumer peels or breaks the peelable seal 774 to separate the closure flaps 770 and 771 from each other such that the closure flaps 770 and 771 no longer seal the package 700, or block access to the openings 718, 720 of the pouches 712, 714. The breaking of the peelable seal 774 can provide an audible, visual and/or tactile response to a consumer during opening. After opening, the consumer can remove portions of the food product 90 from the pouches 712 and 714 through the openings 718 and 720, unless the openings are further blocked, as discussed in an alternative embodiment herein.

Figure 22:
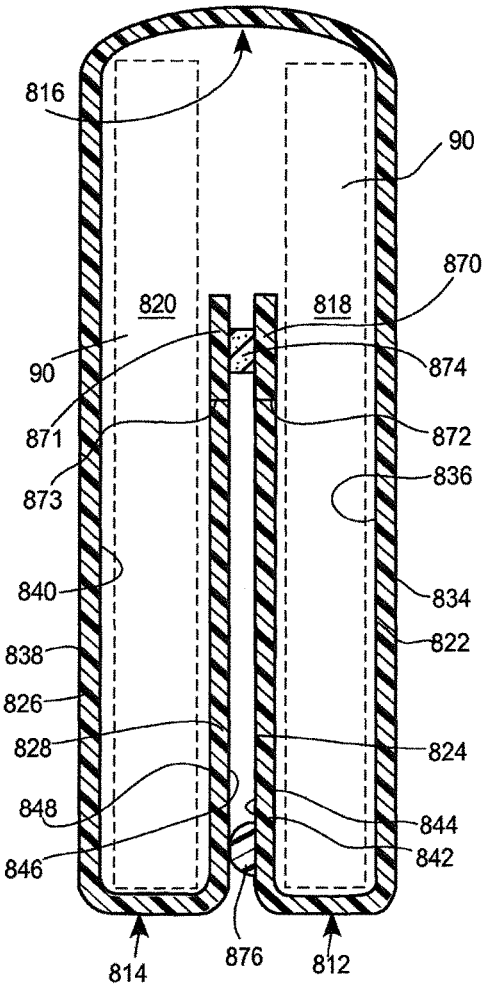
FIG. 22 illustrates a cross-section of a fifth exemplary package, similar to the packages of the prior figures but having a pair of closure flaps that are each attached to their respective pouches via a line of weakness, attached to each other and not folded against their respective pouches.

A package 800 according to another form is illustrated in FIG. 22. The package 800 is similar to the package 200 of FIG. 14, with specific differences discussed in detail below. For ease of reference, aspects of the package 800 that are similar to aspects of the package 200 have been designated with similar reference numbers, but prefaced with a "8." While shown in section, it will be understood that the package 800 is of the same general construction of the packages described above, with differences highlighted below.

The package 800 in unlike the package 200 in that the interior panels 824 and 828 in FIG. 22 do not include closure flaps akin to the closure flaps 270 and 271 in FIG. 14. Specifically, while the closure flaps 270 and 271 of FIG. 14 are folded to overlie portions of the outer surfaces 842 and 846 of the interior panels 824 and 828, respectively, the interior panels 824 and 828 of FIG. 22 are not folded but extend generally parallel to each other and each include a line of weakness 872 and 873, respectively. Portions of the interior panels 824 and 828 above the lines of weakness 872 and 873 constitute detachable closure flaps 870 and 871, which are non-detachably attached to each other via an adhesive 874, for example, a heat seal, to seal the package 800.

During the opening of the package 800, the pouches 812, 814 move away from each other to a position where the opening force being applied by the consumer initiates a tear in one or both of the interior panels 824 and 828 along one or both of the lines of weakness 872 and 873 to separate one or both of the closure flaps 870 and 871 from the remainder of the interior panels 824 and 828. When the package 800 is in the open position, the closure flaps 870 and 871 remain attached to each other via the heat seal 874, but one or both of the closure flaps 870 and 871 are no longer attached to their respective interior panels 824 and 828 and no longer seal the package 800, or block access to the openings 818, 820 of the pouches 812, 814. This permits the consumer to remove portions of the food product 90 from the pouches 812, 814 via the openings 818, 820.

Figure 23:
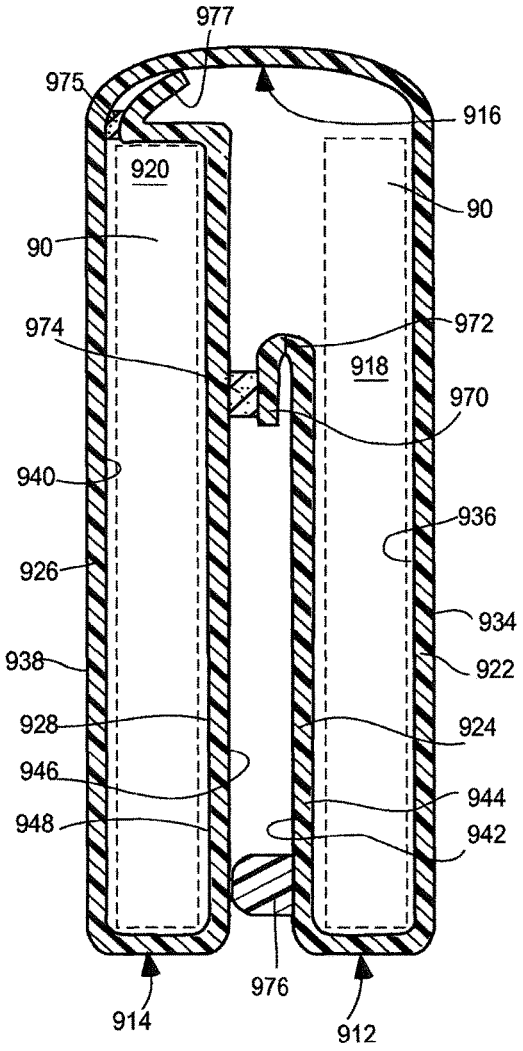
FIG. 23 illustrates a cross-section of a sixth exemplary package, similar to the package of FIGS. 1-5, but having an interior panel of one of the pouches extend toward the hinge region and removably attached to the interior of the outer panel of the one of the pouches to selectively block access to the opening of the one of the pouches after opening of the package and separation of the closure flap.

A package 900 according to another form is illustrated in FIG. 23. For ease of reference, aspects of the package 900 that are similar to aspects of the packages 10, 200, 600, 700, and 800 have been designated with similar reference numbers, but prefaced with a "9." While shown in section, it will be understood that the package 900 is of the same general construction of the packages described above, with differences highlighted below.

The pouch 912 of the package 900 of FIG. 23 is similar to the pouch 612 of the package 600 of FIG. 20, with the only difference being in that the pouch 912 includes a line of weakness 972 that facilitates the separation of the closure flap 970 from the interior panel 924 of the first pouch 912. Another difference is that unlike the peelable seal 674 in FIG. 20, which is preferably a cold seal, the seal 974 between the closure flap 970 and the outer surface 946 of the interior panel 928 of the pouch 914 is seal that provides a non-detachable attachment, for example, a heat seal. In other words, the seal 974 has a strength selected such that there is a greater propensity for rupturing along the line of weakness 972 relative to along the seal 974.

The pouch 914 of the package 900 of FIG. 23 is different from the pouch 614 of the package 600 of FIG. 20 in that while the interior panel 628 of the package 600 extends along a portion of the height of the food product 90, the interior panel 928 of the package 900 extends along the entire height of the food product 90 and wraps around the food product to form a cold seal 975 to an inner surface 940 of the exterior wall 926, thereby sealing the product 90 within the pouch 914.

As the package 900 is being opened by the consumer by pivoting about the hinge, the pouches 912, 914 move away from each other to a position where the opening force being applied by the consumer initiates a tear in the closure flap 970 along the line of weakness 972 to separate the closure flap 970 from the interior panel 924 of the pouch 912 such that the closure flap 970 remains attached to the interior panel 928 via the heat seal 974, but no longer seals the pouch 912, or blocks access to the opening 918 of the pouch 912, permitting the consumer to remove portions of the food product 90 from the pouch 912. Notably, the package 900 is distinct from the packages described herein in that the second pouch 914 remains fully sealed (at the cold seal 975) even after the package 900 is opened by separation of the closure flap 970. To permit the consumer to open the second pouch 914, the interior panel 924 of the pouch 914 includes an end portion in the form of a pull tab 977 that can be used to break the cold seal 975 and open the pouch 914 to retrieve the food product 90.

Figure 24:
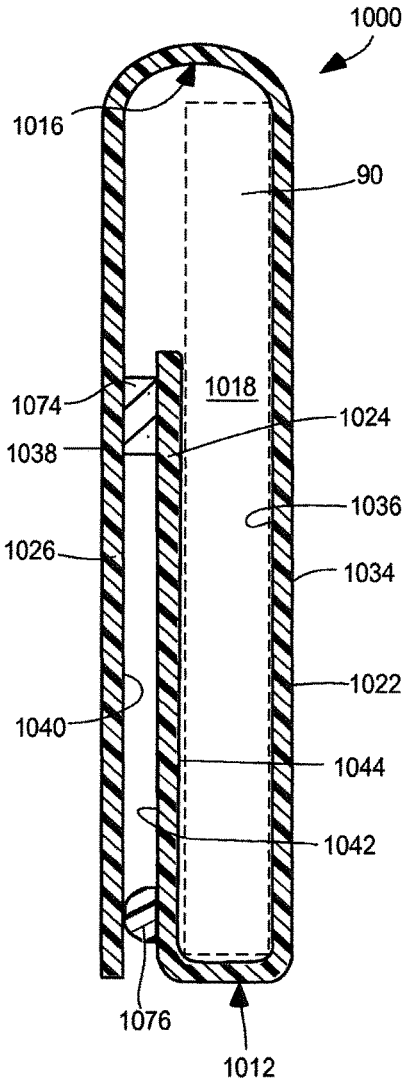
FIG. 24 illustrates a cross-section of a seventh exemplary package, similar in some aspects to the package of FIGS. 1-5, but having only one pouch with a hinged cover, a closure flap that is not folded over, and attached to the cover by a seal configured for rupturing during opening instead of along a line of weakness.

A package 1000 according to another form is illustrated in FIG. 24. The package 1000 is different from the previously described packages (that include two pouches joined at a hinge) in that the package 1000 includes only one pouch for containing a food product 90. For ease of reference, aspects of the package 1000 that are similar to aspects of the previously described packages have been designated with similar reference numbers, but prefaced with a "10." While shown in section, it will be understood that the package 1000 is of the same general construction of the packages described above, with differences highlighted below.

As shown in FIG. 24, the exterior wall 1026 of the package 1000, instead of forming a second pouch, extends substantially linearly along the height of the food product 90 to function as a cover. The inner surface 1042 of the interior panel 1024 is attached to an outer surface 1042 of the interior panel 1024 of the package 1000 via a peelable seal 1074, such as a cold seal or a pressure sensitive adhesive, to seal the package 1000.

During the opening of the package 1000 by a consumer, the exterior wall 1026 of the package 1000 may be moved away from the interior panel 1024 to a position where the opening force being applied by the consumer breaks the peelable seal 1074 to permit the exterior wall 1026 to be detached from the interior panel 1024 such that the outer wall 1026, which constitutes a closure flap in this embodiment, no longer seals the package 1000, or blocks access to the opening 1018 of the pouch 1012, but provides the consumer access to the opening 1018 of the pouch 1012 such that portions of the food product 90 can be removed from the package 1000 through the opening 1018.

Figure 25:
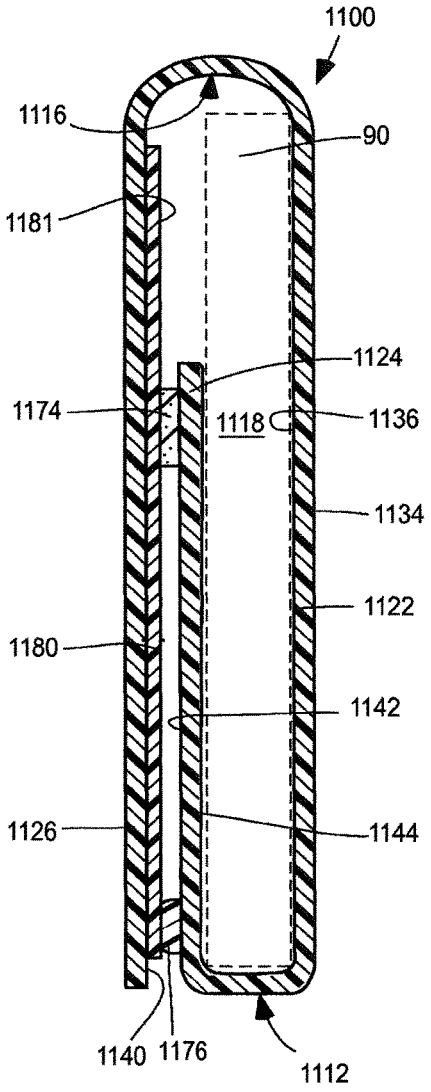
FIG. 25 illustrates a cross-section of an eighth exemplary package, similar to the package of FIG. 24, but having a stiffening member attached to the cover.

A package 1100 according to another form is illustrated in FIG. 25. The package 1100 is similar to the package 1000 of FIG. 24. For ease of reference, aspects of the package 1100 that are similar to aspects of the package 1000 have been designated with similar reference numbers, but prefaced with an "11." While shown in section, it will be understood that the package 1100 is of the same general construction of the packages described above, with differences highlighted below.

The package 1100 of FIG. 25 is unlike the package 1000 of FIG. 24 in that the exterior wall 1026 of the package 1000, includes a stiffening member 1180 attached to the interior surface 1140 of the exterior wall 1126 to provide structural support to the outer wall 1126. Whereas the exterior wall 1026 of the package 1000 of FIG. 24 is attached to the outer surface 1042 of the interior panel 1024 via the peelable seal 1074, the exterior wall 1126 is attached, at its inner surface 1140, to the stiffening member 1180, the interior surface 1181 of which in turn is attached to the outer surface 1142 of the interior panel 1124 via a peelable seal 1174, such as a cold seal or a pressure sensitive adhesive, to seal the package 1100. The stiffening member 1180 may be formed from a variety of materials, for example, paperboard, plastic, or the like.

The package 1100 can be opened by moving the outer wall 1126 away from the interior panel 1124 to a position where the opening force breaks the peelable seal 1174 such that the outer wall 1126, which constitutes a closure flap in this embodiment, no longer seals the package 1100, or blocks access to the opening 1118 of the pouch 1112, but provides the consumer access to the opening 1118 of the pouch 1112 such that portions of the food product 90 can be removed from the package 1100 through the opening 1118.

Figure 26:
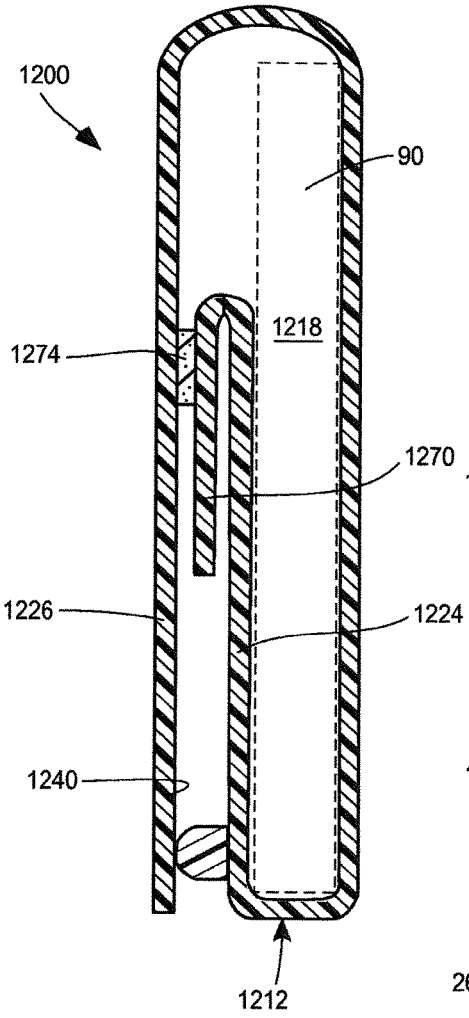
FIG. 26 illustrates a cross-section of a ninth exemplary package, similar to the package of FIGS. 1-5, but having a hinged cover instead of a second pouch.

A package 1200 according to another form is illustrated in FIG. 26. The package 1200 is similar to the package 1000 of FIG. 24, with certain differences discussed below. For ease of reference, aspects of the package 1200 that are similar to aspects of the package 1000 have been designated with similar reference numbers, but prefaced with a "12." While shown in section, it will be understood that the package 1200 is of the same general construction of the packages described above, with differences highlighted below.

The package 1200 of FIG. 26 is unlike the package 1000 of FIG. 24 in that the interior panel 1224 of the package 1200 is not attached directly to the inner surface 1240 of the exterior wall 1226, but includes a closure flap 1270, which is folded about a line of weakness 1271 to overlie portions of the inner surface 1242 of the interior panel 1224. The closure flap 1270 is non-detachably attached to the inner surface 1140 of the outer wall 1126 via an adhesive 1274, for example, a heat seal, cold seal, hot melt, pressure sensitive adhesive, or the like to seal the package 1200.

During the opening of the package 1200, the outer wall 1226 of the package 1200 may be moved away from the interior panel 1224 to a position where the opening force being applied by the consumer initiates a tear in the closure flap 1270 to separate the closure flap 1270 from the interior panel 1224 along the line of weakness 1271 such that the closure flap 1270 remains attached to the inner surface 1140 of the exterior wall 1226 via the heat seal 1274, but no longer seals the package 1200, or blocks access to the opening 1218 of the pouch 1212 to permit the consumer to remove portions of the food product 90 from the pouch 1212 through the opening 1218.

Figure 27:
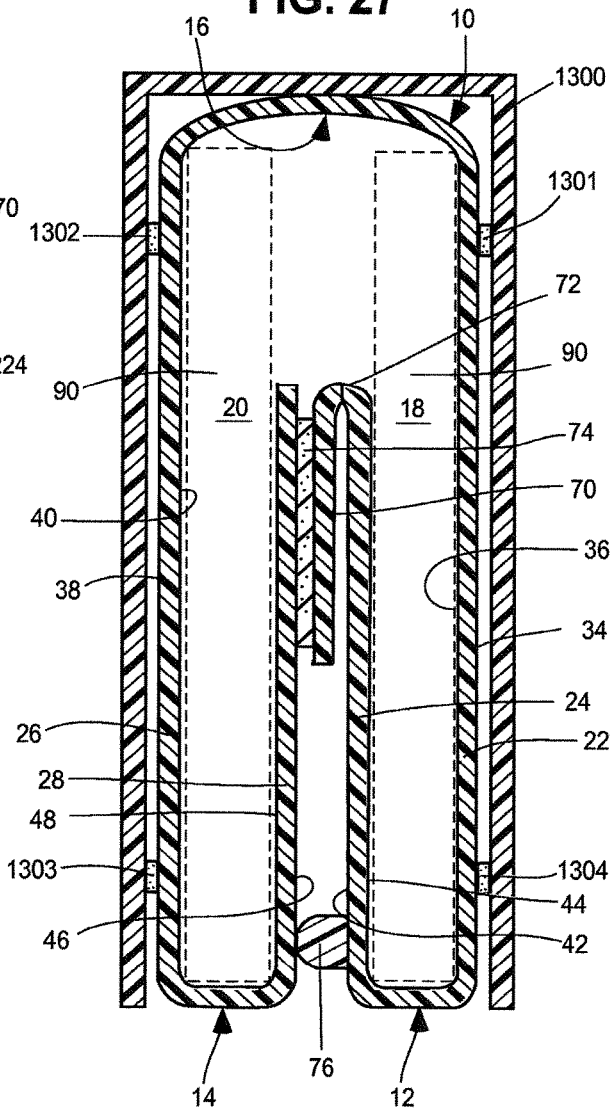
FIG. 27 illustrates a cross-section of a tenth exemplary package, similar to the package of FIGS. 1-5, but having a rigid outer cover attached to the exterior of each of the two pouches.

FIG. 27 shows the package 10 of FIG. 5 further including an external cover 1300. The cover 1300 may be formed from a rigid material such as paperboard, cardboard, plastic, or combinations thereof. The cover 1300 may be attached, for example, using an adhesive, a cold seal, or the like to the package 10. In the form shown in FIG. 27, the cover 1300 is attached to the outer surface 34 of the exterior wall 22 via seals 1301 and 1302 and attached to the outer surface 38 of the exterior wall 26 via seals 1303 and 1304. To remove the cover 1300 and gain access to the package 10, the cover 1300 may be moved, for example, by sliding, along the outer walls 22 and 26 of the package 10 until the opening force being applied by the consumer breaks the seals 1301, 1302, 1303, and 1304, permitting the package 10 to be removed from the cover 1300. After the package 10 is removed from the cover 1300, it can be opened as discussed above.

Each of the packages shows in FIGS. 20-29 can be formed via a method that is substantially similar to the method shown in FIGS. 6-10 and described above, as well as other suitable methods.

Figure 33:
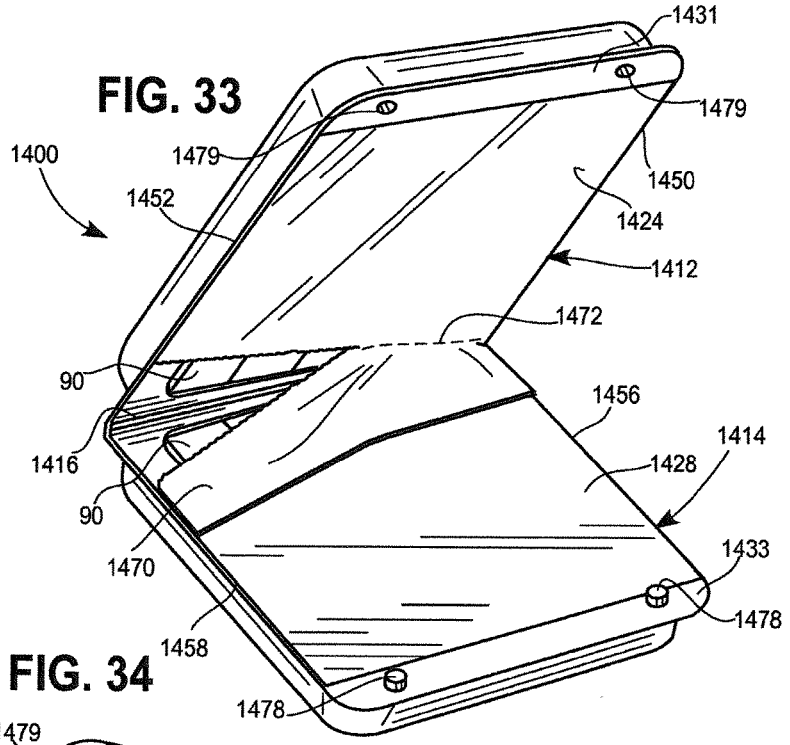
FIG. 33 illustrates a perspective view of the package of FIG. 31 being moved from the closed configuration of FIG. 32 toward an open configuration by rupturing along a line of weakness joining a closure flap to one of the film sheets.
Figure 34:
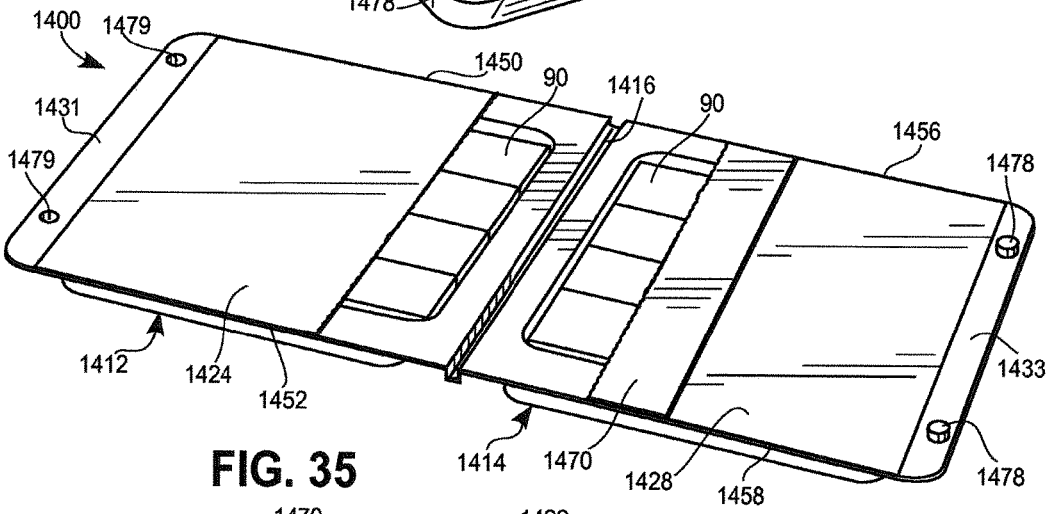
FIG. 34 illustrates a perspective view of the package of FIG. 31 in the open configuration with the closure after the closure flap has been ruptured along the line of weakness.

In yet another embodiment, the package 1400 of FIGS. 31-35 can include a rigid clam-shell like outer member 1410 with two pockets 1412, 1414 and a hinge 1416 therebetween. The first pocket 1412 has a hollow interior 1411 sized and shaped to contain the food product 90 and a peripheral flange 1431 surrounding the hollow interior 1411. Similarly, the second pocket 1414 has a hollow interior 1413 sized and shaped to contain the food product 90 and a peripheral flange 1433 surrounding the hollow interior 1413. A first sheet of film 1424 can be attached to peripheral flange 1431 of the first pocket 1412, and a second sheet of film 1428 can be attached to a peripheral flange 1433 of the second pocket 1414. The sheets 1424 and 1428 are dimensioned such that they cover a portion of the hollow interiors 1411 and 1413 of the first and second pocket 1412 and 1414, respectively, thus providing the consumer access to the food product 90 and permitting the consumer to remove the food product 90 from the pockets 1412 and 1414 when the package 1400 is in the open position as shown in FIG. 34. By "rigid," what is meant is a material is preferably more rigid that the film. Thus, the material forming the pockets 1412, 1414 of the clam-shell like outer member 1410 is more rigid than the material forming the first and second sheets of film 1424 and 1428. In one approach, the rigid material can be thermoformable to make the pockets 1412 and 1414.

The first and second sheets of film 1424 and 1428 can be attached to their respective peripheral flanges 1431 and 1433 via one or more adhesives, heat sealing, welding, or the like. In one approach, the first and second sheets of film 1424, 1428 are attached to the peripheral flanges 1431, 1433 such that each film 1424, 1428 extends from the a respective top edge 1450, 1456 to the respective bottom edge 1452, 1458 of the first and second pockets 1412, 1414, covering underlying portions of the respective peripheral flanges 1431, 1433, as shown in FIG. 34. It will be appreciated that the films 1424 and 1428 can be attached to the peripheral flanges 1431 and 1433 such that the films 1424 and 1428 are spaced from the top edges 1450, 1456 and the bottom edges 1452, 1458.

The first sheet of film 1424 has a closure flap 1470 folded against the film 1424 about a line of weakness 1472 and separable from the film 1424 along the line of weakness 1472. When the package 1400 is closed, the closure flap 1470 is attached to the first film 1424 along the line of weakness 1472 and attached to the second film 1428 via an adhesive 1474 to the second film 1428, thereby sealing the food product 90 in the package 1400. The adhesive 1474 is selected to create a non-detachable attachment of the closure flap 1470 to the second film 1428. It will be appreciated that instead of an adhesive, the closure flap 1470 may be attached to the second film 1428 via other suitable means, for example, heat sealing, welding, UV-curing, lamination, or the like.

When the package 1400 is moved from the closed position of FIG. 32 toward the open position of FIG. 34 in a direction shown by the directional arrow in FIG. 33, the pockets 1412 and 1412 move about the hinge 1416 away from each other to open the package 1400 in a book-like manner, which may be visually appealing to consumers. During the opening of the package 1400, the pockets 1412, 1414 move away from each other to a position where the opening force being applied by the consumer initiates a tear in the line of weakness 1472 and causes the closure flap 1470 to separate by tearing from the first film 1424 along the line of weakness 1472, as shown in FIG. 33. The closure flap 1470 thus provides a consumer with a visual indication of the degree of opening of the package 1400. In addition, since a consumer would feel some resistance during the detachment of the closure flap 1470 along the line of weakness 1472, the closure flap 1470 can provide a tactile and potentially audible response to the consumer during the initial opening of the package 1400.

After the closure flap 1470 is detached from the first film 1424 along the line of weakness 1472, the closure flap 1470 no longer holds the pockets 1412 and 1414 together and permits the pockets 1412 and 1414 to be moved further away from each other into the open position shown in FIG. 34. When the package 1400 is in the open position shown in FIG. 34, the closure flap 1470 remains attached to the second film 1428 of the second pocket 1414, but no longer seals the package 1400 or blocks access to the hollow interiors 1411, 1413 of the pockets 1412, 1414. Instead, as shown in FIG. 34, a consumer is permitted to remove portions of the food products 90 from the pockets 1412 and 1414. The closure flap 1470 thus provides a freshness seal and/or tamper-evident feature for the package 1400 such that the absence of, or the partial detachment of the closure flap 1470, would visually indicate to a consumer that the package 1400 has been previously opened or tampered with.

Figure 35:
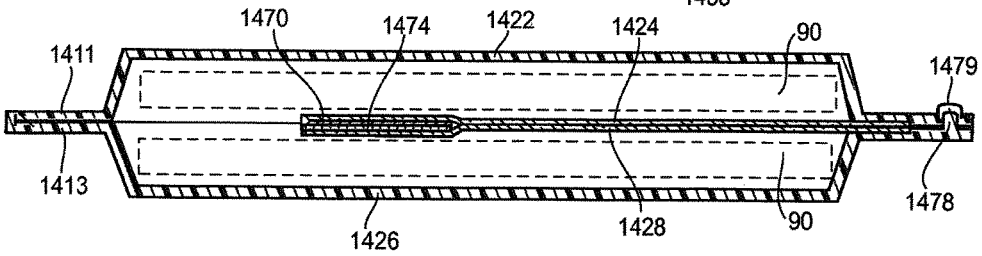
FIG. 35 illustrates a section view of the package of FIG. 31 taken along line 35-35 of FIG. 32.

To permit the package 1400 to be reclosed after being opened for the first time, the peripheral flange 1433 of the second pocket 1414 includes optional peg-like or pin-like projections 1478, and the peripheral flange 1431 of the first pocket 1412 includes optional openings 1479 sized to receive the projections 1478 in a friction fit as shown in FIGS. 34 and 35. A consumer desiring to reclose the package 1400 from the open position of FIG. 34 to the closed position of FIG. 35 would bring the pockets 1412, 1414 toward each other about the hinge 1416 such that the projections 1478 mate with their corresponding openings 1479 thereby reclosing the package 1400.

When the package 1400 is reclosed, the food product 90 is contained in the pockets 1412, 1414 and restricted from falling out of the package 1400. While the package 1400 has been shown as including projections and receiving openings 1479, the package 1400 may include adhesive areas similar to adhesive area in the form of one or more glue dots, pressure-sensitive adhesive, adhesive tape or strips, velcro, zipper, or the like that would permit multiple openings and reclosures of the package 1400.

A package 1500 according to another form is illustrated in FIGS. 36-40. For ease of reference, aspects of the package 1500 that are similar to aspects of the packages described above have been designated with similar reference numbers, prefaced with a "15." The package 1500 has a similar general construction to the packages described above in that it is formed from a single sheet of flexible film 1700, shown in more detail in FIG. 41, with some differences highlighted below.

Figure 40:
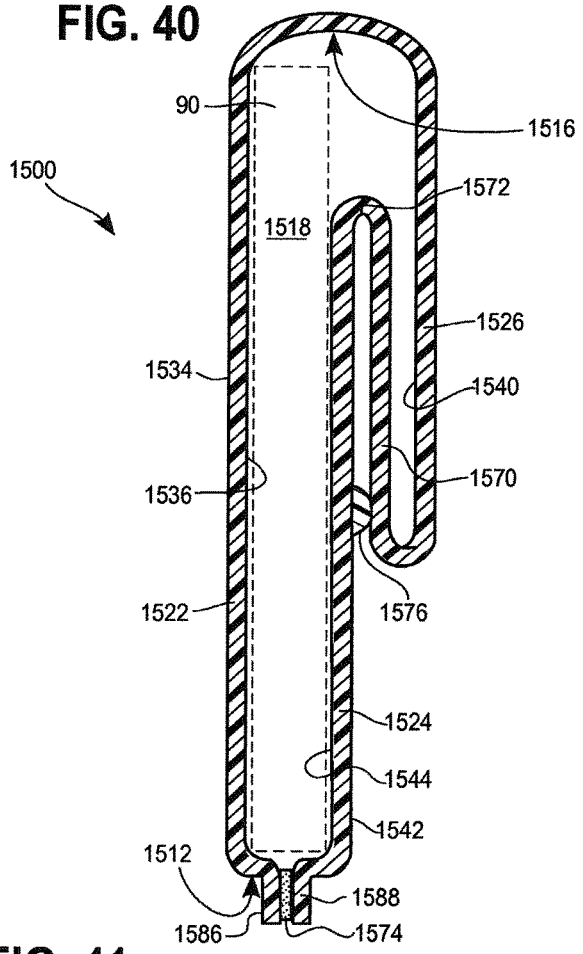
FIG. 40 illustrates a cross-section of the package of FIG. 36 taken along line 40-40 thereof.

The package 1500 of FIG. 40 includes one pouch 1512 similar to the package 1200 of FIG. 26 and includes a back panel 1522, a front panel 1524 and an exterior wall 1526, which acts substantially as a cover or an external flap. Unlike the pouch of the package 1200, and unlike the pouches 12, 14 of the package 10, which have a generally U-shaped bottom end formed by the folding of the film forming such pouches, the pouch 1512 of the package 1500 is formed by attachment of two opposing ends 1586 and 1588 of the film (e.g., film 400) that forms the package 1500. The opposing ends 1586 and 1588 are attached to each other via an adhesive 1574, for example, a heat seal, cold seal, hot melt, pressure sensitive adhesive, or the like to seal the package 1500. The adhesive 1574 is preferably selected to create a non-detachable attachment (in normal use) of the ends 1586 and 1588 to each other, as shown in FIG. 40.

The package 1500 of FIG. 40 is also unlike the package 1200 of FIG. 26 in that the closure flap 1570, which is detachably joined to the front panel 1524 along a line of weakness 1572, is not attached directly to the inner surface 1240 of the exterior wall 1526, but is joined to and forms a U-shaped fold or pleat together with the exterior wall 1526. In addition, while the closure flap 1270 of the package 1200 is detachably attached to the interior surface 1240 of the exterior wall 1226 by an adhesive 1274, the closure flap 1570 of the package 1500 is detachably and optionally reclosably attached to an outer surface 1542 of the front panel 1524 by an adhesive area 1576, which may be, for example, a cold seal or a pressure-sensitive adhesive.

Figure 38:
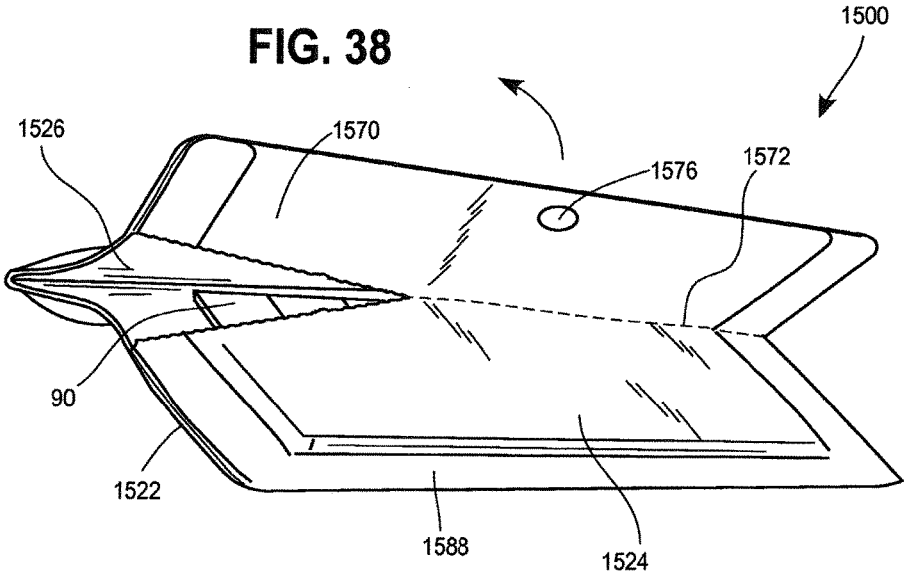
FIG. 38 illustrates a front perspective view of the package of FIG. 36 in a further partially open position with the closure flap being partially detached along the line of weakness.
Figure 39:
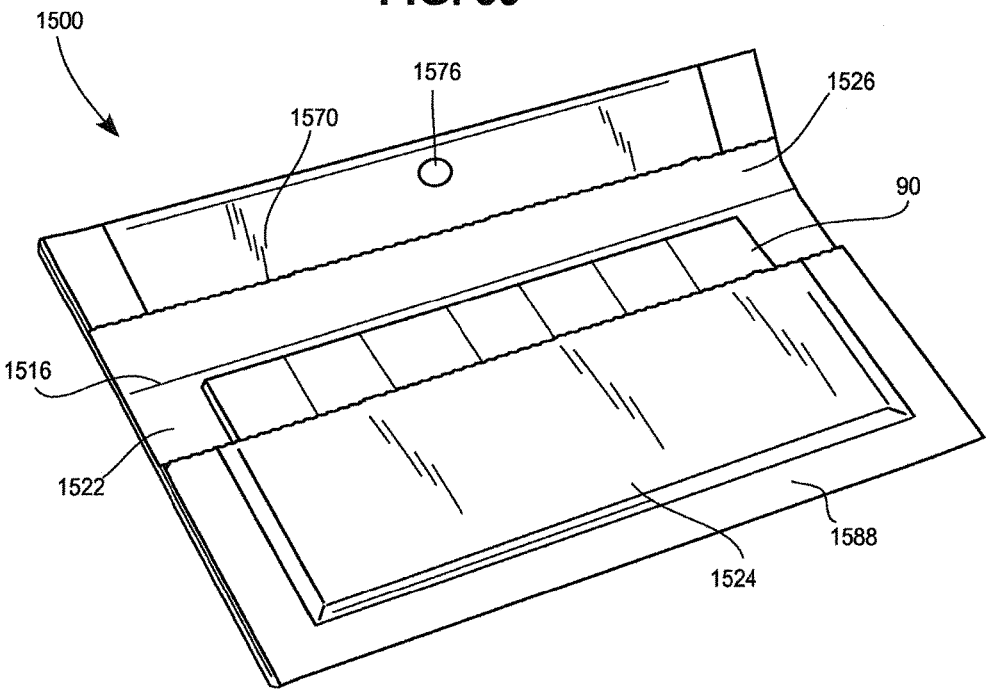
FIG. 39 illustrates a perspective view of the package of FIG. 36 in an open position with the closure flap being fully detached along the line of weakness.

During the opening of the package 1500 by a consumer, the exterior wall 1526 of the package 1500 is moved away from the front panel 1524 to a position where the opening force and tension being applied by the consumer initiates a tear in the line of weakness 1572 and causes the closure flap 1570 to separate by tearing from the front panel 1524 along the line of weakness 1572, as shown in FIG. 38, to permit the package 1500 to be moved into an open position shown in FIG. 39 where the closure flap 1570 no longer seals the package 1500, or blocks access to the opening 1518 of the pouch 1512 to permit the consumer to remove portions of the food product 90 through the opening 1518.

Figure 36:
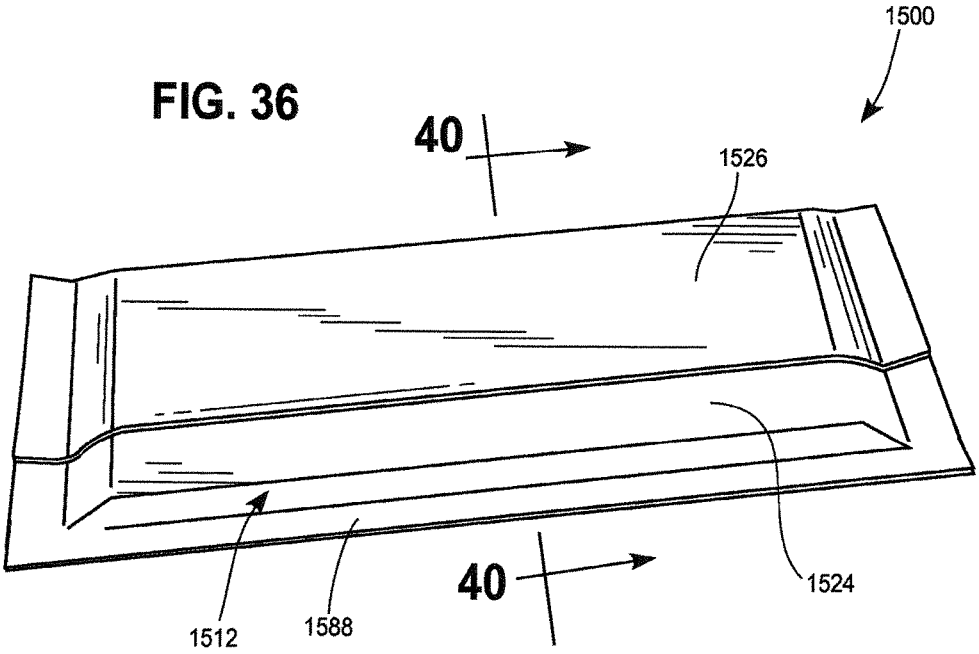
FIG. 36 illustrates a front perspective view of a twelfth exemplary package having one pouch and a pleated closure flap in a closed position.
Figure 37:
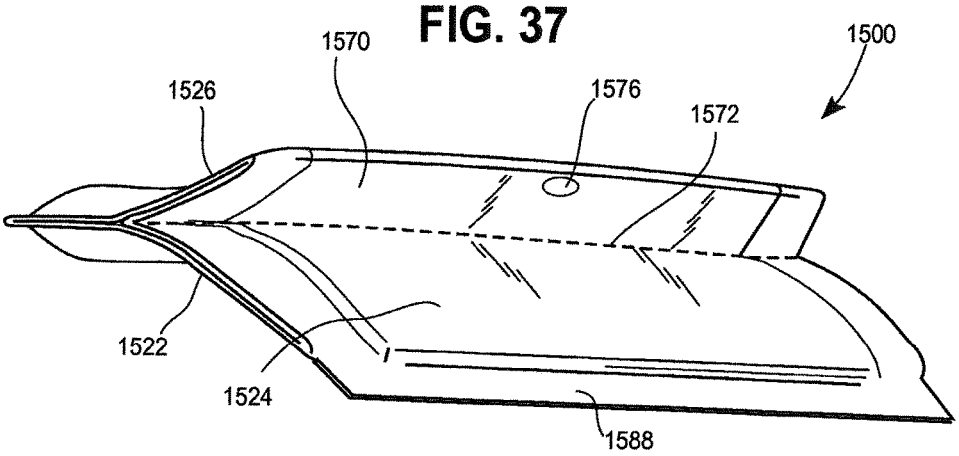
FIG. 37 illustrates a front perspective view of the package of FIG. 36 moved about the hinge to a partially open position with the closure fully attached to a front panel along a line of weakness.

A consumer desiring to reclose the package 1500 from the open position of FIG. 39 to the closed position of FIG. 36 can bring the exterior wall 1526 back toward the front panel 1524 about the hinge 1516 such that the adhesive area 1576 contacts and detachably attaches to the outer surface 1542 of the front panel 1524 to permit multiple reclosings and openings of the package 1500.

Figure 41:
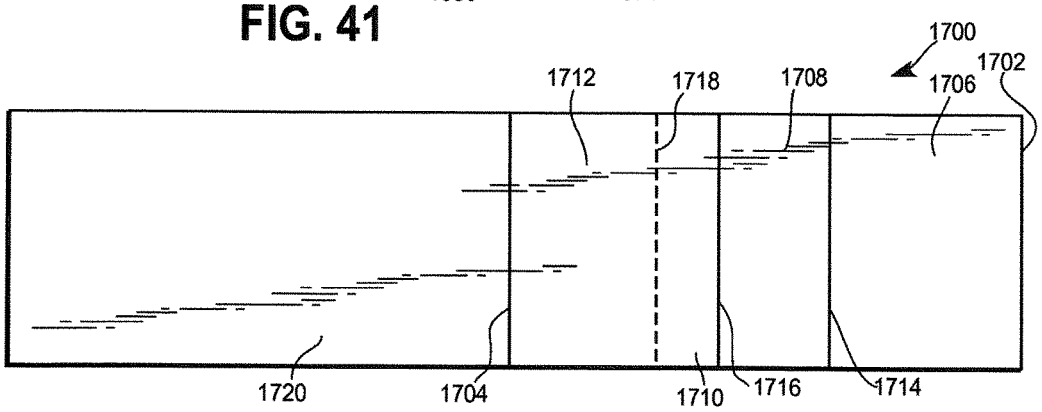
FIG. 41 illustrates a top plan view of an exemplary sheet of material, which can be part of a larger web of material, that can be used to form the package of FIG. 36.

An exemplary single sheet or segment of a web of flexible material 1700 from which the package 1500 may be made is shown in FIG. 41. The web has a width sized to make to pouches 1512 that are mirror images about a center line 1704 as the web moves in the machine direction indicated by the arrow in FIG. 41. The flexible material 400 may be a film made of one or more polymers, laminates, metalized polymers, paper, or the like. With reference to FIG. 41, area 1706 of the flexible film 1700 between a longitudinal edge 1702 of the film 1700 and a crease line 1714 corresponds to the back panel 1522 of the folded package 1500. Area 1708 of the flexible film 1700 between the crease line 1714 and a crease line 1716 corresponds to the external flap or external wall 1526 of the folded package 1500. Area 1710 of the flexible film 1700 between the crease line 1716 and a line of weakness 1718 (which corresponds to the line of weakness 1572) corresponds to the closure flap 1570 of the folded package 1500. Finally, area 1712 of the flexible film 1700 between a crease line 1704, which is also the centerline of the film 1700, and the line of weakness 1718 corresponds to the front panel 1524 of the folded package 1500. Area 1720 of the flexible film 1700 is a mirror image of the aforementioned areas, edges, and crease lines on the right side of the centerline 1704 and may be used to form a second package identical to the package 1500 as the film 1700 moves along the machine direction indicated by the arrow.

As the flexible film 1700 is moved in the machine direction, a food product 90 is deposited onto an upward-facing surface of the area 1706 of the flexible film 1700, and areas 1706, 1708, and 1710 of the film 1700 are folded about the crease lines 1714 and 1716 and about the line of weakness 1718 to envelop the food product 90 and to bring the edges 1702 and 1704 of the flexible film toward each other and non-detachably attaching the edges 1702 and 1704 to each other via the adhesive 1574 as shown in FIG. 40. In a folded package 1500, the closure flap 1570 is folded in a pleat-like configuration, as shown in FIG. 40. Although described as crease lines, the lines can instead represent eventual fold lines as opposed to pre-formed crease lines.

Figure 42:
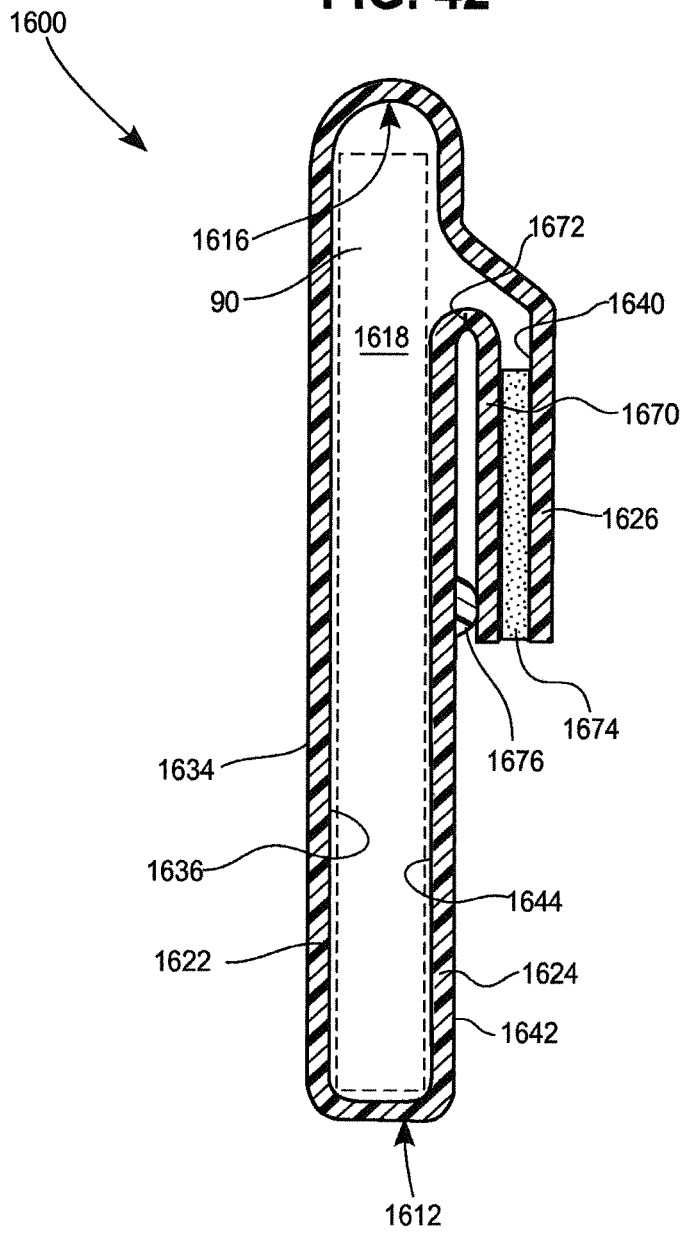
FIG. 42 illustrates a cross-section of a thirteenth exemplary package, similar to the package of FIGS. 36-41, but having a closure flap and an external flap that are attached differently than shown in FIG. 40.

A package 1600 according to another form is illustrated in FIG. 42. For ease of reference, aspects of the package 1600 that are similar to aspects of the packages described above have been designated with similar reference numbers, prefaced with a "16." The package 1600 has a similar general construction to the packages described above in that it is formed from a single sheet of flexible film, with some differences highlighted below.

The package 1600 of FIG. 42 is similar to the package 1500 of FIG. 40 in that it includes one pouch 1612, a back panel 1622, a front panel 1624 and an exterior wall 1626, which acts substantially as a cover or an external flap. Unlike the pouch 1512 of the package 1500, which is formed by attachment of two opposing ends 1586 and 1588 of the film that forms the package 1500, the pouch 1612 has a generally U-shaped bottom end formed by the folding of the film forming the package 1600.

The package 1600 of FIG. 42 is also unlike the package 1500 of FIG. 40 in that the closure flap 1670, which is detachably joined to the front panel 1624 along a line of weakness 1672 similar to the closure flap 1570 of the package 1500 of FIG. 40, is not joined together, and does not form a U-shaped fold, with the exterior wall 1626, but is attached directly to the outer surface 1642 of the front panel 1624 by an adhesive area 1676, which is similar to the adhesive area 1576 in both adhesive materials and providing for multiple reclosings and reopenings of the package 1600.

Figure 43:
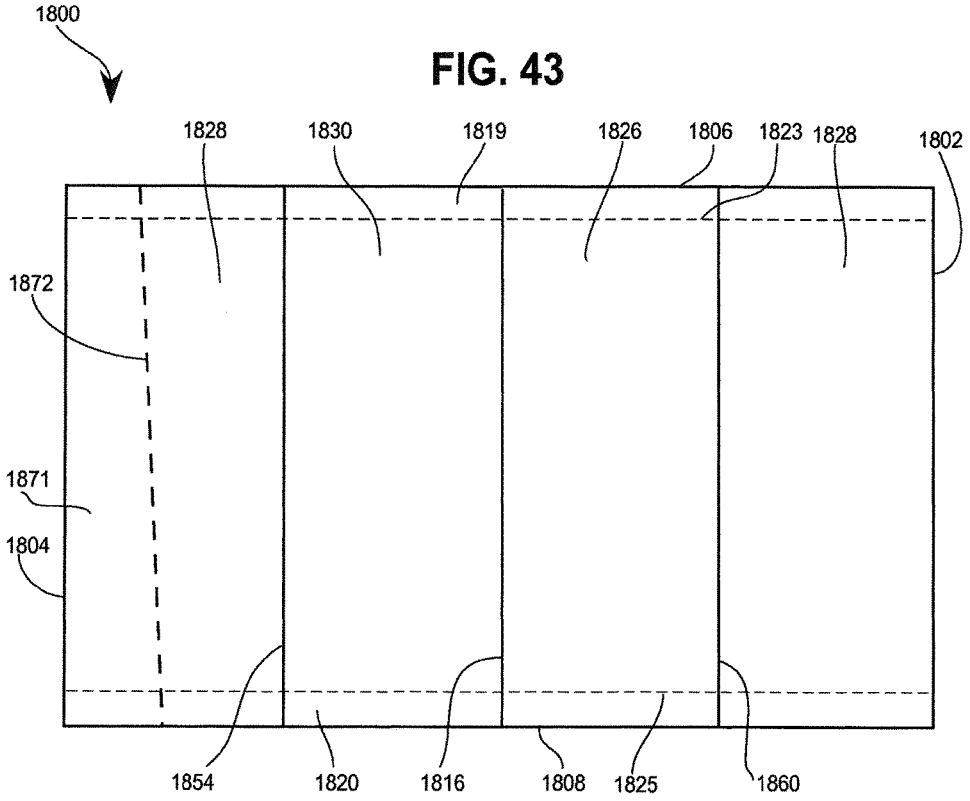
FIG. 43 illustrates a top plan view of an exemplary sheet of material, which can be part of a larger web of material that can be used to form a fifteenth exemplary package including a sloped line of weakness as shown in FIGS. 47 and 48.
Figure 44:
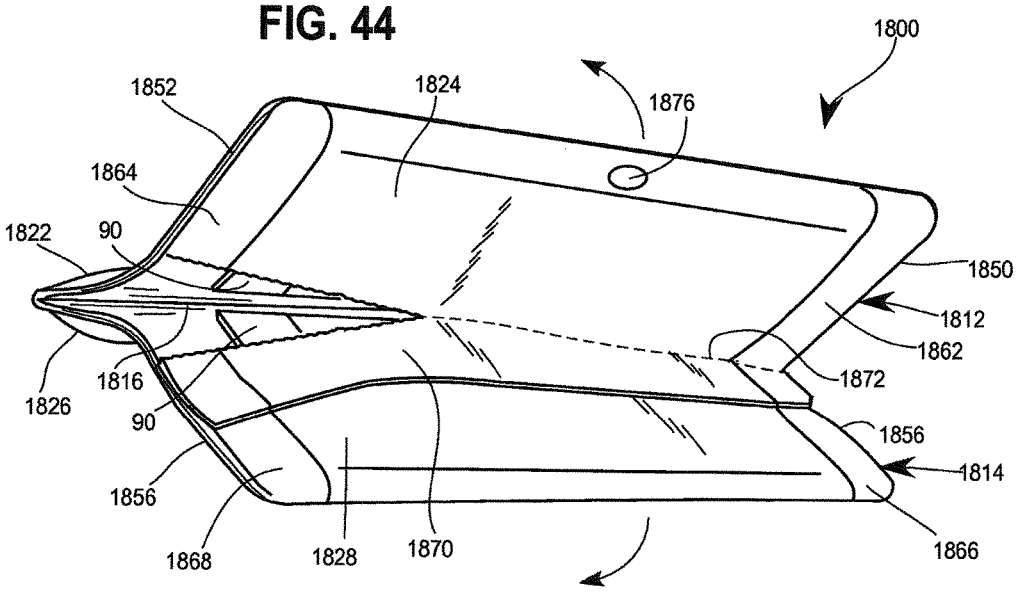
FIG. 44 illustrates a front perspective view of the fifteenth exemplary package in a partially open position with the closure flap being partially detached along the line of weakness.
Figure 45:
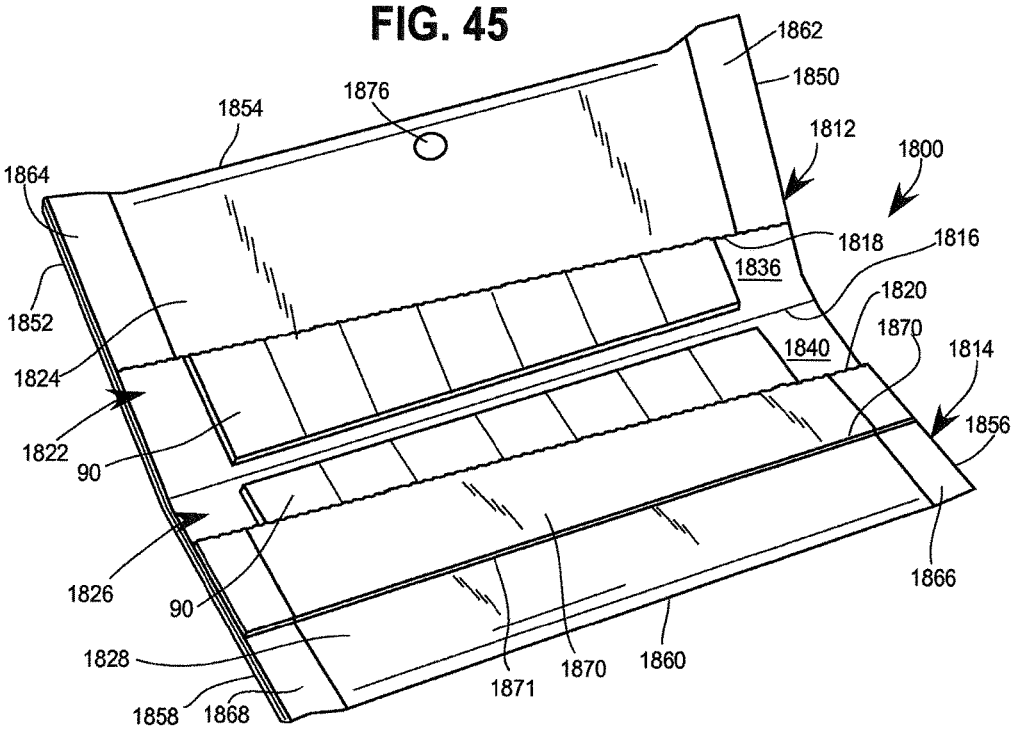
FIG. 45 illustrates a perspective view of the package of FIG. 44 in an open position with the closure flap being fully detached along the line of weakness.

A package 1800 according to another form is illustrated in FIGS. 43-45. The package 1800 is similar to the package 10 of FIGS. 1-9, with certain differences highlighted below. For ease of reference, aspects of the package 1800 that are similar to aspects of the package 10 have been designated with similar reference numbers, but prefaced with an "18."

The package 1800 is unlike the package 10 in that while the line of weakness 72 of the package 10 is straight and parallel to the side edges 54, 60 of the pouches 12, 14, the line of weakness 1872 of the package 1800 is not parallel to the side edges 1854, 1860 of the pouches 1812, 1814. Specifically, the line of weakness 1872 of the package 1800 is sloped relative to the side edges 1854 and 1860, as shown in FIG. 43.

With the package 1800 including the line of weakness 1872 oriented as shown in FIGS. 43-45, when the package 1800 is moved from a closed position in a direction shown by the directional arrows in FIG. 44 toward the open position of FIG. 45, the pouches 1812, 1814 move away from each other to a position where the opening force and tension being applied by the consumer initiates a tear in the line of weakness 1872 at the bottom edge 1852 of the pouch 1812 and causes the closure flap 70 to separate by tearing along the line of weakness 1872 from the interior panel 1824 of the pouch 1812, as shown in FIG. 44. Thus, unlike the package 10, where the tear through the line of weakness 72 is equally likely to start at either one or simultaneously both of the edges 50 and 52 of the package 10, the slanted orientation of the line of weakness 1872 provides for preferential opening of the package at a predetermined edge 1852 of the package 1800, thereby facilitating the opening of the package 1800 by the consumer by reducing the force required to open the package 1800 relative to the force required to open the package 10.

It is to be appreciated that the line of weakness 1872 may be oriented in a reverse orientation to that shown in FIG. 43 such that when the package 1800 is moved from a closed position toward the open position of FIG. 45, the opening force being applied by the consumer would preferentially initiate a tear in the line of weakness 1872 not at the bottom edge 1852 of the pouch 1812, but at the top edge 1850 of the pouch 1812. Further, while the package 1800 has been illustrated with only one pouch 1812 including the sloped line of weakness 1872, it is to be appreciated that the sloped line of weakness 1872 may alternatively be formed in the pouch 1814 instead of the pouch 1812, or in both pouches 1812 and 1814 to suitably facilitate the preferential opening of the package 1800 by the consumer and reducing the force required to open the package 1800. The line of weakness 1872 of this embodiment, with one end closer to a hinge or to a bottom of the package as compared to the other end, can be incorporated into any of the embodiments described herein having a line of weakness.

Figure 46:
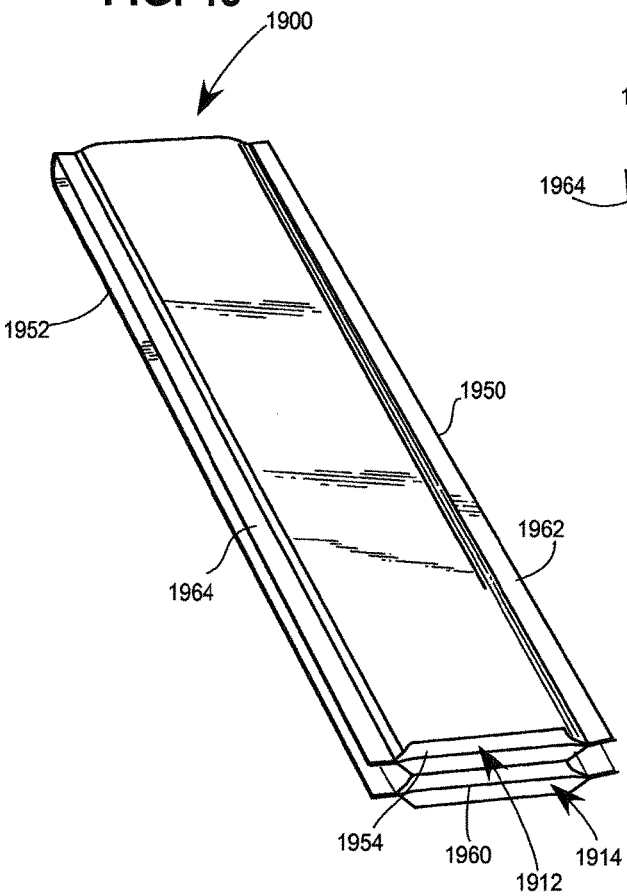
FIG. 46 illustrates a front perspective view of a sixteenth exemplary package having pouches being elongated and narrower relative to the pouches shown in FIG. 16 and being folded about a hinge in a closed position with an internal closure flap fully attached to one of the pouches along a line of weakness.
Figure 47:
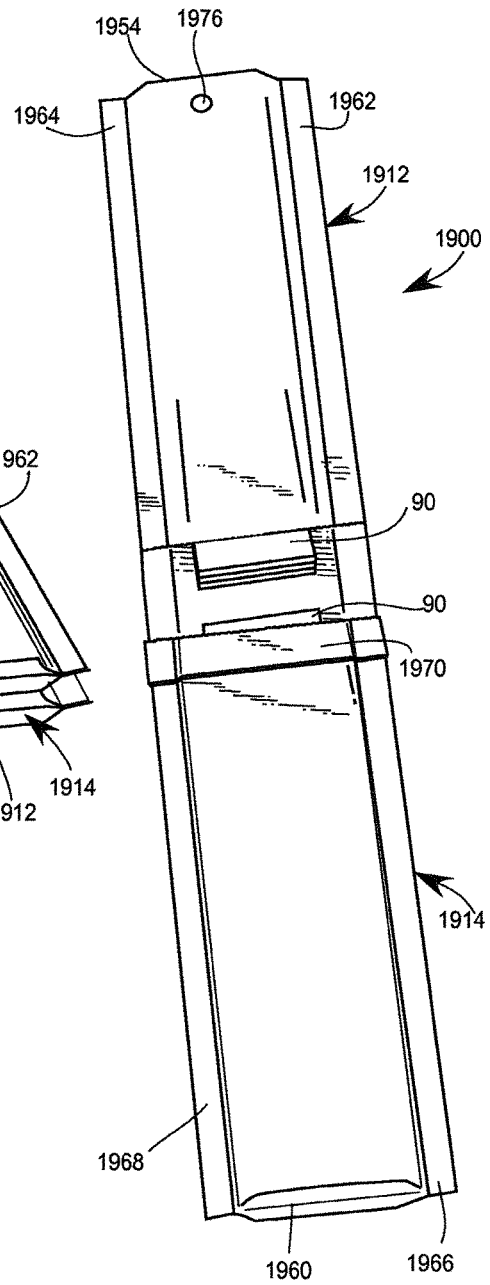
FIG. 47 illustrates a perspective view of the package of FIG. 46 in an open position with the closure flap being fully detached from one of the pouches along the line of weakness.

A package 1900 according to another form is illustrated in FIGS. 46-47. The package 1900 is similar to the package 400 of FIGS. 16-17, with certain differences highlighted below. For ease of reference, aspects of the package 1900 that are similar to aspects of the package 400 have been designated with similar reference numbers, but prefaced with a "19."

The package 1900 has a similar construction and features, but has a different shape than the package 400. Specifically, while the package 400 is generally square-shaped, the package 1900 is generally rectangular, with the long sides of the package 1900 being optionally longer than the sides of the package 400 and the short sides of the package 1900 being shorter than the sides of the package 400. In addition, the package 1900 is sized to have a different capacity for the food product 90 and is shaped to contain a grouping of food products 90 having a different overall shape than the grouping of food product 90 discussed with respect to other embodiments. Specifically, while the package 400 of FIGS. 16-17 includes two gum sticks positioned side-by-side in each of the pouches 412 and 414, the package 1900 of FIGS. 46-47 includes a stack of three gum sticks in each of the pouches 1912 and 1914.

The package 1900 is otherwise similar to the package 400 of FIGS. 16-17 and is opened similarly to the package 400 of FIGS. 16-17 in that the closure flap 1970 detaches from the pouch 1912 along a line of weakness and remains attached to the other pouch 1914, as shown in FIG. 47. The package 1900 is also provided with a reclosure feature in that the pouch 1912 includes an adhesive area 1976 similar to the adhesive area 476 of the package 400.

The package 1900 can be formed via a method that is substantially similar to the method shown in FIGS. 6-10. The package 1900 can be formed with different dimensions and/or features than those shown in FIGS. 46 and 47. For example, the package 1900 may optionally be sized such that each of the pouches 1912 and 1914 includes stacks of four, five, six, or more gum sticks, or to include more than one stack of gum sticks. In addition, the package 1900 may optionally have two closure flaps similar to the package 200 of FIGS. 11-14.

A package 2000 according to another form is illustrated in FIGS. 48-54. The package 2000 is similar to the package 200 of FIGS. 11-14, with certain differences highlighted below. For ease of reference, aspects of the package 2000 that are similar to aspects of the package 200 have been designated with similar reference numbers, but prefaced with a "20." The package 2000 has a similar general construction to some of the packages described above in that it is formed from a single sheet of flexible film.

Figure 50:
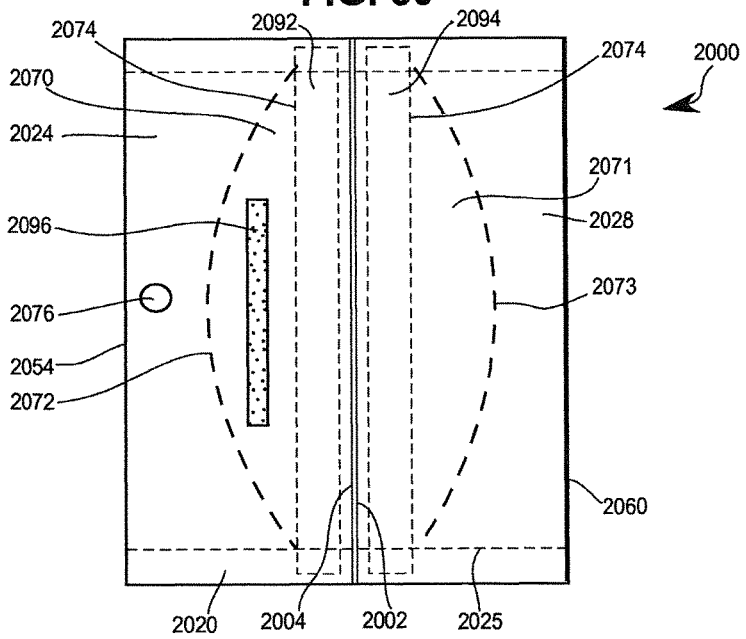
FIG. 50 is a top plan view of the web of material of FIG. 49 having a food product deposited thereon and with interior panels being folded into the sealing position covering the food product.
Figure 51:
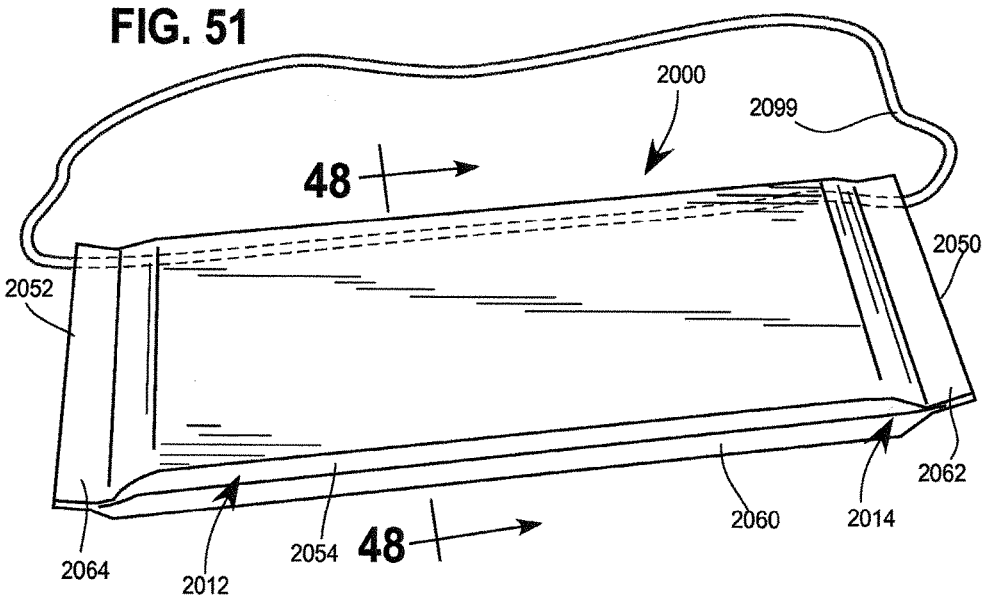
FIG. 51 illustrates a front perspective view of the package of FIG. 48 in a closed position and including an optional strap.
Figure 52:
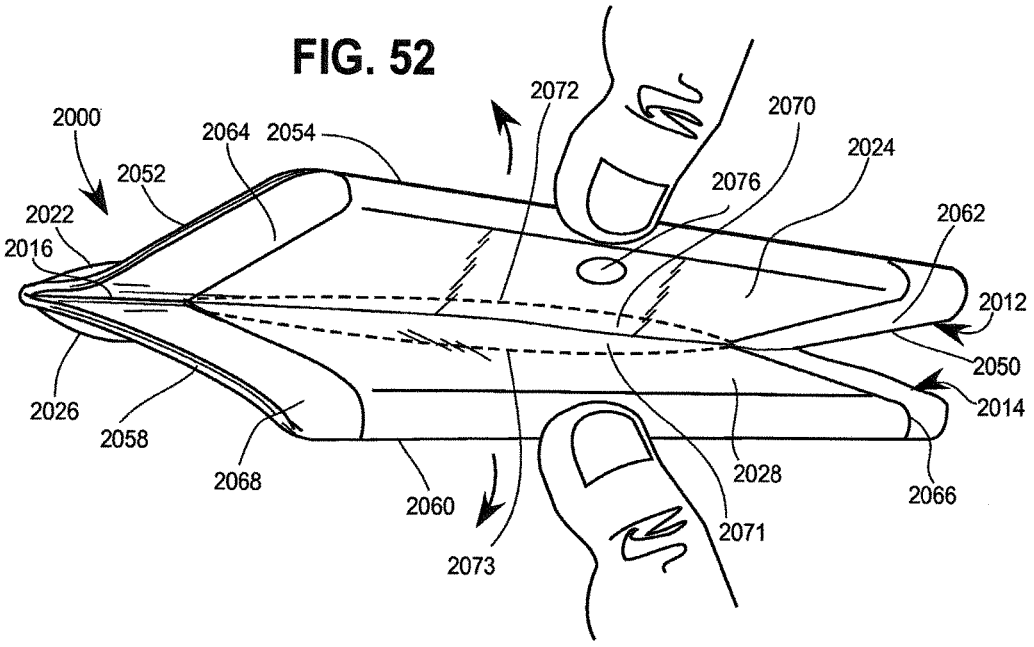
FIG. 52 illustrates a front perspective view of the package of FIG. 51 in a partially open position with the closure flaps still being fully attached along the lines of weakness.
Figure 53:
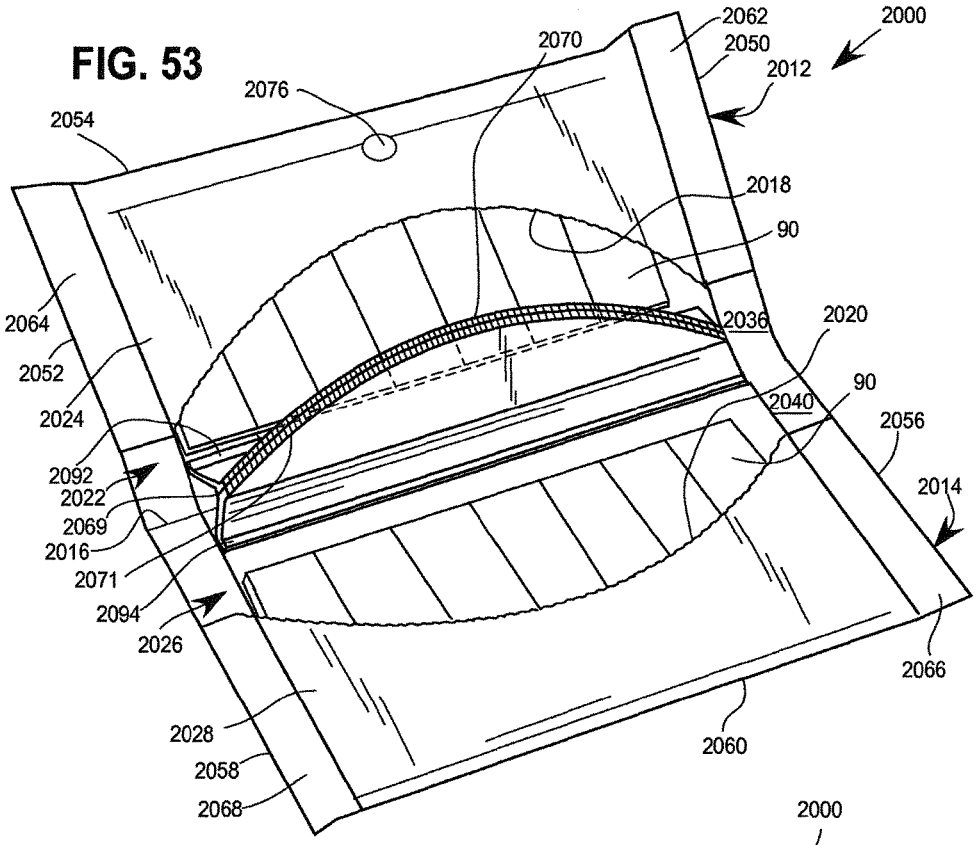
FIG. 53 illustrates a front perspective view of the package of FIG. 52 in an open position with both closure flaps being fully detached along the lines of weakness and being in part attached to each other and the food products in both pouches being fully accessible to a user.

The package 2000 is similar to the package 200 of FIGS. 11-14 in that it is formed from two pouches 2012 and 2014 having closed bottom ends 2054 and 2060. The pouches 2012 and 2014 of the package 2000 have end seals 2062, 2064, 2066, and 2068, as shown in FIGS. 51-53. Similarly to the package 200, the package 2000 includes two closure flaps 2070 and 2071. In particular, the first pouch 2012 includes a first closure flap 2070. The first closure flap 2070 of the first pouch 2012 is attached to an interior panel 2024 of the first pouch 2012 along a first line of weakness 2072. Similarly, the second pouch 2014 includes a second closure flap 2071, which is attached to an interior panel 2028 of the second pouch 2014 along a second line of weakness 2073, as shown in FIGS. 48 and 50.

Figure 48:
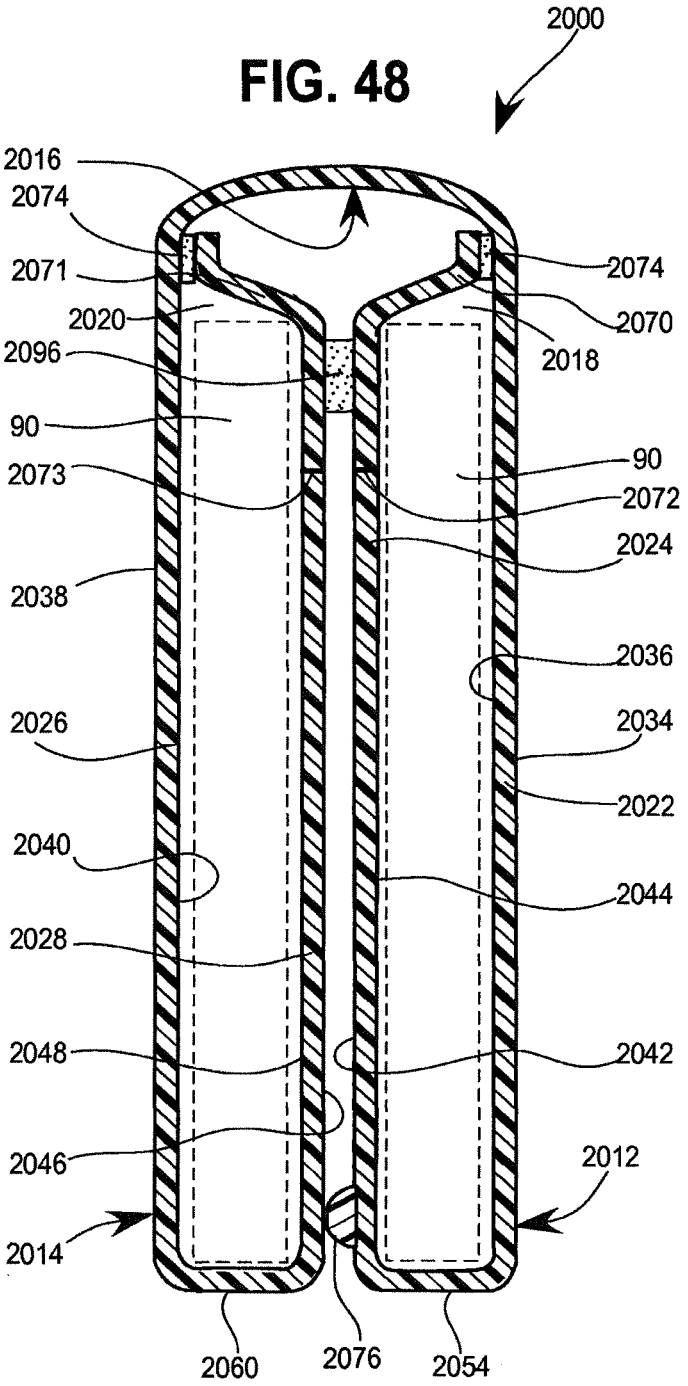
FIG. 48 illustrates a cross-section of a seventeenth exemplary package having two pouches folded about a hinge in a closed position taken along line 48-48 of FIG. 51.

When the package 2000 is in a closed position, the flaps 2070 and 2071 are oriented in a generally diverging orientation relative to each other such that the closure flap 2070 extends from the interior panel 2024 toward the outer wall 2022 of the pouch 2012 and is attached to the inner surface 2036 of the outer wall 2022 via an adhesive 2074, while the closure flap 2071 extends from the interior panel 2028 toward the outer wall 2026 of the other pouch 2014 and is attached to the inner surface 2040 of the outer wall 2026 via an adhesive 2074, as shown in FIG. 48. With the closure flaps 2070, 2071 being attached to their respective inner surfaces 2036, 2040 of the outer walls 2022, 2026 when the package 2000 is in the closed position, access to the openings 2018, 2020 of the first and second pouches 2012, 2014 is blocked by the closure flaps 2070, 2071, as can be seen in FIG. 48.

Similar to the package 200, the closure flaps 2070 and 2071 of the package 2000 are attached to each other via an adhesive material 2096, which may be identical to or different from the adhesive material 2074, and is selected to create a non-detachable attachment of the closure flaps 2070 and 2071 to each other. It will be appreciated that while the adhesive material 2096 has been illustrated in a form of a single elongated strip, the adhesive material 2096 may be in the form of two or more strips or areas of any suitable shape (e.g., square-shaped, circular, triangular, etc.).

With the closure flaps 2070 and 2071 being attached to each other when the package 2000 is in the closed position, access to the openings 2018, 2020 of the pouches 2012, 2014 is blocked by the closure flaps 2070, 2071. It will be appreciated that the adhesive materials 2074 and 2096 may be hot melt glue, or any other adhesive, and that the closure flaps 2070 and 2071 may be attached to their respective inner surfaces 2036 and 2040 of the outer walls 2022 and 2026 and to each other via other suitable means, for example, heat sealing, welding, UV-curing, lamination, or the like.

Figure 54:
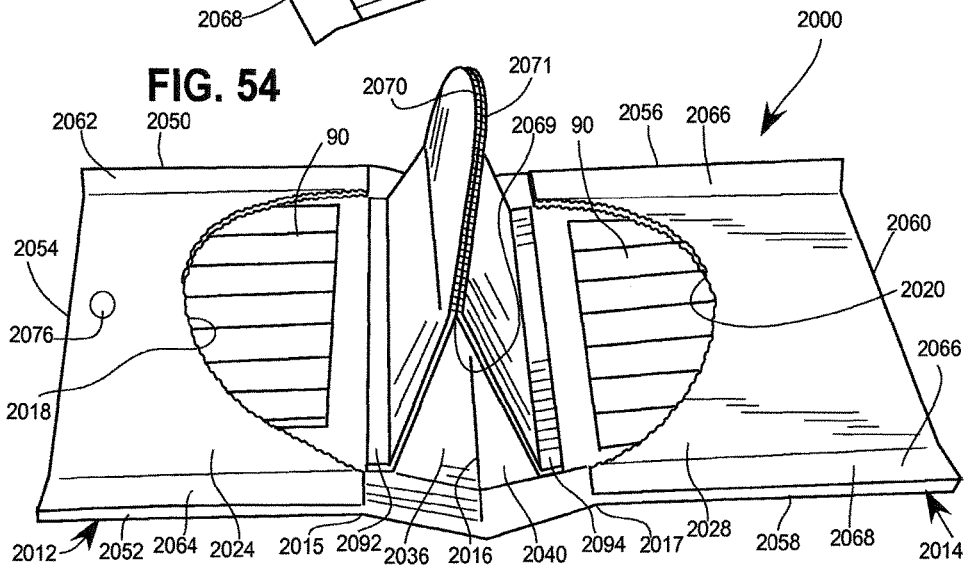
FIG. 54 illustrates a side perspective view of the package of FIG. 53 in an open position with the closure flaps being fully detached along the lines of weakness and being in part attached to each other.

To open the package 2000, the package 2000 may be grasped by a user (exemplary position of thumbs shown in FIG. 52) and manipulated to move the pouches 2012, 2014 from the closed position of FIG. 51 in a direction shown by the arrows in FIG. 52 toward the open position of FIGS. 53-54. When moved from the closed position toward the open position, the pouches 2012, 2014 move about an outer hinge 2016 away from each other to open the package 2000 in a book-like manner, which may be visually appealing to consumers.

In FIG. 52, the package 2000 is shown in a position that is not open enough (or where not enough opening force has been applied) to cause the closure flaps 2070, 2071 to separate from their respective pouches 2012, 2014 along their respective lines of weakness 2072, 2073. During the opening of the package 2000 by the user in the direction shown in FIG. 52, as the pouches 2012, 2014 of the package 2000 move away from each other, a position is reached where the opening force or tension applied by the consumer initiates one or more tears in one or both of the lines of weakness 2072, 2073. This can be achieved by having an increasing tension in the closure flaps 2070, 2071 as the package 2000 is opened, controlled in part by the length of portions of the closure flaps 2070, 2071, in combination with the flaps 2070, 2071 being joined together, being less than the length required to have a fully opened package without separation of the closure flaps 2070, 2071 from their respective pouches 2012, 2014.

Figure 59:
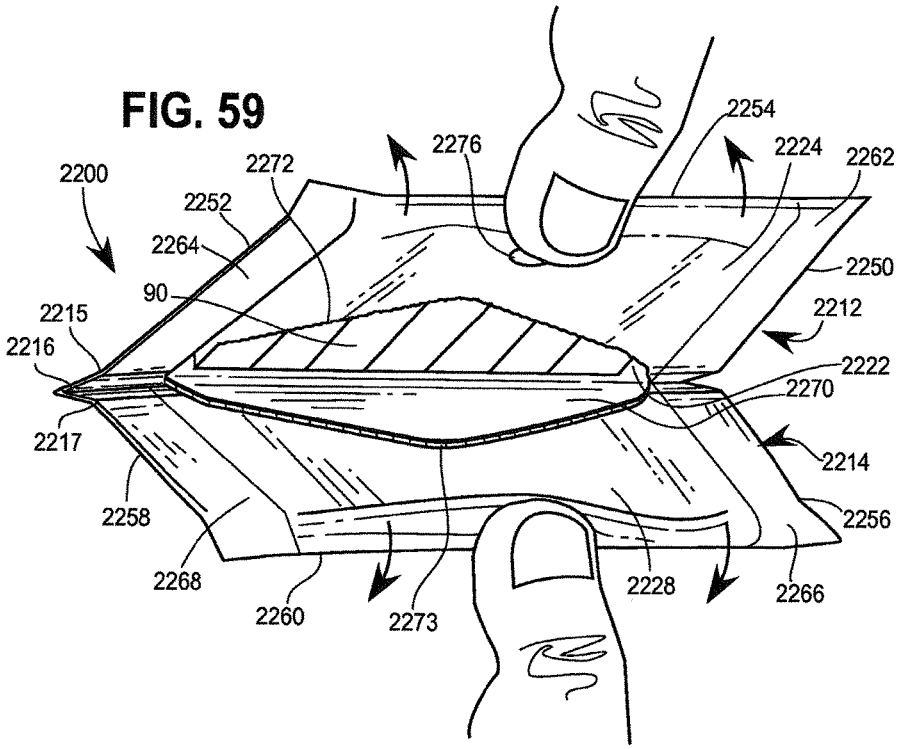
FIG. 59 illustrates a front perspective view of a nineteenth exemplary package, similar to the package of FIG. 51, in a partially open position with one of the closure flaps being fully detached along its respective line of weakness and the product in the pouch being opened not yet being fully accessible.
Figure 60:
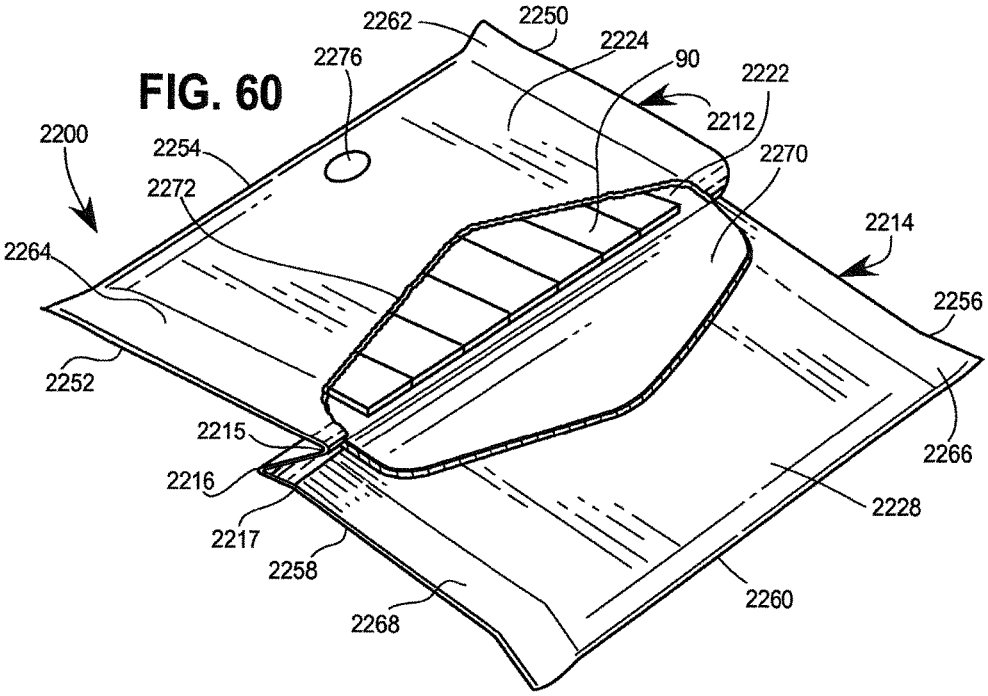
FIG. 60 illustrates a perspective view of the package of FIG. 59 in a partially open position, and opened further than the package of FIG. 59, with one of the closure flaps being fully detached along its respective line of weakness and the product in the pouch being opened being fully accessible.
Figure 61:
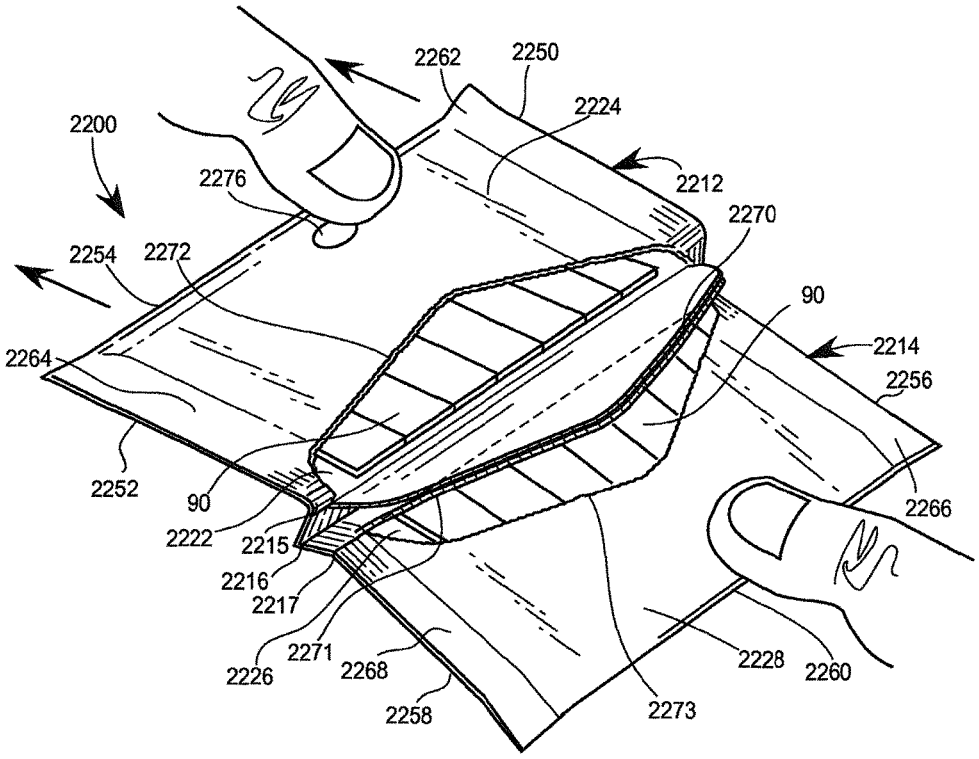
FIG. 61 illustrates the same view as in FIG. 60 with one of the pouches of the package being pulled away from the other pouch and the package being shown in a partially open position where both of the closure flaps are fully detached along their respective lines of weakness and the product in one of the pouches being fully accessible while the product in the other one of the pouches not yet being fully accessible.

FIGS. 59-61 show a package 2200 according to another embodiment. The package 2200 is different from the package 2000 of FIGS. 48-54 in at two ways: the lines of weakness 2272, 2273 of the package 2200 are shaped differently than the lines of weakness 2072, 2072 of the package 2000; and the closure flaps 2270, 2271 of the package 2200 are shaped differently than the closure flaps 2070, 2071 of the package 2000. In particular, while the lines of weakness 2072, 2073 of the package 2000 are arcuate as shown in FIGS. 49-50 and 53-54, the lines of weakness 2272, 2273 of the package 2200 are partially straight and partially curved and generally form a V-shape, as shown in FIGS. 59-61. Similarly, while the closure flaps 2070, 2071 of the package 2000 have arcuate contours to match the shape of the lines of weakness 2072, 2073, as shown in FIGS. 49-50 and 53-54, the closure flaps 2270, 2271 of the package 2200 include partially straight and partially curved contours and generally form a V-shape, as shown in FIGS. 59-61.

It is to be appreciated that the lines of weakness 2272, 2273 may be entirely linear and lack any curved portions. Similarly, the contours of the closure flaps 2270, 2271 may be correspondingly entirely linear and lack any curved portions. While some of the packages (e.g., 10, 200, 400, and 500) described herein have closure flaps that are rectangular and one of the closure packages (1800) has a trapezoidal closure flap, it is to be appreciated that the closure flaps and the lines of weakness associated with the closure flaps can be of any desired geometric or irregular shape. By way of example, FIG. 50 a generally elliptical or oblong closure flap 2070 and its associated curved line of weakness 2072. In another example, FIG. 60 shows an irregularly-shaped closure flap 2270 generally shaped like a postal envelope flap and its associated irregularly-shaped line of weakness 2272.

While the package 2200 of FIGS. 59-61 includes differently shaped closure flaps and lines of weakness than the package 2000, the opening sequence of the package 2200 being illustrated in FIGS. 59-61 is equally applicable to the package 2000, as described below. In particular, if the package 2200 were positioned the same way as the package 2000 is positioned in FIG. 52, the package 2200 would similarly not be open enough (or subject to sufficient tension) to cause the closure flaps 2270, 2271 to separate from their respective pouches 2212, 2214 along their respective lines of weakness 2272, 2273. During the opening of the package 2200 by the user in the direction shown in FIGS. 52 and 59, as the pouches 2212, 2214 of the package 2200 move away from each other, a position is reached where the opening force applied by the consumer initiates one or more tears in one or both of the lines of weakness 2272, 2273. As described above, this may be a result of a predetermined increase in tension at the lines of weakness 2272, 2273 in response to an opening force being applied by a consumer.

The force being applied by the consumer in the direction (shown by the arrows in FIG. 59) toward the open position causes one or more of the tears in the lines of weakness 2272, 2273 to propagate across the package 2200 such that the closure flaps 2270, 2271 fully detach from their respective interior panels 2224, 2228 to fully open the pouches 2212, 2214 to provide the consumer with full access to the food product 90 (or a non-food product) in the pouches 2212, 2214.

The exemplary package 2200 of FIG. 60 is shown with the closure flap 2270 fully separating from the interior panel 2224 of the first pouch 2212 along the line of weakness 2272 while the closure flap 2271 is still fully attached to the interior panel 2228 of the second pouch 2214 along the line of weakness 2273. In one form, as the user manipulates the package 2200 by moving the pouches 2212, 2214 in the direction indicated by the arrows in FIG. 59 toward the partially open position of FIG. 61, the closure flap 2270 may fully separate simultaneously along the entire line of weakness 2272 from the interior panel 2224. In another form, as the user moves the pouches 2212, 2214 of the package 2200 toward the open position, one or more small tears may form in one or more portions of the line of weakness 2272 and sequentially propagate along the entire line of weakness 2272 until the closure flap 2270 fully separates from the interior panel 2224.

When the package 2200 is in a position shown in FIG. 59, the end seal 2264 of the first pouch 2212, the hinge region 2216 and the end seal 2268 of the second pouch 2214 combine to generally form a V-shape. During the opening of the package 2000, an opening force applied by the consumer may cause a portion of the first pouch 2212 to fold or bend about a second hinge 2215 and a portion of the second pouch 2214 to fold or bend about a third hinge 2217, as shown in FIG. 59. With the closure flap 2270 being fully separated along the entire line of weakness 2272 from the interior panel 2224 of the first pouch 2212 such that the food product 90 in the first pouch 2212 is fully accessible to the consumer, as shown in FIG. 60, the end seal 2264 of the first pouch 2212, the hinge region 2216, and the end seal 2268 of the second pouch 2214 combine to generally form a zig-zag (Z) shape.

More specifically, as illustrated in FIG. 60, a part of this zig-zag shape is provided by the outer or first hinge 2216, another part of this zig-zag shape is provided by portions of the first pouch 2212 that are folded to form a second hinge 2215 that extends at least across the end seals 2262, 2264 of the first pouch 2212, and another part of this zig-zag shape is provided by portions of the second pouch 2214 that are folded to form a third hinge 2217 that extends at least across the end seals 2266, 2268 of the second pouch 2214. The configuration of the pouches 2212, 2214 during the opening of the package 2200 is such that the first pouch 2212 includes the second hinge 2215, the second pouch 2214 includes the third hinge 2217, and the package 2200 includes the first hinge 2216 between the pouches 2212, 2214 when the package 2200 is in a more fully open position as shown in FIG. 61 and when the package 2200 is in a fully open position, as shown in FIG. 59, in reference to the hinges 2015, 2016, 2017 of the package 2000.

As can be seen in FIG. 60, the package 2200 is positioned such that the interior panel 2224 of the first pouch 2212 is not in the same plane as the interior panel 2228 of the second pouch 2212, but positioned at least in part above the interior panel 2228 of the second pouch 2212. More specifically, the second hinge 2215 formed by a portion of the end seal 2264 of the first pouch 2212 overlies a portion of the end seal 2268 of the second pouch 2212, creating a gap between the second hinge 2215 and that portion of the end seal 2268, as shown by the shading lines in FIG. 60. With the package 2200 being in the partially open position of FIG. 60, the outer panel 2222 of the first pouch 2212 is positioned such that the second hinge 2215 is closer to a bottom end 2260 of the second pouch 2214 than the outer hinge 2216.

The positioning of the first pouch 2212 relative to the second pouch 2214, i.e., the partial elevation of the first pouch 2212 relative to the second pouch 2214 while the first pouch 2212 is open and the food product 90 in the first pouch 2212 is accessible, may facilitate retention of the food product 90 in the first pouch 2212 and restrict the food product 90 from inadvertently sliding out from the first pouch 2212, particularly when both pouches 2212, 2214 have been opened, such as when the closure flaps are generally perpendicular or otherwise angled with respect to the pouches 2212, 2214. The packages 2000 and 2200 may include an additional structural feature that restricts the food product 90 from inadvertently sliding out from the pouches, as described below.

In particular, as discussed above, the closure flaps 2070, 2071 of the package 2000, as well as the closure flaps 2270, 2271 of the package 2200 are attached to each other via an adhesive material selected to create a non-detachable attachment of the closure flaps to each other. The attachment of the closure flaps 2070, 2071 of the package 2000 to each other, as well as the attachment of the closure flaps 2270, 2271 of the package 2200 to each other is maintained during the movement of the package 2000 and 2200 from the closed position to a partially open position (e.g., FIG. 60) or to a fully open position (e.g., FIG. 54). The attached portions of the closure flaps 2270, 2271 are oriented similarly to the attached portions of the closure flaps 2070, 2071, which are spaced away from the hinge 2016 of the package 2000, forming an open area between unattached portions of the closure flaps 2070, 2071 and the hinge 2016 of the package 2000, as seen, for example, in FIG. 54. As discussed below, this open area may be generally diamond-shaped as discussed in the next paragraph, and may provide for passage of a strap as shown, for example, in FIG. 51 and discussed below.

With further reference to FIG. 54, a foot portion 2092 of the first closure flap 2070 is non-detachably attached to an inner surface 2036 of the outer wall 2022 of the first pouch 2012, while a foot portion 2094 of the second closure flap 2071 is non-detachably attached to an inner surface 2040 of the outer wall 2026 of the second pouch 2014. Portions of the first and second closure flaps 2070, 2071 extending away from their respective foot portions 2092, 2094 are not attached to each other, and converge toward each other, until they intersect at an apex 2069 of a generally diamond-shaped opening, defined by the aforementioned unattached portions of the first and second closure flaps 2070, 2071, a portion of the outer wall 2022 of the first pouch 2012 between a first hinge 2016 and a second hinge 2015, and a portion of the outer wall 2026 of the second pouch 2014 between the first hinge 2016 and the third hinge 2017. Portions of the first and second closure flaps 2070, 2071 above the apex 2069 are non-detachably attached to one another as shown in FIG. 54 and described previously. It is to be appreciated that the apex 2069 provides a fourth hinge relative to which portions of the first and second closure flaps 2070, 2071 (and first and second pouches 2012, 2014) move during the movement of the package 2000 from a closed position toward an open position. The attached portions of the first and second closure flaps 2070, 2071 may also pivot relative to the hinge 2069, during the opening of the package 2000. Notably, portions of the pouches 2212, 2214 of the package 2200, when moved from a closed position toward an open position, may form a similar generally diamond-shaped opening defined by portions of the pouches 2212, 2214 between the first hinge 2216, second hinge 2215, third hinge 2217, and fourth hinge 2269, as in FIG. 61.

The closure flaps 2070, 2071, by virtue of being attached to each other, provide a stiffer support surface than adjacent portions of the pouches 2212, 2214. As such, with the package 2200 being positioned such that a portion of the closure flap 2270 (supported by the attached closure flap 2271) obstructs a portion of an access opening 2018 of the first pouch 2212, as shown in FIG. 61, the gum sticks 90 (or other food or non-food product) are advantageously restricted from being inadvertently dislodged from the first pouch 2212. For example, during the movement of the first and second pouches 2212, 2214 of the package 2200 up to 180 degrees away from each other about the hinge 2216 from a closed position, where the pouches 2212, 2214 are closed by their respective closure flaps 2270, 2271 (e.g., position shown in FIG. 51), toward an open position where one or more of the closure flaps 2270, 2271 is detached along a line of weakness 2272, 2273 to provide access to the food product 90 in one or both of the pouches 2212, 2214, the closure flaps 2270, 2271 may form a barrier that moves relative to the hinge 2216 and restricts the product 90 from being dislodged from the pouches 2212, 2214.

FIGS. 59 and 60 show that the closure flap 2270 fully separates from the interior panel 2224 along the line of weakness 2272 while the closure flap 2271 remains fully attached to the interior panel 2228 along the line of weakness 2273. Depending on the orientation of the package 2200 and the opening force or tension applied by the user, the package 2200 may be positioned and manipulated by the user toward the open position such that the closure flap 2270 remains fully attached to the interior panel 2224 along the line of weakness 2272 while the closure flap 2271 is fully detached from the interior panel 2228 along the line of weakness 2273. As such, moving the package 2200 from the fully closed position shown in FIG. 52 with reference to package 2000 to the partially open position shown in FIG. 59 includes separating an inner closure flap 2270 of the first pouch 2212 from the inner panel 2224 of the first pouch 2212 along the line of weakness 2272 of the first pouch 2212 without separating an inner closure flap 2071 of the second pouch 2214 attached to the inner panel 2228 of the second pouch 2214 along the line of weakness 2273 of the second pouch 2214. This causes the first pouch 2212 to open to provide access to the product 90 in the first pouch 2212 while the second pouch 2214 remains sealed to restrict access to the product 90 in the second pouch 2214.

Alternatively, the package 2200 may be positioned and moved by the user toward the open position such that instead of only one of the closure flaps 2270, 2271 fully detaching first from its respective interior panel 2224, 2228, the opening force applied by the user may cause such tension at the lines of weakness 2272, 2273 that both of the closure flaps 2270, 2271 substantially simultaneously separate from their respective interior panels 2224, 2228 along their respective lines of weaknesses 2272, 2273. "Substantially simultaneously" will be understood to mean that during the movement of the first and second pouches 2212, 2214 from the closed position (FIG. 51) to the fully open position (FIG. 54), both of the closure flaps will separate from their respective interior panels 2224, 2228 along their respective lines of weaknesses 2272, 2273 and open their respective pouches 2212, 2214 to provide the consumer with access to the product 90 in the pouches 2212, 2214.

While the closure flaps 2270, 2271 may separate from their respective interior panels 2124, 2128 sequentially or generally simultaneously based on the positioning of the package 2200 and the relative opening force applied by each hand of the user, the package 2200 can be configured such that one of the lines of weakness 2272 or 2273 will tear prior to the other one of the lines of weakness 2272, 2273 to provide access to a predetermined one of the pouches 2212, 2214 first. For example, the V-shape formed by one of the lines of weakness 2273 may extend downward closer to one of the bottom ends 2054, 2060 of the pouches 2012, 2214, respectively, to facilitate the preferential primary opening of the selected V-shape that is positioned closer to a bottom end of a pouch selected for opening first. Alternatively, one of the lines of weakness 2272, 2273 may be weaker such that it preferentially opens first before the other one of the lines of weakness 2272, 2273. In another alternative, one of the lines of weakness 2272, 2273 may include a tear notch such that upon manipulation of the package 2200 toward the open position, the line of weakness including the notch would preferentially perforate first.

After the consumer manipulates the package 2200 such that one or more tears propagates through one of the lines of weakness 2272 or 2273 to provide access to one of the pouches 2212 or 2214, further manipulation of the package 2200 may then tear through the other of the lines of weakness 2272 or 2273 in order to provide access the other one of the pouches 2212 or 2214. Advantageously, as shown, for example, in FIG. 60, this can allow for one of the pouches to be accessed, while the other pouch remains closed or sealed, such as until the contents of the one of the pouches are removed.

With the package being in the partially open position shown in FIG. 60, a consumer desiring to open and access the interior of the second pouch 2214 may grasp the first pouch 2212 and move the first pouch 2212 toward the fully open position shown in FIGS. 53-54 in a direction shown by the arrow in FIG. 61. In particular, the movement shown by the arrow in FIG. 61 includes moving a bottom end 2254 of the first pouch 2212 in a direction away from the outer hinge 2216 and moving the second hinge 2215 in a direction away from a bottom end 2260 of the second pouch 2214. The movement of the first pouch 2212 away from the second pouch 2214 in the direction shown in FIG. 61 includes moving the second hinge 2215 in a direction away from the bottom end 2260 of the second pouch 2214 to a position where the second hinge 2215 is further away from the bottom end 2260 of the second pouch 2214 than the outer hinge 2216, as shown in FIG. 61. In other words, a distance from the second hinge 2215 to the bottom end 2260 of the second pouch 2214 in FIG. 61 is greater than the distance from the outer hinge 2216 to the bottom end 2260 of the second pouch 2214. 52. Similarly, the moving the first pouch 2212 includes moving the bottom end 2254 of the first pouch in a direction away from the bottom end 2260 of the second pouch 2214 to increase a length of the package 2200. It will be understood that the "length of the package" will be understood to mean a distance between the bottom end 2254 of the first pouch 2212 and the bottom end 2260 of the second pouch 2214 along a line perpendicular to the outer hinge 2216 and to the bottom ends 2054, 2260.

The movement of the first pouch 2212 away from the second pouch 2214 as shown in FIG. 61 facilitates the detachment of the closure flap 2271 away from the interior panel 2228 via one or more tears at the line of weakness 2273 to open the second pouch 2214, thereby exposing the food product 90 stored within the second pouch 2214 to the consumer for access, as shown in FIG. 61. It will be appreciated that the detachment of the closure flap 2271 away from the interior panel 2228 via one or more tears at the line of weakness 2273 to open the second pouch 2214 may occur before or after the position of the package 2200 shown in FIG. 61, depending on, for example, opening force used and orientation of the package 2200 during the opening. The first pouch 2212 may be moved by the consumer in the direction of the arrow of FIG. 61 until the package 2200 reaches its fully open position, as shown in FIGS. 53-54 and described with reference to the package 2000.

The location of the closure flaps 2070, 2071 of the package 2000 in their fully open positions as shown in FIGS. 53-54 facilitates a consumer in removing portions of the food product 90 through the openings 2018, 2020 of the pouches 2012, 2014. In particular, unlike the package 200 where the line of weakness 2072 is linear, the lines of weakness 2072 and 2073 are curved further toward their respective bottom ends 2054 and 2060 of the package 2000, with the package 2000 being open as shown in FIG. 53, causing more of the food product 90 to be exposed than is exposed by the package 200 (see FIG. 13) to the consumer to facilitate possibly easier removal of the food product 90 from each of the pouches 2012 and 2014.

With the closure flaps 2070 and 2071 being in their fully open position as shown in FIGS. 53-54, a consumer is permitted to remove portions of the food product 90 from the pouches 2012 and 2014 through the openings 2018 and 2020. Similar to the closure flaps 270 and 271 of the package 200, the closure flaps 2070 and 2071 of the package 2000 provide a freshness seal and/or tamper-evident feature for the package 2000 such that the absence of, or the partial detachment of one or both of the closure flaps 2070, 2071 would visually indicate to a consumer that the package 2000 has been previously opened or tampered with.

With the closure flaps 2070, 2071 being in their fully open positions as shown in FIG. 54, the unattached portions of the closure flaps 2070, 2071 are advantageously positioned such that they provide a structural feature that restricts the food product 90 from inadvertently sliding out from their respective pouches 2012, 2014.

The packages 2000 and 2200 can be formed via a method that is substantially similar to the method shown in FIGS. 6-10 with some of the differences being the formation of a second closure flap 2071 and second line of weakness 2073, location and shape of the lines of weakness 2072 and 2073, the location where the adhesives 2074 and 2096 are applied, and the fact that no portion of the closure flaps 2070 and 2071 is folded over their respective interior panels 2024, 2028 of the pouches 2012, 2014.

The packages 2000, 2200 may each include an optional strap 2099, shown in FIG. 51. The strap 2099 may pass through and loop around an opening formed between the closure flaps 2070, 2071 and the hinge region 2016, shown, for example, in FIGS. 53-54. Alternatively, the ends of the strap 2099 may be attached to each of the end seals 2062, 2064 of the package 2000 such that the strap 2099 does not have to pass through the interior of the package 2000. The strap 2099 may be used to manually hold the packages 2000, 2200, or may be used to hang the packages 2000, 2200, for example, on a hook of a display in a store. In one form, the strap 2099 may be used to separate the first and second pouches 2012, 2014 or 2212, 2214 from each other in order to tear the packages 2000, 2200 in half.

For example, a consumer desiring to tear the package 2000 in half would pull the strap 2099 in a direction away from the bottom ends 2054, 2060 of the first and second pouches 2012, 2014 such that the opening force being applied by the consumer would cause the strap 2099 to cause a tear in the flexible material forming the package 2000. The tear may be through the hinge region 2016, since the hinge region 2016 provides a crease where the strap 2099 may be initially positioned and an optional line of weakness for the strap 2099 to tear through the flexible material that forms the package 2000. In one form, a tear notch may be made at or near the hinge region 2016 to facilitate a preferential tearing point or points where the first and second pouches 2012, 2014 may tear away from each other in response to a force being applied by the consumer to the strap 2099 as described above. In one form, the portion of the film forming the package 2000 that facilitates a tear between the pouches 2012, 2014 may be a monoaxial film.

A package 2100 according to another form is illustrated in FIGS. 55-58. The package 2100 is similar to the package 2000 of FIGS. 48-54, with certain differences highlighted below. For ease of reference, aspects of the package 2100 that are similar to aspects of the package 2000 have been designated with similar reference numbers, but prefaced with a "21." Unlike most of the packages described above, the package 2100 is not formed from a single sheet of flexible film.

Figure 55:
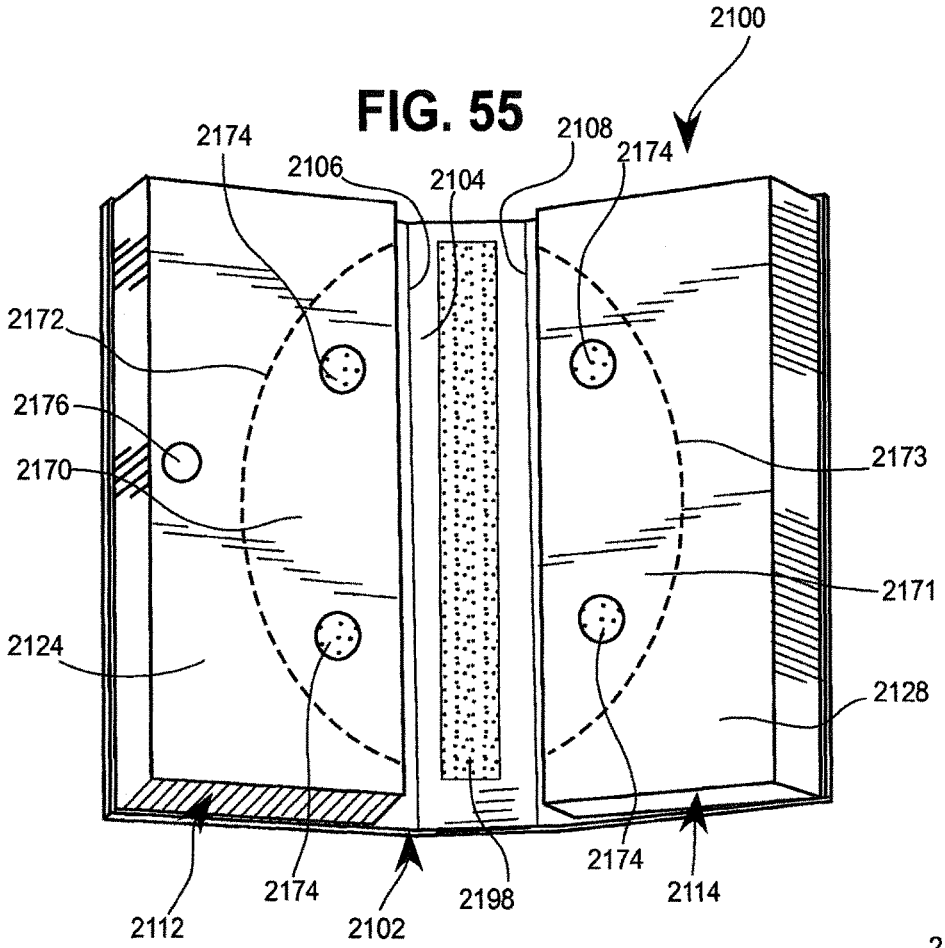
FIG. 55 illustrates a top view of an eighteenth exemplary package having two pouches attached to a cover including a central region with an adhesive in an open position.
Figure 57:
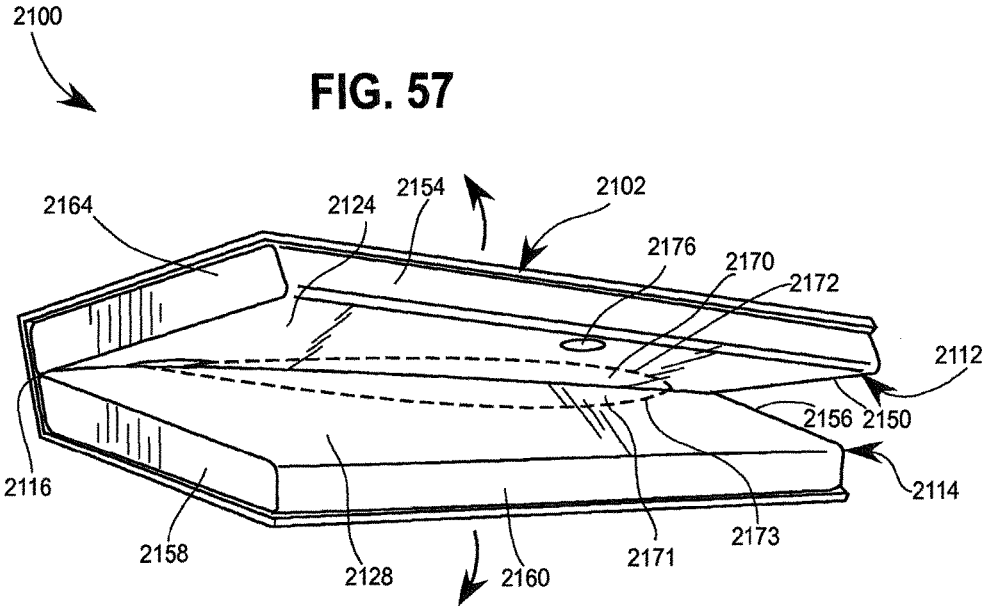
FIG. 57 illustrates a front perspective view of the package of FIG. 56 in a partially open position with the closure flaps being partially detached along the lines of weakness and being in part attached to each other.
Figure 58:
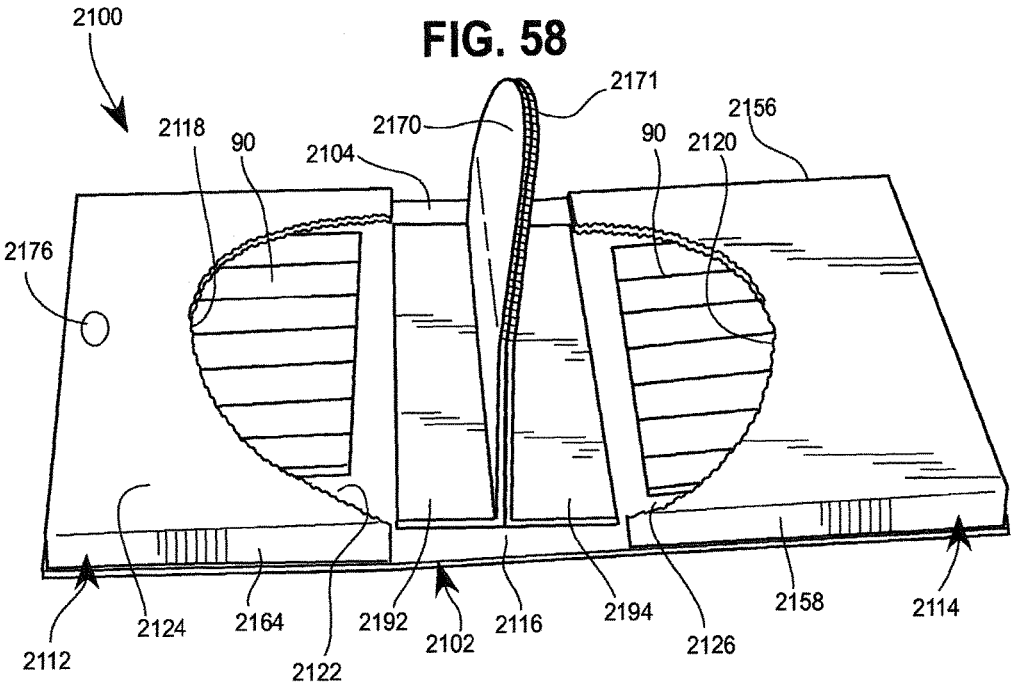
FIG. 58 illustrates a side perspective view of the package of FIG. 57 in an open position with the closure flaps being fully detached along the lines of weakness and being in part attached to each other.

The package 2100 is similar to the package 2000 of FIGS. 48-54 in that it is formed from two pouches 2112 and 2114 having closed bottom ends 2154 and 2160. The pouches 2112 and 2114 of the package 2100 have end seals 2162, 2164, 2166, and 2168, as shown in FIGS. 57-58. Similarly to the package 2000, the package 2100 includes two closure flaps 2170 and 2171. The first closure flap 2170 is attached to an interior panel 2124 of the first pouch 2112 along a first line of weakness 2172, and the second closure flap 2171 is attached to an interior panel 2128 of the second pouch 2114 along a second line of weakness 2173, as shown in FIG. 55.

Unlike the package 2000, the two pouches 2112 and 2114 are not both formed from a single sheet of film, but are each formed from a separate sheet of film, foil, paper or other material. Further, unlike the package 2000, the package 2100 includes an external cover 2102, to which the pouches 2112 and 2114 are separately attached via an adhesive, or any other suitable method, as shown in FIG. 55. The cover 2102 may be formed from a rigid material such as paperboard, cardboard, plastic, or combinations thereof. In the form shown in FIG. 55, the cover 2102 includes a central portion 2104, which is located between the pouches 2112, 2114. The central portion 2104 of the cover 2012 includes an adhesive material 2198 to which portions of the flaps 2170 and 2171 are non-removably attached, as shown, for example, in FIG. 58. The cover 2102 and the pouches 2112, 2114 may be attached via any suitable adhesive, a cold seal, or the like.

Similar to the package 2000, portions of the flaps 2170 and 2171 of the package 2100 are non-detachably attached to each other via an adhesive 2074 selected to create a non-detachable attachment of the closure flaps 2170 and 2171. Unlike the package 2000, where, with the package 2000 being in the closed position shown in FIG. 56, the closure flaps 2070 and 2071 are attached to each other via one adhesive strip 2096, the closure flaps 2170 and 2171 are attached to each other via multiple spaced adhesive dots 2174. It will be appreciated that the number and location of the adhesive strip 2198 and the adhesive dots 2174 of FIG. 55 have been illustrated for exemplary purposes only, and that the single adhesive strip 2198 may be replaced with two or more adhesive strips or two or more adhesive dots, or one or more adhesive areas of other shapes, while the adhesive dots 2174 may be replaced with a single adhesive strip, two or more adhesive strips, or one or more adhesive areas in shape other than a strip or a dot. Further, the adhesives 2174 and 2198 may be in the form of hot melt glue, any other adhesive, or another suitable means, for example, heat sealing, welding, UV-curing, lamination, or the like.

Figure 56:
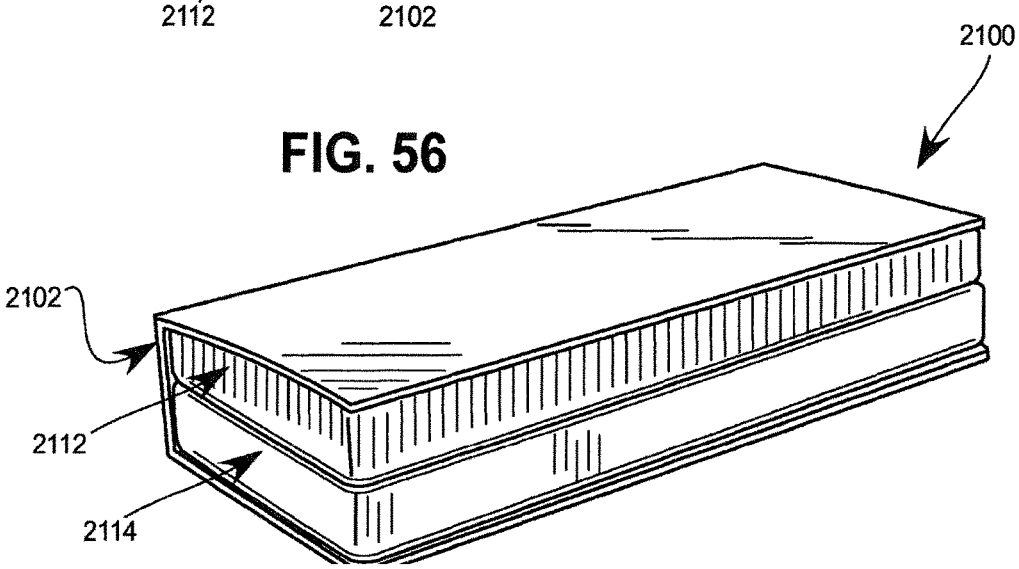
FIG. 56 illustrates a front perspective view of the package of FIG. 55 in a closed position with portions of the closure flaps of the pouches being attached to the adhesive of the central region of the cover.

When the package 2000 is moved from the closed position of FIG. 56 in a direction shown by the directional arrows in FIG. 57 toward the open position of FIG. 58, the pouches 2112, 2114 move about the hinge 2116 away from each other to open the package 2100 in a book-like manner, which may be visually appealing to consumers. During the opening of the package 2100, the pouches 2112, 2114 move away from each other to a position where the opening force being applied by the consumer initiates a tear in one or both of the lines of weakness 2172 and 2173, as shown in FIG. 57.

In FIG. 57, the package 2100 has been shown with the closure flap 2170 partially separating from the interior panel 2124 of the first pouch 2112 along the line of weakness 2072 and the closure flap 2071 partially separating from the interior panel 2028 of the second pouch 2014 along the line of weakness 2073. While both of the closure flaps 2170 and 2171 may separate from their respective interior panels 2124 and 2128 generally simultaneously with the movement of the package 2100 to its open position, the package 2100 can be configured such that one of the lines of weakness 2172 or 2173 will tear initially to access one of the pouches 2112 or 2114. For example, one of the lines of weakness 2172, 2173 may be weaker such that it preferentially opens first. Alternatively, one of the lines of weakness 2172, 2173 may include a tear notch such that upon manipulation of the package 2100 toward the open position, the line of weakness including the notch would preferentially perforate first. After a tear propagates through one of the lines of weakness 2072, 2073, further manipulation of the package 2100 may then tear through the other of the lines of weakness 2172 or 2173 in order to later access the other one of the pouches. Advantageously, as described above in reference to the package 2200, this can allow for one of the pouches to be accessed, while the other pouch remains closed or sealed, such as until the contents of the one of the pouches are removed.

Similar to the closure flaps 2070, 2071 and 2270, 2271 of the packages 2000 and 2200, the closure flaps 2170, 2171 of the package 2100 provide a freshness seal and/or tamper-evident feature for the package 2100 such that the absence of, or the partial detachment of one or both of the closure flaps 2170, 2171 would visually indicate to a consumer that the package 2100 has been previously opened or tampered with.

Unlike the package 2000 of FIG. 54, which does not have a cover such as the cover 2102, when the package 2100 is in the open position shown in FIG. 58, a portion 2192 of the first closure flap 2170 proximate the hinge line 2116 remains attached not to the inner surface 2136 of the outer wall 2122 of the pouch 2112, but to the central area 2104 of the cover 2012, and a portion 2194 of the second closure flap 2171 proximate the hinge line 2116 remains attached not to the inner surface 2140 of the outer wall 2126 of the pouch 2114, but to the central area 2104 of the cover 2012, as shown in FIG. 58.

With the package 2100 in the open position, portions of the closure flaps 2170 and 2171 remain attached to each other via the adhesive dots 2174 as the closure flaps 2170 and 2171 open up due to their separation from their respective interior panels 2124 and 2128, as shown in FIG. 58. Similarly to the lines of weakness 2072 and 2073, the lines of weakness 2172 and 2173 are curved toward their respective side edges 2154 and 2160, and, with the package 2100 being open as shown in FIG. 58, more of the food product 90 is exposed to the consumer to facilitate easy removal of the food product from each of the pouches 2112, 2114. Unlike the closure flaps 2070, 2071 of the package 2000 of FIG. 54, which include portions that are not attached to each other and not substantially perpendicular to the foot portions 2092, 2094, the closure flaps 2170, 2171 in their open positions shown in FIG. 58 are fully attached to each other and positioned in a substantially perpendicular position relative to the foot portions 2192, 2194 to facilitate a consumer in removing portions of the food product 90 from the pouches 2112 and 2114 through the openings 2118 and 2120.

The package 2100 can be formed via a method that is substantially similar to the method shown in FIGS. 6-10 with some of the differences being the formation of the first and second pouches 2112 and 2114 separately from one another, the formation of the cover 2102 from a single sheet of suitable material, the attachment of the first and second pouches 2112 and 2114 to the cover 2102, the position and number of the adhesives 2174 and 2198, and the fact that no portion of the closure flaps 2170 and 2171 is folded over their respective interior panels 2124 and 2128.

Figure 62:
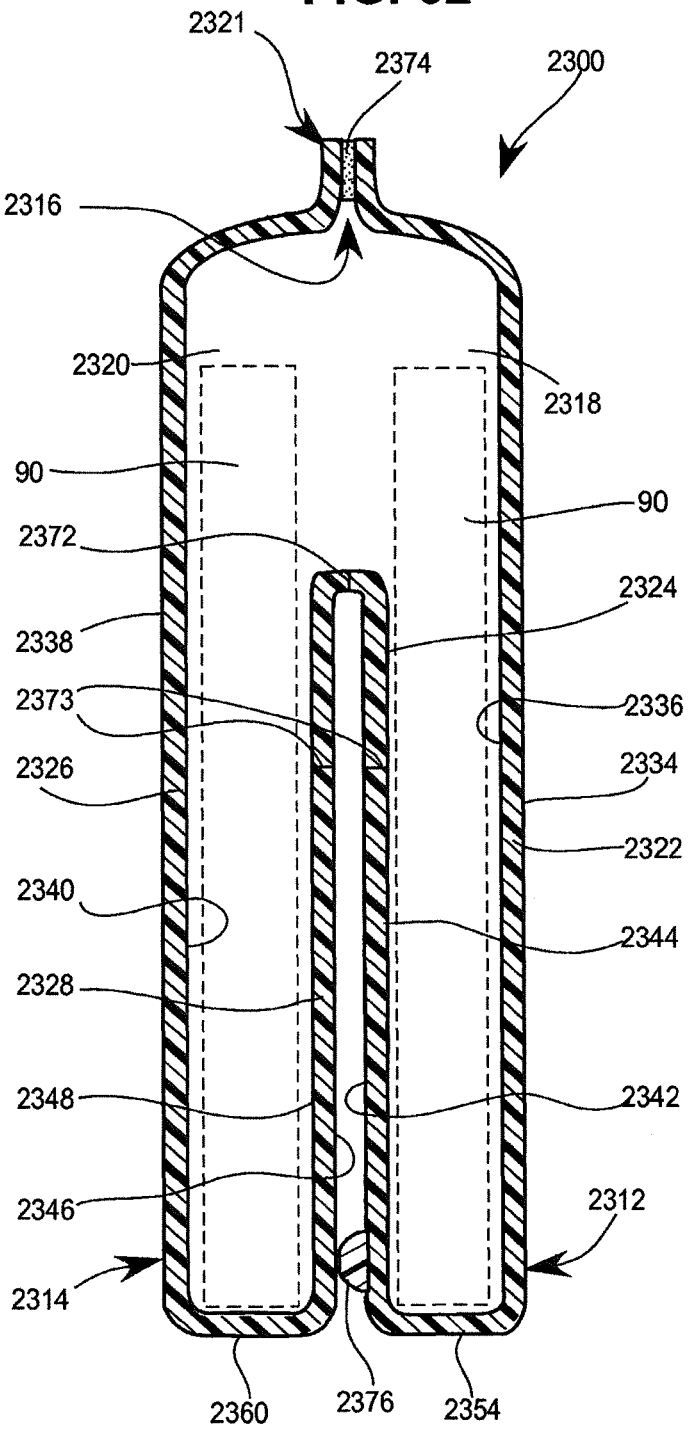
FIG. 62 illustrates a cross-section of a twentieth exemplary package having two pouches folded about a hinge in a closed position, taken along a line similar to the line 48-48 of FIG. 51.
Figure 63:
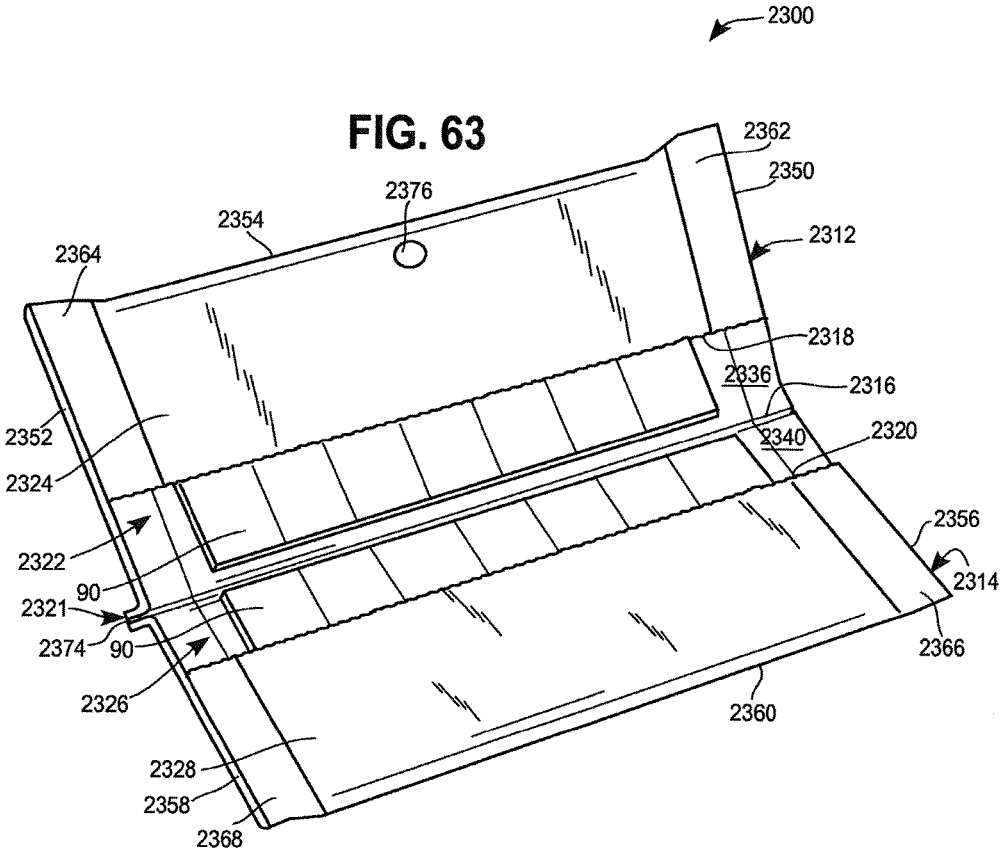
FIG. 63 illustrates a perspective view of the package of FIG. 62 in an open position with the interior panels of the pouches being detached from each other along a line of weakness and the products in each pouch being fully accessible.

A package 2300 according to another form is illustrated in FIGS. 62-63. For ease of reference, aspects of the package 2300 that are similar to aspects of the packages described above have been designated with similar reference numbers, prefaced with a "23." The package 2300 has a similar general construction to the packages described above in that it is formed from a single sheet of flexible film, with some differences highlighted below.

The package 2300 includes two pouches 2312, 2314. Unlike, for example, the packages 2000, 2100, and 2200, the pouches 2312, 2314 of the package 2300 do not include closure flaps. Instead, the interior panel 2324 of the first pouch 2312 is attached to the interior panel 2328 of the second pouch 2314 along a first line of weakness 2372, as shown in FIG. 62. Since the package 2300 is formed from one sheet of flexible film, the outer walls 2322 and 2326 of the pouches 2312 and 2314, respectively, are brought together to form a fin seal 2321 proximate a hinge portion 2316 of the package 2300. Ends of the outer walls 2322, 2326 forming the fin seal 2321 are attached to each other via an adhesive 2374, for example, a heat seal, cold seal, hot melt, pressure sensitive adhesive, or the like to seal the package 2300. The adhesive 2374 is preferably selected to create a non-detachable or permanent attachment (in normal use) of the ends to each other, as shown in FIG. 62. When the package 2300 is moved from the closed position of FIG. 62 toward the open position of FIG. 63, the pouches 2312 and 2314 move about the hinge 2316 away from each other to open the package 2300 in a book-like manner, which may be visually appealing to consumers.

During the opening of the package 2300, the pouches 2312, 2314 move away from each other about the hinge 2316 and relative to the line of weakness 2372 to a position where the opening force or tension being applied by the consumer initiates one or more tears in the line of weakness 2372 to permit separation of the interior panels 2324 and 2328 from each other. As the package 2300 is moved by the consumer to the fully open position, the interior panels 2324 and 2328 fully separate from each other along the line of weakness 2372 and the food product in each of the pouches 2312, 2314 is accessible to the consumer.

As an alternative to the line of weakness 2372 described above and shown in FIG. 62, the package 2300 may optionally include a line of weakness 2373 on each of the interior panels 2324 and 2328, at or near the locations shown in FIG. 62. In this optional embodiment, during the opening of the package 2300, the pouches 2312, 2314 move away from each other about the hinge 2316 to a position where the opening force or tension being applied by the consumer initiates one or more tears in one or both of the lines of weakness 2373 to permit separation of a portion of one or both of the interior panels 2324 and 2328 along one or both of the lines of weakness 2373 to permit access to the food product 90 in one or both of the pouches 2312, 2314. In the event that a portion of only one of the interior panels 2324 separates along its respective line of weakness 2373 to provide access to the food product 90 in only the first pouch 2312, a consumer may then manipulate the package 2300 to separate a portion of the interior panel 2328 along its respective line of weakness 2373 to provide access to the food product 90 in the second pouch 2314.

Figure 49:
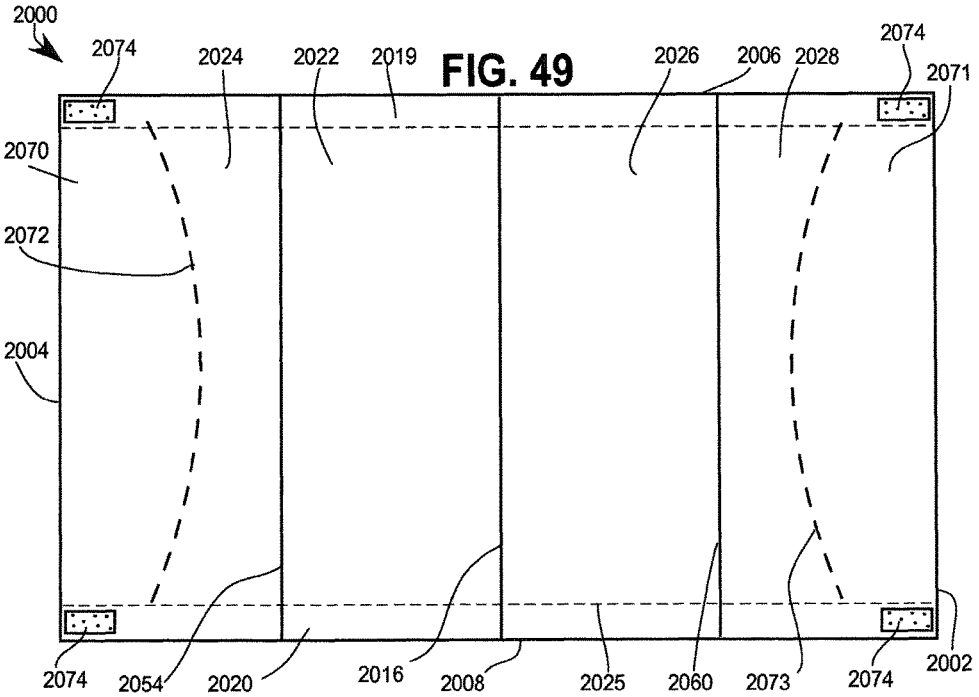
FIG. 49 illustrates a top plan view of an exemplary sheet of material, which can be part of a larger web of material, that can be used to form the package of FIG. 48.

While the line of weakness 2372 of the package 2300, as well as each of the lines of weakness 2373 of an alternative embodiment of the package 2300, may be straight (and substantially parallel to the bottom ends 2354, 2360 of the pouches 2312, 2314) as shown, for example, in FIG. 63 (which shows a tear propagated alone the line of weakness 2372), it is to be appreciated that the line of weakness 2372 (and the alternative lines of weakness 2373) may be slanted (non-parallel to the bottom ends 2354, 2360 of the pouches 2312, 2314) as in FIG. 43, or may be arcuate as in FIG. 49, or irregularly shaped as in FIG. 61.

Optionally, portions of the interior panels 2324 and 2328 above the lines of weakness 2373 (for example, at a location similar to the location of the adhesive material 2096 in FIG. 48) may be attached to each other via an adhesive material. The adhesive material may be similar or identical to the adhesive material 2096 and would be selected to create a non-detachable or permanent attachment of the interior panels 2324 and 2328 of the closure flaps 2370 and 2371 to each other.

In the form where such an adhesive material is present and attaches portions of the interior panels 2324 and 2328 to each other, during the opening of the alternative package 2300, the pouches 2312, 2314 move away from each other about the hinge 2316 to a position where the opening force or tension being applied by the consumer initiates one or more tears in one or both of the lines of weakness 2373 to permit separation of a portion of one or both of the interior panels 2324 and 2328 along one or both of the lines of weakness 2373 to permit access to the food product 90 in one or both of the pouches 2312, 2314. As the package 2300 is moved by the consumer to the fully open position, portions of the interior panels 2324 and 2328 may sequentially or simultaneously fully separate along the lines of weakness 2373 from their respective panels 2324, 2328 to provide access to the food product 90 in the pouches 2312, 2314 in a way generally similar to that shown in FIGS. 59-61.

A consumer desiring to reclose the package 2300 from the open position of FIG. 63 to the closed position of FIG. 62 can move the pouches 2312 and 2314 back toward each other about the hinge 2316 such that the adhesive area 2376 on the interior panel 2324 of the pouch 2312 contacts and detachably attaches to the outer surface 2346 of the interior panel 2328 of the pouch 2314 to permit multiple reclosings and openings of the package 2300.

A package 2400 according to another form is illustrated in FIGS. 64-70. The package 2400 is similar to the package 2000 of FIGS. 48-54, with certain differences highlighted below. For ease of reference, aspects of the package 2400 that are similar to aspects of the package 2000 have been designated with similar reference numbers, but prefaced with a "24." The package 2400 has a similar general construction to some of the packages described above in that it can be formed from a single sheet or portion of a web of flexible film. It will be appreciated that the features of the package 2400 have been exaggerated for clarity and are not intended to be drawn to scale.

The package 2400 is different from the package 2000 of FIGS. 48-54 in that, unlike the package 2000, which is formed of two pouches 2012 and 2014, the package 2400, in addition to the first and second pouches 2412 and 2414 similar to the pouches 2012, 2014 of the package 2000, includes a third pouch 2435 movably attached relative to the second pouch 2414 about a hinge 2443. In the embodiment shown in FIGS. 64-70, the third pouch 2435 advantageously provides the three-pouch package 2400 with additional storage capability for food product 90 as compared to the two-pouch package 2000 with a similar width. The third pouch 2435 may be optionally separated from the first and second pouches 2412 and 2414 and disposed after use, as described in more detail below.

Figure 70:
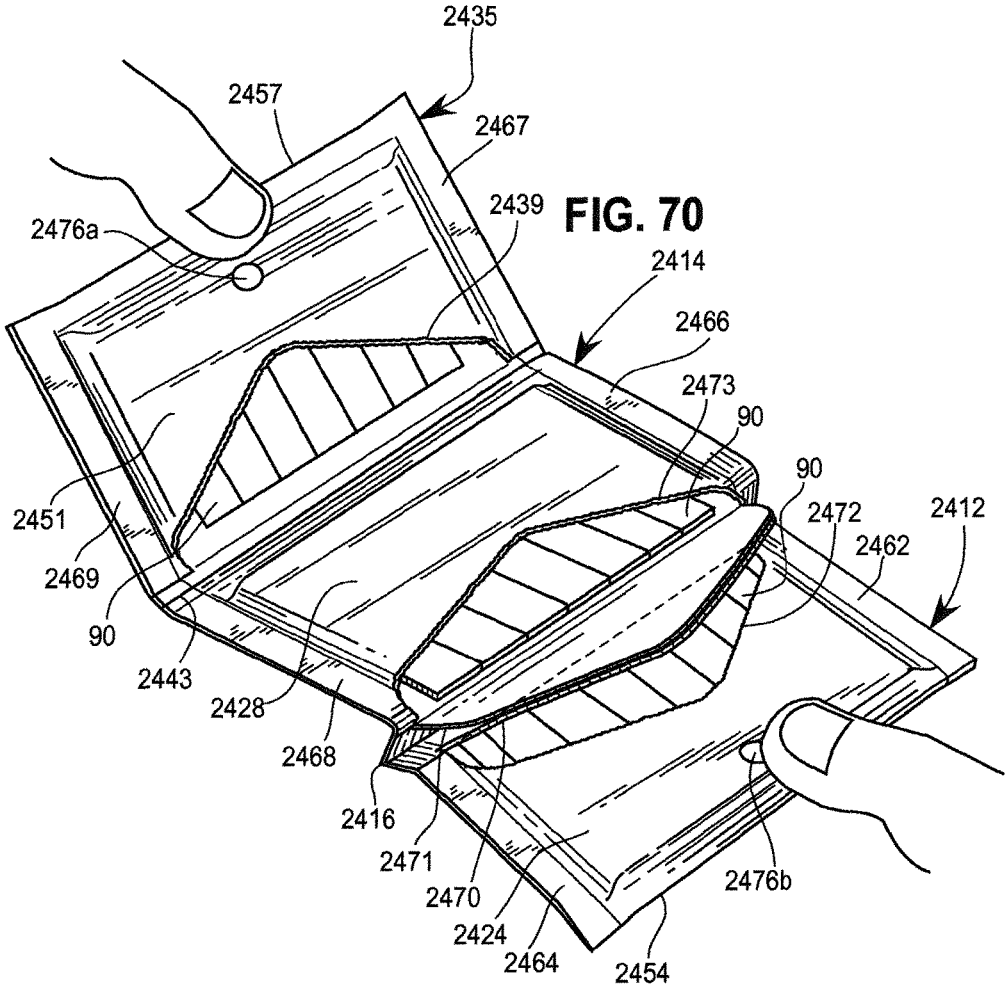
FIG. 70 illustrates a front perspective view of the package of FIG. 68 in a fully open position with the closure flaps of the first and second pouches being fully detached from their respective interior panels and the food products in all three pouches being fully accessible to a user.

The three-pouch package 2400 is similar to the two-pouch package 2000 of FIGS. 48-54 in that it includes two pouches 2412 and 2414 having closed bottom ends 2454 and 2460. In the form illustrated in FIG. 68, the three-pouch package 2400 is different from the two-pouch package 2000 in that the bottom end 2454 of the first pouch 2412 is not formed by a fold, but by sealing a portion of the inner surface 2436 of the outer wall 2422 to a portion of the inner surface 2444 of the interior panel 2424 via an adhesive 2474*a* to form a hermetic seal. The three-pouch package 2400 is also different from the two-pouch package 2000 in that, unlike the bottom end 2060 of the pouch 2014 of the two-pouch package 2000, the bottom end 2460 of the second pouch 2414 of the three-pouch package 2400 is not formed by a fold, but by sealing a portion of the inner surface 2440 of the outer wall 2426 to a portion of the interior surface 2448 of the interior panel 2428 via an adhesive 2474*b* to optionally form a hermetic seal. The pouches 2412 and 2414 of the three-pouch package 2400 have end seals 2462, 2464, 2466, and 2468, as shown in FIG. 70. It will be appreciated that one or more of the end seals 2462, 2464, 2466, and 2468.

Similarly to the package 2000, the package 2400 includes a first pouch 2412 having a first closure flap 2470 and a second pouch 2414 having a second closure flap 2471. The first closure flap 2470 of the first pouch 2412 is separable from an interior panel 2424 of the first pouch 2412 along a first line of weakness 2472. Similarly, the second closure flap 2471 is detachably attached to an interior panel 2428 of the second pouch 2414 along a second line of weakness 2473, as shown in FIGS. 68 and 70.

Figure 64:
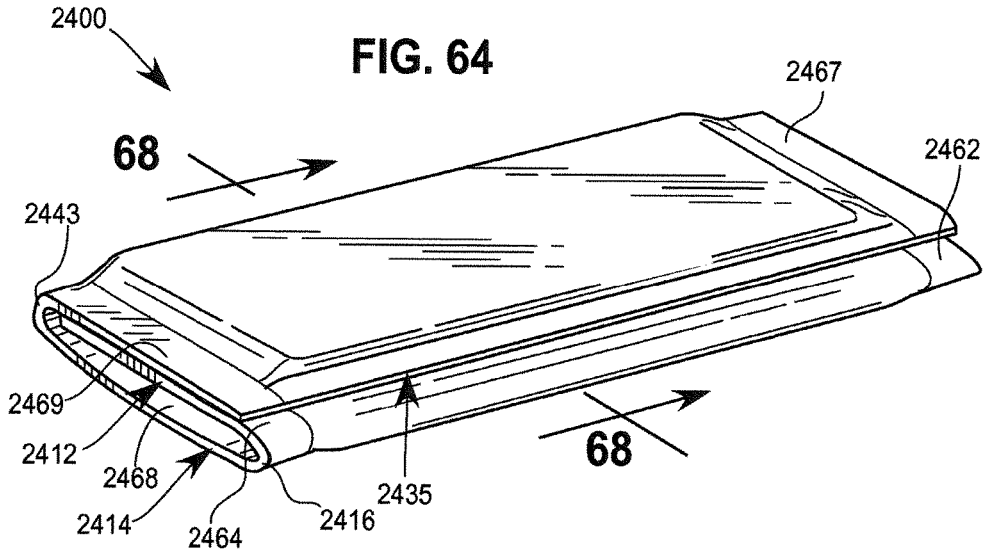
FIG. 64 illustrates a front perspective view of a twenty-first exemplary package having two pouches folded about a first hinge and a third pouch folded about a second hinge in a closed position.
Figure 68:
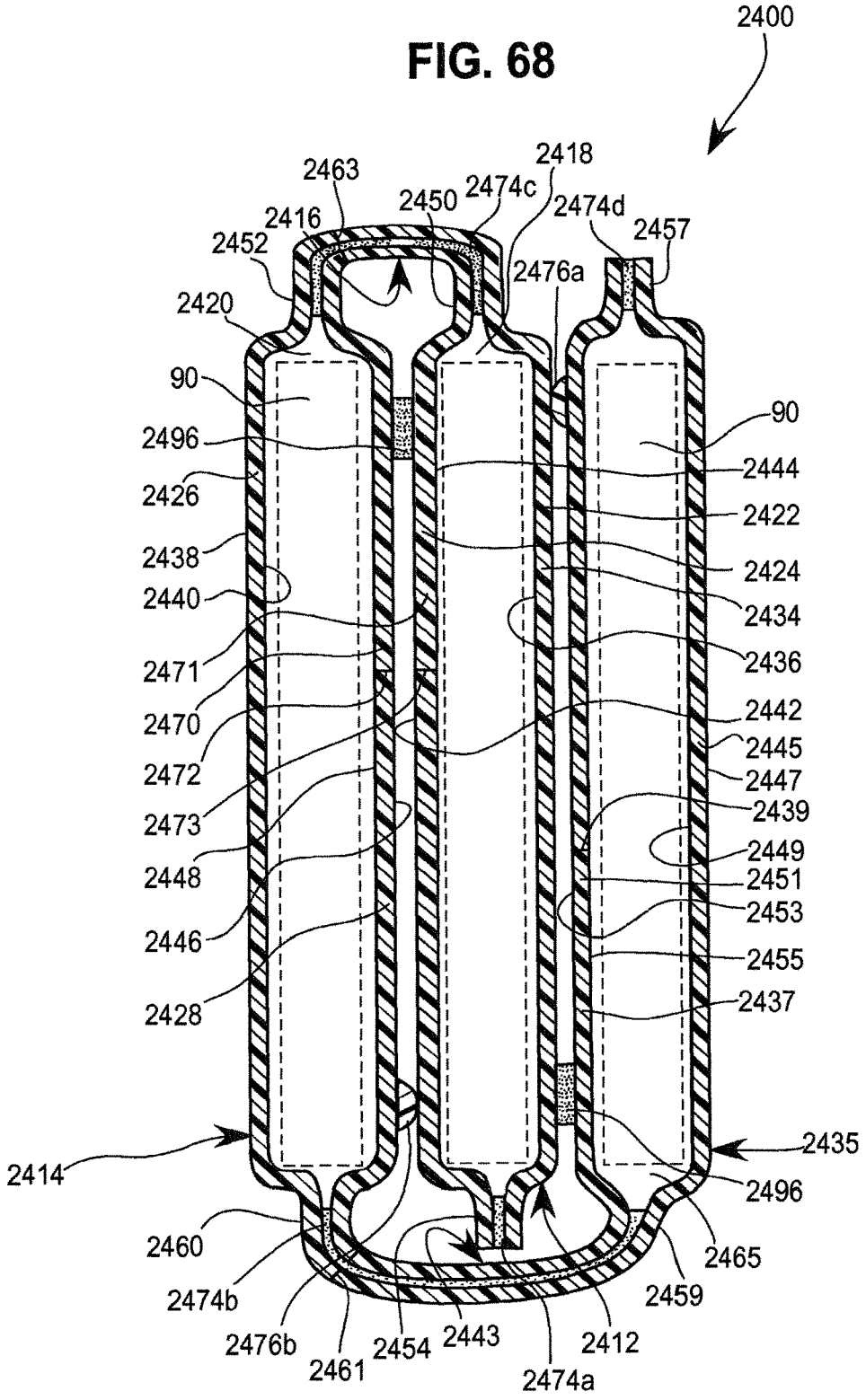
FIG. 68 illustrates a cross-section of the package of FIG. 64 taken along line 68-68 of FIG. 64.

When the package 2400 is in a closed position shown in FIGS. 64 and 68, portions of the first and second closure flaps 2470 and 2471 of the first and second pouches 2412 and 2414, respectively, are oriented such that a portion of the closure flap 2470 extends from the interior panel 2424 of the pouch 2412 toward the outer wall 2422 of the first pouch 2412 and is attached to the inner surface 2436 of the outer wall 2422 of the first pouch 2412 via an adhesive 2474*c*, as shown in FIG. 68. Similarly, the closure flap 2471 extends from the interior panel 2428 of the second pouch 2414 toward the outer wall 2426 of the second pouch 2414 and is also attached to the inner surface 2440 of the outer wall 2426 of the second pouch 2414 via the adhesive 2474*c*, as shown in FIG. 68.

In the form shown in FIG. 68, the adhesive material 2474*c* seals the closure flaps 2470 and 2471 to their respective outer walls 2422 and 2426, and extends from a top end 2450 of the first pouch 2412 to a top end 2452 of the second pouch 2414 along a hinge area 2416 between the first and second pouches 2412 and 2414. Thus, when the closure flaps 2470 and 2471 are attached to their respective inner surfaces 2436, 2440 of the outer walls 2422, 2426 via the adhesive 2474*c* when the package 2400 is in the closed position, access to the food product 90 in the first and second pouches 2412, 2414 is blocked by the closure flaps 2470, 2471, as can be seen in FIG. 68.

It will be appreciated that while the adhesive material 2474*c* has been illustrated in FIG. 68 as a single adhesive layer extending continuously from the top end 2450 of the first pouch 2412 to the top end 2452 of the second pouch 2414, in an alternative approach, two separate adhesives may be used to seal the closure flaps 2470 and 2471 to their respective outer walls 2422 and 2426. In this approach, the hinge area 2416 would not include two layers of film sealed to each other by an adhesive 2474*c* as in FIG. 68, but would include a fold of flexible film similar to that shown along the hinge area 2016 in FIG. 48.

Similar to the closure flaps 2070 and 2071 of the two-pouch package 2000, the closure flaps 2470 and 2471 of the three-pouch package 2400 are attached to each other via an adhesive material 2496. The adhesive material 2496 may be identical to or different from the adhesive materials 2474*a*, 2474*b*, 2474*c*, and is selected to attach of the closure flaps 2470 and 2471 to each other. The adhesive materials 2474*a*, 2474*b*, 2474*c* are selected to attach of the outer walls and interior panels of the first and second pouches 2412 and 2414 to form the closed top and bottom ends of the pouches 2412 and 2414. The adhesive materials 2474*a*, 2474*b*, 2474*c*, and 2496 may be in the form of hot melt glue, heat seals, welding, UV-curing, lamination, or the like.

The third pouch 2435 of the three-pouch package 2400 has a substantially similar structure to the first and second pouches 2412 and 2414. The third pouch 2435 includes an outer wall 2445 having an outer surface 2447 and an inner surface 2449, an interior panel 2451 opposite the outer wall 2445 and including an outer surface 2453 and an inner surface 2455. Similar to the bottom end 2460 of the second pouch 2414, the bottom end 2457 of the third pouch 2435 is formed by sealing a portion of the inner surface 2449 of the outer wall 2445 to a portion of the inner surface 2455 of the interior panel 2451 via an adhesive 2474*d* to form a hermetic seal, as shown in FIG. 68. The third pouch 2435 of the three-pouch package 2400 has end seals 2467 and 2469 similar to the end seals of 2462, 2464, 2466, and 2468 of the first and second pouches 2412 and 2414, as shown, for example, in FIG. 70.

Similarly to the closed bottom end 2454 of the first pouch 2412, the closed top end 2459 of the third pouch 2435 is formed by sealing a portion of the inner surface 2449 of the outer wall 2445 of the pouch 2435 to a portion of the inner surface 2455 of the interior panel 2453 of the pouch 2435 via an adhesive 2474*d* to form an optionally hermetic seal, as shown in FIG. 68. In the embodiment illustrated in FIG. 68, a single adhesive 2474*a* is used to seal the closed bottom end 2460 of the second pouch 2414 and the closed top end 2459 of the third pouch 2435. It will be appreciated that instead of a single adhesive 2474 that extends continuously from the closed bottom end 2460 of the first pouch 2412 to the closed top end 2459 of the third pouch 2435, two separate adhesives may be used to seal the bottom end 2460 of the second pouch 2414 and the closed top end of the third pouch 2435. In this approach, a hinge area 2443 about which the third pouch 2435 opens would not include two layers of film sealed to each other by an adhesive 2474*a* as in FIG. 68, but would include a fold of flexible film similar to that shown along the hinge area 2016 in FIG. 48.

The third pouch 2435 includes a third closure flap 2437 separable from an interior panel 2451 of the third pouch 2435 along a third line of weakness 2439. A portion of the third closure flap 2437 is attached to the outer wall 2422 of the second pouch 2414 as shown in FIG. 68. Specifically, a portion of the exterior surface 2453 of the interior panel 2451 of the third pouch 2435 is attached to an opposite portion of the exterior surface 2434 of the outer wall 2422 of the first pouch 2412 by an adhesive 2496. The adhesive 2496 is selected to attach of the closure flap 2437 of the third pouch 2435 to the outer panel 2422 of the first pouch 2412 such that the strength required to separate the closure flap 2437 along the third line of weakness 2439 is less than the strength required to break the attachment of the closure flap 2437 to the outer panel 2422 via the adhesive 2496. A portion of the closure flap 2437 is also attached to the inner surface 2449 of the outer wall 2445 via the adhesive 2474*a* to seal the third pouch 2435 at the top end 2459 of the third pouch 2435, as shown in FIG. 68. Thus, when the three-pouch package 2400 is in the closed position, access to the food product 90 in the third pouch 2435 is blocked by the closure flap 2437, as can be seen in FIG. 68.

Figure 69:
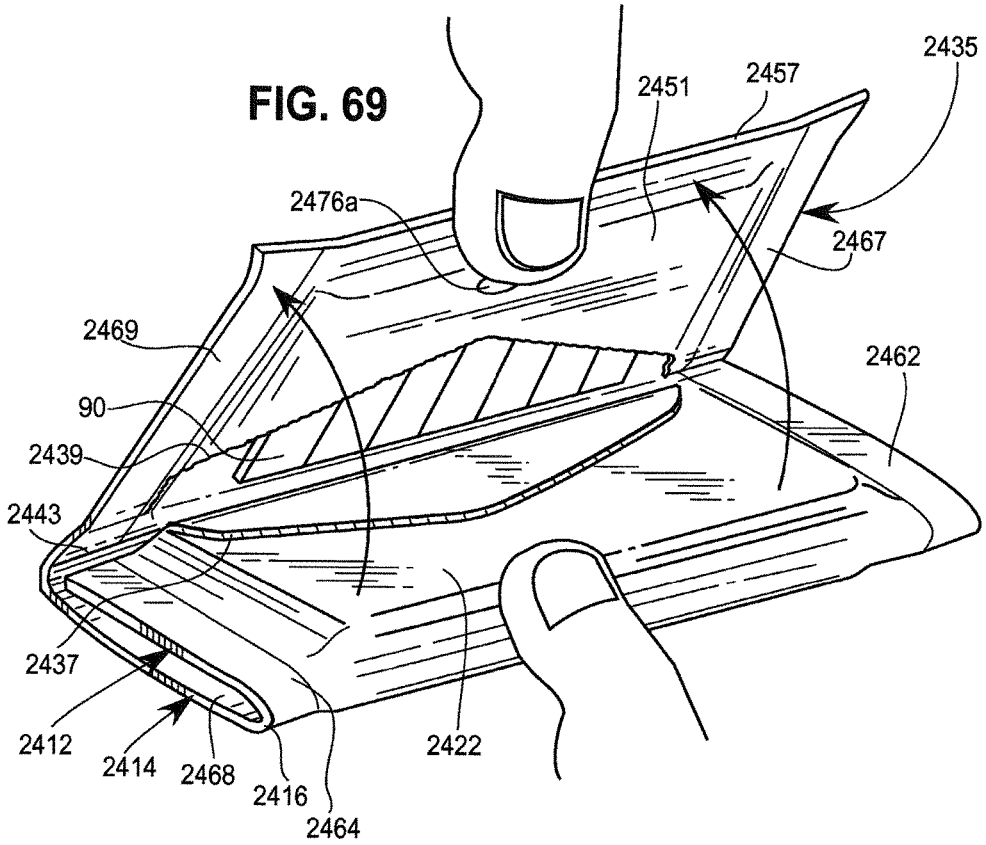
FIG. 69 illustrates a front perspective view of the package of FIG. 68 in a partially open position with the closure flap of the third pouch being fully detached from its interior panel and the food product in the third pouch being exposed to a user while the second and third pouches are still closed.

To open the three-pouch package 2400, the package 2400 may be grasped by a user (exemplary position of thumbs shown in FIG. 69) and manipulated to move the third pouch 2435 from the closed position of FIG. 64 in a direction shown by the arrows in FIG. 69 toward the open position of FIGS. 69-70. When moved from the closed position of FIG. 64 toward the open position of FIG. 69, the third pouch 2435 pivotally moves about the hinge 2443 away from the first pouch 2412 to partially open the three-pouch package 2400 and provide access to the food product 90 in the pouch 2435 in a book-like manner, which may be visually appealing to consumers. With the three-pouch package 2400 being partially open as shown in FIG. 69, the first and second pouches 2412, 2414 can remain sealed, advantageously preserving the freshness of the food product 90 in the first and second pouches 2412, 2414 while the user may consume the food product 90 in the third pouch 2435 of the three-pouch package 2400.

During the opening of the three-pouch package 2400 by a user from the closed position of FIG. 64 in the direction shown in FIG. 69, as the third pouch 2435 and the second pouch 2012 of the three-pouch package 2400 move away from each other, a position is reached where the opening force or tension applied by the consumer initiates a one or more tears in the line of weakness 2439 in the interior panel 2451 of the third pouch 2435. This can be achieved by having an increasing tension in the closure flap 2437 as the three-pouch package 2400 is opened, controlled in part by the length of the closure flap 2437, being less than the length required to have a partially opened three-pouch package 2400 as in FIG. 69 without separation of the closure flap 2437 from the interior panel 2451 of the third pouch 2435.

In FIG. 69, the three-pouch package 2400 is shown in a partially open position where enough opening force has been applied to cause the closure flap 2437 to separate from the interior panel 2451 of the third pouch 2435 along the line of weakness 2439. With the three-pouch package 2400 being in the partially open position shown in FIG. 69, the user is permitted to access the food product 90 in the third pouch 2435 without having to open the three-pouch package 2400 to the fully open position of FIG. 70. In other words, the food product 90 of the third pouch 2435 may be consumed while the first and second pouches 2412 and 2414 remain sealed, preserving the freshness of the food product 90 inside the first and second pouches 2412 and 2414.

To permit the three-pouch package 2400 to be reclosed after being opened for the first time to the partially open position shown in FIG. 69, the outer surface 2453 of the interior panel 2451 of the pouch 2435 includes an optional adhesive area 2476*a*, as shown in FIGS. 68 and 70. A consumer desiring to reclose the three-pouch package 2400 from the open position of FIG. 69 to the closed position of FIG. 64 would bring the first pouch 2412 and the third pouch 2435 toward each other about the hinge 2443 such that the adhesive area 2476*a* contacts and adheres to the outer surface 2434 of the outer wall 2422 of the first pouch 2412. When the package 2400 is so reclosed, the food product 90 is contained in the third pouch 2435 and restricted from falling out of the three-pouch package 2400. The three-pouch package 2400 may include an optional line of weakness 2461 between the bottom end 2460 of the second pouch 2414 and the top end 2459 of the third pouch 2435, as shown in FIG. 68, that would permit the consumer, after the third pouch 2435 no longer has any food product 90 left, to detach the third pouch 2435 from the second pouch 2414 and dispose of the third pouch 2435 without opening the first and second pouches 2412 and 2414.

To open the three-pouch package 2400 from the partially open position of FIG. 69 to the fully open position of FIG. 70, the three-pouch package 2400 may be grasped by a user (exemplary position of thumbs shown in FIG. 70) and manipulated to move the first pouch 2412 from its position of FIG. 69 toward the open position of FIG. 70. When moved from the closed position toward the open position, the first pouch 2412 moves about the hinge 2416 away from the second pouch 2414 until a position is reached where the opening force or tension applied by the consumer initiates one or more tears in one or both of the lines of weakness 2472, 2473 to separate the first and second closure flaps 2470 and 2471 from their respective pouches 2412 and 2414 and to fully open the package 2400 and provide access to the food product in all three pouches 2412, 2414, and 2435 in a book-like manner, which may be visually appealing to consumers, as shown in FIG. 70.

To permit the first and second pouches 2412 and 2414 of the three-pouch package 2400 to be reclosed after being opened for the first time to the fully open position shown in FIG. 70, the outer surface 2446 of the interior panel 2428 of the second pouch 2414 includes an optional adhesive area

2476*b*, as shown in FIGS. 68 and 70. A consumer desiring to reclose the three-pouch package 2400 from the open position of FIG. 70 to the partially open position of FIG. 69 would bring the first and second pouches 2412 and 2414 toward each other about the hinge 2416 such that the adhesive area 2476*b* contacts and adheres to the outer surface 2442 of the outer wall 2424 of the pouch 2412. When the three-pouch package 2400 is so reclosed, the food products 90 are contained in the first and second pouches 2412 and 2414 and restricted from falling out of the three-pouch package 2400. In one approach, the three-pouch package 2400 may include an optional line of weakness 2463, between the top end 2450 of the first pouch 2412 and the top end 2452 of the second pouch 2414, as shown in FIG. 68, that would permit the consumer, after one of the first or second pouches 2412, 2414 no longer has any food product 90 left in it, to detach and dispose of the empty pouch 2412 or 2414, while retaining the other pouch 2412 or 2414 that still contains food product 90 in it.

Figure 65:
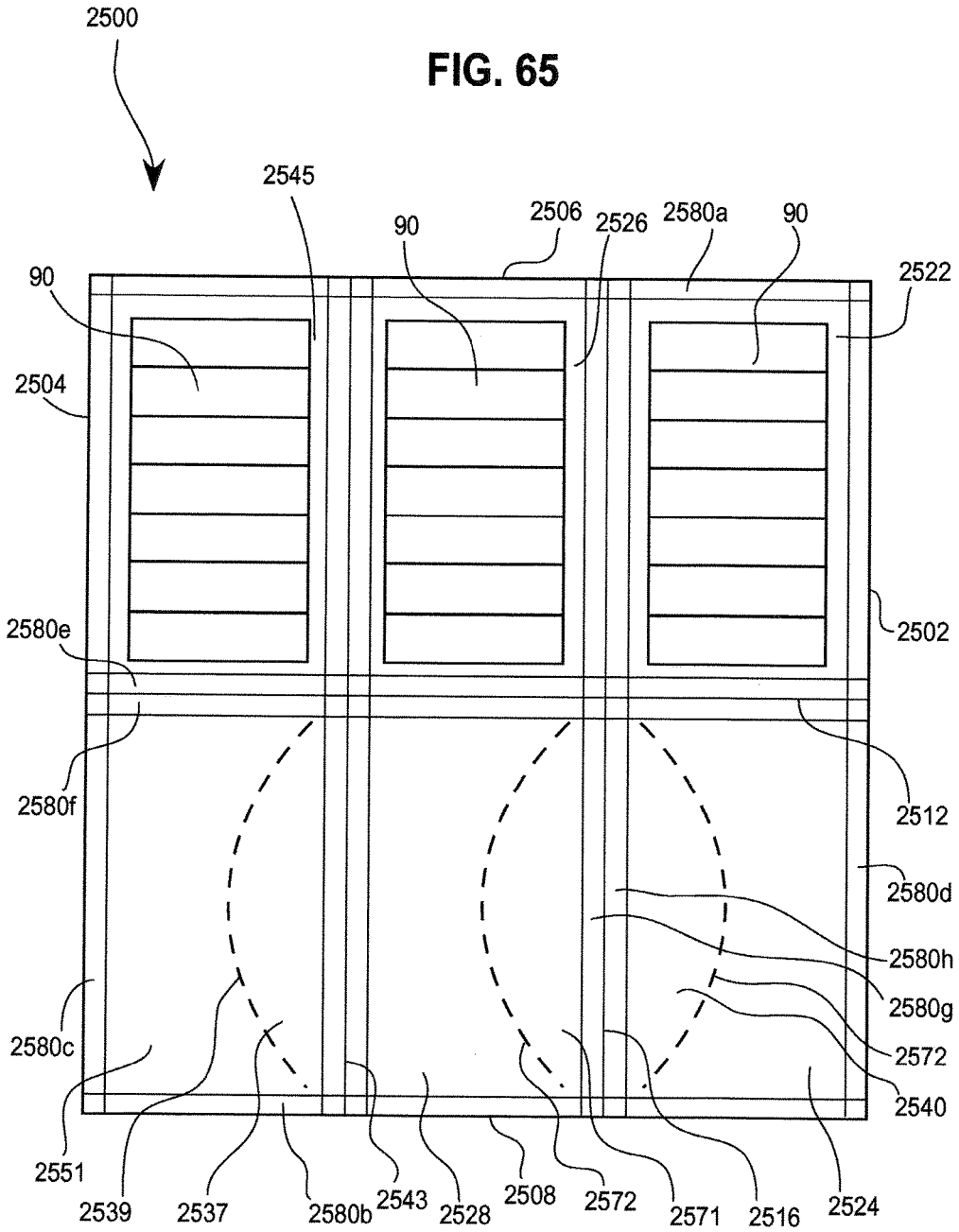
FIG. 65 illustrates a top plan view of an exemplary sheet of material having food product deposited thereon, which can be part of a larger web of material, that can be used to form the package of FIG. 64.
Figure 66:
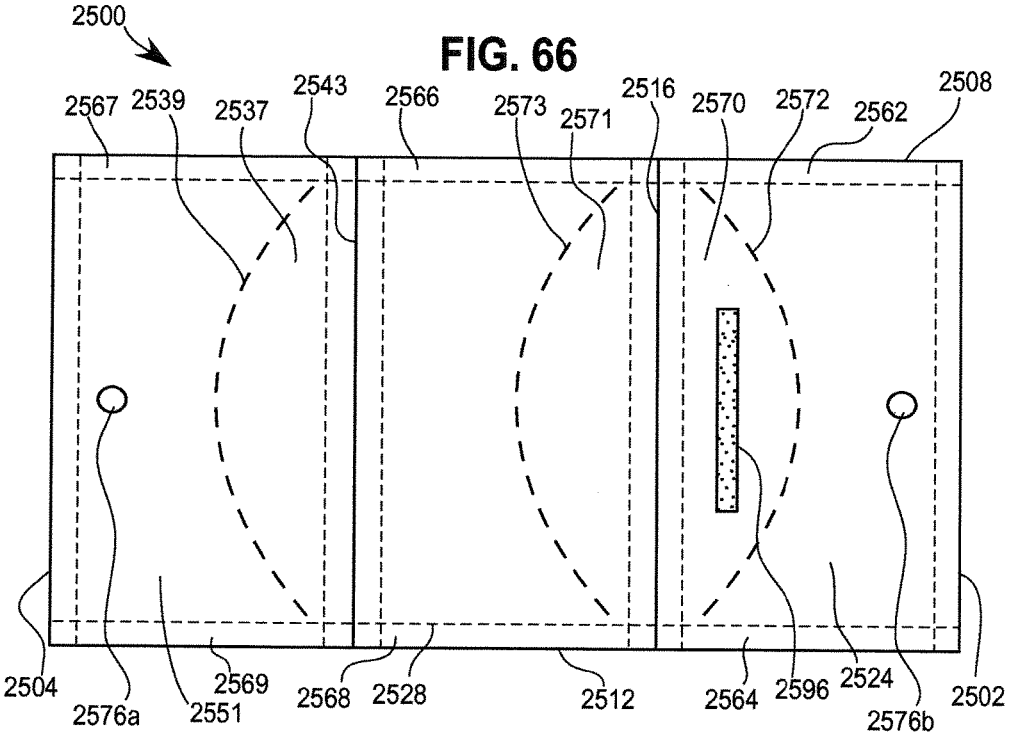
FIG. 66 is a top plan view of the sheet of material of FIG. 65 folded to cover the food product.
Figure 67:
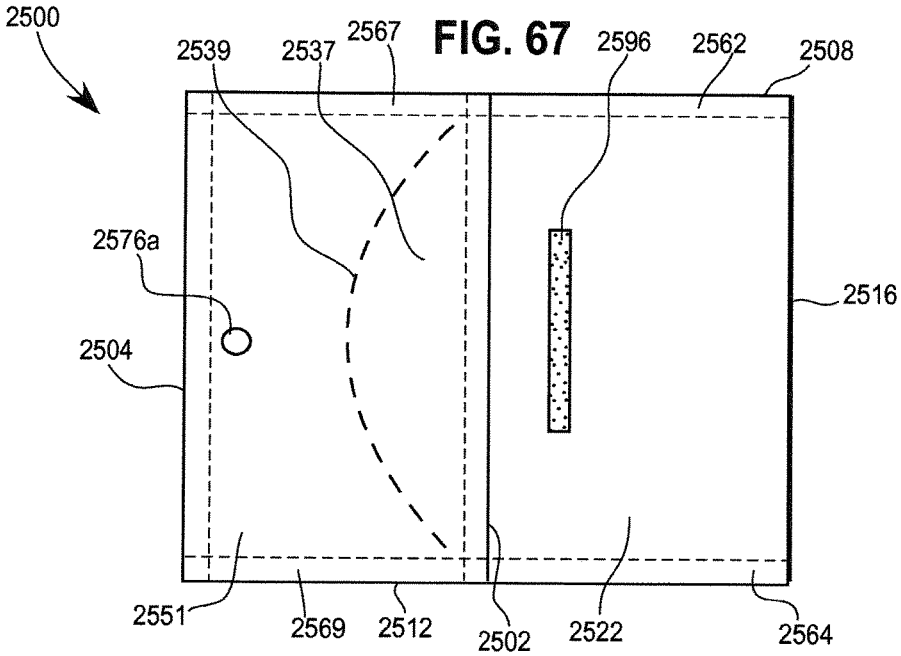
FIG. 67 is a top plan view of the sheet of material of FIG. 65 with the material of the first pouch being folded over the material of the second pouch and before the third pouch is folded to overlay to the first pouch.

The package 2400 can be manufactured from a single sheet or web of flexible material 2500. The flexible material 2500 may be a film made of one or more polymers, laminates, metalized polymers, paper, or the like. For clarity of illustrating the method, a portion of the flexible film 2500 from which a single package 2400 may be manufactured is depicted in FIGS. 65-67. The exemplary single sheet of the flexible film 2500 depicted in FIG. 65 has a leading edge 2508, a rear edge 2506, a first longitudinal side edge 2502, a second longitudinal side edge 2504, and an upward-facing surface 2510. It will be appreciated that the leading edge 2508 and the rear edge 2506 may reverse depending on the orientation of the machine direction in the method manufacturing such that the leading edge 2508 may become the rear edge and the rear edge 2506 may become the leading edge, and that the sheet illustrated in FIGS. 65-67 may be part of a longer web of film.

As the flexible film 2500 is moved in the machine direction, a food product 90 is deposited onto the upward-facing surface 2510 of the flexible film 2500, as shown in FIG. 65. Specifically, the food product 90 is positioned on areas of the film 2522, 2526, and 2545, which will form the outer walls 2422, 2426, and 2445 of the first, second, and third pouches, 2412, 2414, and 2435, respectively. The flexible film 2500 has a central fold zone where a first fold line 2512 may be formed in the flexible film 2500 when the film 2500 is folded approximately in half about the central fold line 2512 from the open sheet configuration shown in FIG. 65 to the folded configuration shown in FIG. 66 to envelope the food product 90.

Specifically, the leading edge 2508 of the flexible film 2500 is folded about the fold zone 2512 and brought toward the rear edge 2506 such that the leading edge 2508 overlies the rear edge 2506. The leading edge 2508 may overlie the rear edge 2506 directly as shown in FIG. 65 such that the two edges 2506 and 2508 are co-linear. In an alternative approach, the leading edge 2508 may be offset from the rear edge 2506 in either direction.

With the flexible film 2500 being folded once as shown in FIG. 66, areas of the film 2524, 2528, and 2551, which will form the interior panels 2424, 2428, and 2451 of the first, second, and third pouches 2412, 2414, and 2435, respectively, overlie the areas of the film 2522, 2526, and 2545 to envelope the food product 90. The film 2500 may then be further folded to form a second fold zone or fold line 2516 on one side of the central fold line 2512 and a third fold zone or fold line 2543 on the opposite side of the central fold zone 2512, as shown in FIG. 66. While the central fold line 2512, and second and third fold lines 2516 and 2543 have been shown in FIGS. 65-66 as straight lines, it will be appreciated that one or more of the first, second, and third fold lines 2512, 2516, and 2543 may be non-linear or in a form of an area of the flexible film 100 instead of a single line.

It will be appreciated that the fold lines 2512, 2516, and 2543 may be made in the flexible film 2500 when portions of the flexible film 2500 are folded as shown in FIGS. 66 and 67, or may be pre-made in the flexible film 2500 before or after the flexible film 2500 is unwound from a feed roll in the machine direction. In an approach where the fold lines 2512, 2516, and 2543 are created in the flexible film 2500 prior to folding of the flexible film 2500, such fold lines can be made, for example, by suitable rollers, lasers, or the like. For example, optionally, the fold lines 2512, 2516, and 2543 may not be made in the flexible film 2500, and the flexible film 2500 may be folded without the fold lines 2512, 2516, and 2543. With the flexible film 2500 being folded as shown in FIG. 66 to form the first fold line 2512, the second fold line 2516 corresponds to the hinge 2416 between the first and second pouches 2412 and 2414 of the formed package 2400, and the third fold line 2543 corresponds to the hinge 2443 between the third pouch 2435 and the second pouch 2414 of the formed package 2400.

Prior to, or after depositing the food product 90 on the flexible film 2500 and prior to, of after making the first second, and third fold lines 2512, 2516, and 2543 in the flexible film 2500, lines of weakness 2537, 2570, and 2571 are made in the flexible film 2500, as shown in FIG. 65. The lines of weakness 2537, 2570, and 2571 can be formed in the flexible film 2500 using, for example, laser ablation, die-cutting, micro-abrasion, or other suitable means. The lines of weakness 2537, 2570, and 2571 in the flexible film 100 correspond to the lines of weakness 2437, 2470, and 2471 of the first, second, and third pouches 2412, 2414, and 2435, respectively.

With the film 2500 being folded as shown in FIG. 66, end seals 2462, 2466, and 2467 may be formed proximate the edge 2508, for example, using an adhesive, or another suitable sealing technique (e.g., heat sealing) as described above. For example, the sealing margins 2480*a*, 2480*b*, 2480*c*, 2480*d*, 2480*e*, 2480*f*, 2480*g*, 2480*h* shown in FIG. 65, where the end seals 2462, 2464, 2466, 2468, 2467, and 2469 are formed in FIG. 66 may include metalized areas to facilitate the heat sealing of the sealing margins to form the end seals 2462, 2464, 2466, 2468, 2467, and 2469 of the package 2500. The edges of the metalized areas the sealing margins 2480*a*, 2480*b*, 2480*c*, 2480*d*, 2480*e*, 2480*f*, 2480*g*, 2480, that coincide with the edges of the sealing margins of the end seals 2462, 2464, 2466, 2468, 2467, and 2469 are indicated in dotted lines in FIG. 66 because the metalized areas are on an underside of the flexible film 2500 (illustrated as the upper facing surface 2510 in FIG. 65). The metalized areas can include, for example, foil, or another reflective material. It will be appreciated that the metalized areas are optional and the flexible film 2500 may lack the metalized areas, in which case such areas can correspond to sealing zones.

With reference to FIG. 66, the area 2570 of the flexible film 2500 between the first line of weakness 2572 and the fold line 2516 and/or a sealing margin adjacent the fold line 2516 corresponds to the closure flap 2470 of the first pouch 2412. The area 2571 of the flexible film 2500 between the second line of weakness 2573 and the fold line 2516 and/or a sealing margin adjacent the fold line 2516 corresponds to the closure flap 2471 of the second pouch 2414. The area 2537 of the flexible film 2500 between the third line of weakness 2539 and the fold line 2543 and/or a sealing margin adjacent the fold line 2543 corresponds to the closure flap 2437 of the third pouch 2435.

With the flexible film 2500 being positioned as shown in FIG. 66, an adhesive 2596, for example, a single elongated strip as shown, or spaced apart multiple strips or dots, is applied to the area 2570, which will permit the areas 2570 and 2571 to be at least in part non-detachably attached to each other when the flexible film 2500 is folded to the configuration shown in FIG. 67. In addition, optionally, an adhesive 2576*b*, for example, a glue dot may be applied to the area 2524 of the flexible film 2500. The adhesive 2576*b* corresponds to the adhesive area 2476*b* of the package 2400, which permits reclosure of the first and second pouches 2412, 2414 after the package 2400 is opened for the first time.

The flexible film is then folded from the configuration shown in FIG. 66 to the configuration shown in FIG. 67. Specifically, the longitudinal edge 2502 of the flexible film 2500 is folded about the fold line 2516 and brought toward the fold line 2543 such that the fold line 2516 overlies the fold line 2543. The crease line 2516 may overlie the fold line 2543 directly as shown in FIG. 67 such that the two fold lines 2516 and 2543 are co-linear, or the fold line 2516 may be optionally offset from the fold line 2543 in either direction.

With the flexible film 2500 being positioned as shown in FIG. 67, an adhesive 2596, for example, a single elongated strip as shown, or spaced apart multiple strips or dots, is applied to a portion of the area 2522 (which underlies the area 2524 in FIG. 66). The adhesive 2596 permits the area 2537 of the flexible film 2500 to be at least in part non-detachably attached to a portion of the area 2522 when the flexible film 2500 is folded to the final formed and closed configuration shown in FIG. 68. In addition, optionally, an adhesive 2576*a*, for example, a glue dot may be applied to the area 2551 of the flexible film 2500. The adhesive 2576*a* corresponds to the adhesive area 2476*a* of the package 2400 and permits reclosure of the third pouch 2435 to the first pouch 2412 after the package 2400 is opened for the first time.

It will be appreciated that the three-pouch package 2400 may interchangeably incorporate one or more features of the other packages described above. For example, the three-pouch package 2400 may be used with an external cover similar to the cover 1300 shown in FIG. 27. The lines of weakness 2472, 2473, and 2439 along which the closure flaps 2470, 2471, and 2437 may be separated from their respective pouches 2412, 2414, and 2435 may be arcuate as shown in FIGS. 50 and 66, one or more of the lines of weakness 2472, 2473, and 2439 may be straight and parallel to (e.g., as in FIG. 15) the longitudinal edges of the flexible film from which the package 2400 is made, or straight and non-parallel to (e.g., as in FIG. 43) the longitudinal edges of the flexible film. Furthermore, the shapes of the closure flaps 2470, 2471, and 2437 may be rectangular as in FIGS. 7 and 10, or may have an irregularly-shaped closure flap 2270 generally shaped like a postal envelope flap as shown in FIG. 59-61. In addition, instead of being formed as part of their respective inner panels 2424, 2428, and 2451 as shown in FIG. 68, the closure flaps 2470, 2471, and 2437 may be folded over their respective inner panels 2424, 2428, and 2451, and attached to an opposite wall of a pouch as shown in FIG. 5, or to another closure flap as shown in FIG. 14. It will also be appreciated that while the three-pouch package 2400 has been illustrated, the number of pouches is being shown by way of example only, and packages having four, five, six, or more pouches may be manufactured in accordance with the principles set forth above.

The packages described herein can be more cost-effective to manufacture than packages requiring multiple sheets of film, multiple flaps, and/or multiple adhesive strips. However, multiple sheets of film could be joined together and utilized as desired. The packages also require less materials and result in less waste as they do not require an overwrap. In addition, the packages have an easy and intuitive opening mechanism and may open like a book, which may be visually appealing to consumers.

In any of the foregoing packages, the seal of the flap to an adjacent pouch or between flaps does not have to be continuous across the width of the package. For example, and with reference to the embodiment of FIGS. 1-5, the seal of the flap 70 to the interior panel 28 of the adjacent pouch 14 does not have to be continuous between the top edge 56 and the bottom edge 58 of the pouch 14. Although the seal can be continuous, the seal can be discontinuous along its length, can be only proximate the top edge 56 and the bottom edge 58, can be only in a region between the top edge 56 and the bottom edge, or other suitable variations.

Any of the foregoing packages may be made of a variety of materials including, but not limited to, metalized or unmetalized polymers, laminates, plastics, paper, paperboard, cardboard, and the like, as well as combinations thereof. Any of the foregoing packages can optionally be hermetically sealed to maintain the freshness of a food or other product contained in the package prior to initial opening of the packages. Any of the foregoing packages can optionally be configured in non-rectangular formats, such as trapezoidal, circular, ovular, triangular, and the like. Any of the pouches described herein can be divided into multiple pouches, such as be adding seals or otherwise adhering intermediate portions of the pouch to adjacent material.

While the hinges depicted in the figures are formed from folding either rigid or film material, the hinges could take other forms, such as two materials joined together by a lap or other seal or joint, and can have perforations or other line or lines of weakening for presetting the location of the hinge. Although the term "seal" is used herein, such usage does not imply a perfect, hermetic seal, but can also include other forms of adhesion that do not create a hermetic seal, such as glues and other adhesives, whether cold or heat activated, peelable seals, skip seals and the like. Although certain structures are described as being joined, seal or attached to each other, it will be understood that this includes both direct and indirect or relative joining, sealing or attaching, e.g., with intermediate structures.

While preferred embodiments have been described in detail, variations and modifications can be effected within the configurations described herein. It will be understood that many of the described features of the above-described packages can be interchanged with each other to create alternative packages. For example, the various closure flap configurations, e.g., line of weakness, folded over, not folded over, peelable or otherwise rupturable seal or seals, multiple closure flaps, and number of pouches, can be interchanged among the exemplary embodiments to create alternative embodiments. Similarly, the use of three pouches, two pouches, or one pouch and a cover are interchangeable above the various exemplary embodiments.

The invention claimed is:

1. A package comprising:

a first pouch and a second pouch attached relative to each other about a hinge, each of the first and second pouches being configured to contain a product;

a first closure flap attached relative to the first pouch along a first line of weakness and relative to the second pouch at a location spaced from the hinge;

a second closure flap attached to the second pouch along a second line of weakness, the first and second lines of weakness each being spaced from the hinge, the second closure flap being attached to the first closure flap;

the first and second pouches being movable about the hinge from a closed position, where access to the first and second pouches is blocked by the first closure flap and the second closure flap, respectively, toward an open position;

wherein in response to movement of the package from the closed position to the open position, at least one of the first and second closure flaps separates along a respective at least one of the first and second lines of weakness, such that when the package is in the open position, the first and second closure flaps are attached to each other and at least one of the first and second closure flaps is detached relative to at least one of the first and second pouches to provide access to the at least one of the first and second pouches.

2. The package of claim 1, wherein each of the pouches has an opening facing the hinge to provide access to the product.

3. The package of 1, wherein the first flap is attached to at least one of the first and second pouches along a line of weakness.

4. A package comprising:

a first pouch and a second pouch attached relative to each other about both an outer hinge and first and second inner connecting flaps, each of the first and second pouches being configured to contain a product;

the first and second pouches being movable about the hinge from a closed position, where access to the first and second pouches is blocked by the first inner connecting flap and the second interconnecting flap, respectively, toward an open position;

wherein at least one of the first and second inner connecting flaps is configured to at least partially detach relative to at least one of the first and second pouches in response to movement of the first and second pouches from the closed position to the open position to provide access to at least one of the first and second pouches.

5. The package of claim 4, wherein first and second pouches are attached relative to each other about the first and second inner connecting flaps, and wherein the first inner connecting flap is attached to the first pouch, the second inner connecting flap is attached to the second pouch, and the first and second inner connecting flaps are attached to each other.

6. The package of claim 5, wherein the first inner connecting flap is attached to the first pouch along a first line of weakness and the second inner connecting flap is attached to the second pouch along a second line of weakness, and wherein the first and second inner connecting flaps are attached to each other using an adhesive.

7. The package of claim 4, wherein each of the pouches has an inner panel and an outer panel sealed together to define an interior configured to contain a product and a line of weakness formed in the inner panel to define a respective one of the first and second inner connecting flaps separable from the inner panel along the line of weakness to form an opening to access the interior, the first and second pouches attached relative to each other about both the outer hinge and the first and second inner connecting flaps;

wherein, when the first and second pouches are in the closed position, access to the first and second pouches is blocked by the first and second closure flaps being attached to their respective inner panels, and wherein, when the first and second pouches are in the open position, at least one of the first and second connecting flaps is separated from its respective inner panel along its respective line of weakness to provide access to the respective one of the first and second pouches.

8. The package of claim 7, wherein each of the lines of weakness has a section spaced further from the hinge as compared to other sections thereof.

9. The package of claim 7, wherein the inner panel of the first pouch includes a second hinge permitting a portion of the inner panel of the first pouch to fold about the second hinge during movement of the first and second pouches from the closed position toward the open position; the inner panel of the second pouch including a third hinge permitting a portion of the inner panel of the second pouch to fold about the third hinge form during movement of the first and second pouches from the closed position toward the open position; and wherein the portion of the first pouch between the second hinge and the outer hinge is separated by a gap from the portion of the second pouch between the third hinge and the outer hinge, the gap defining a passage extending across at least a portion of the first and second pouches.

10. The package of claim 9, wherein the first pouch is movable to a position where the first inner connecting flap is separated from the inner panel of the first pouch along the line of weakness of the first pouch without separating the second inner connecting flap of the second pouch attached to the inner panel of the second pouch along the line of weakness of the second pouch.

11. The package of claim 10, wherein, when the first pouch is in the position where the first inner connecting flap is separated from the inner panel of the first pouch along the line of weakness of the first pouch, at least one of:

the second hinge is closer to a bottom end of the second pouch than the outer hinge;

a bottom end of the first pouch is movable in a direction away from the outer hinge to separate the second inner connecting flap from the inner panel of the second pouch along the line of weakness of the second pouch to open the second pouch and provide access to the product in the second pouch;

the bottom end of the first pouch is movable in a direction away from the bottom end of the second pouch to increase a length of the package, wherein the length of the package is defined as a distance between the bottom end of the first pouch and the bottom end of the second pouch along a line perpendicular to the outer hinge;

the second hinge is movable in a direction away from a bottom end of the second pouch; and the second hinge is movable in a direction away from the bottom end of the second pouch to a position where the second hinge is further away from the bottom end of the second pouch than the outer hinge.

12. The package of claim 7, wherein the first inner connecting flap is movable relative to the hinge and obstructs at least a portion of the opening of the first pouch to restrict the product from dislodging from the first pouch during movement of the first and second pouches away from each other by a degree of rotation of at least 180 degrees from the closed position to the open position.

* * * * *